US007654940B2

(12) United States Patent
Webber et al.

(10) Patent No.: US 7,654,940 B2
(45) Date of Patent: Feb. 2, 2010

(54) ARM EXERCISE MACHINE WITH SELF-ALIGNING PIVOTING USER SUPPORT

(75) Inventors: Randall T. Webber, La Jolla, CA (US); Bruce Hockridge, San Diego, CA (US); Jeffrey O. Meredith, Del Mar, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

(21) Appl. No.: 11/848,012

(22) Filed: Aug. 30, 2007

(65) Prior Publication Data

US 2008/0058181 A1 Mar. 6, 2008

Related U.S. Application Data

(60) Provisional application No. 60/824,745, filed on Sep. 6, 2006.

(51) Int. Cl.
*A63B 21/062* (2006.01)

(52) U.S. Cl. ..... 482/94; 482/96; 482/100; 482/136; 482/142

(58) Field of Classification Search ..... 482/96–103, 482/133–138, 142; D21/676, 690
See application file for complete search history.

(56) References Cited

U.S. PATENT DOCUMENTS

| | | | |
|---|---|---|---|
| 248,121 | A | 10/1881 | Tuttle |
| 2,145,940 | A | 2/1939 | Marlowe |
| 2,252,156 | A | 8/1941 | Bell |
| 2,481,121 | A | 9/1949 | Kasten |
| 3,446,503 | A | 5/1969 | Lawton |
| 3,592,465 | A | 7/1971 | Fulkerson, Jr. |
| 3,640,528 | A | 2/1972 | Proctor |
| 3,707,285 | A | 12/1972 | Martin |
| 4,004,801 | A | 1/1977 | Campanaro et al. |
| 4,111,414 | A | 9/1978 | Roberts |
| 4,231,568 | A | 11/1980 | Riley et al. |
| 4,300,760 | A | 11/1981 | Bobroff |
| 4,441,708 | A | 4/1984 | Brentham |

(Continued)

FOREIGN PATENT DOCUMENTS

| | | |
|---|---|---|
| CA | 2075331 | 2/1994 |

(Continued)

OTHER PUBLICATIONS

U.S. Appl. No. 11/846,459, filed Aug. 2007, Webber, et al.

(Continued)

*Primary Examiner*—Fenn C Mathew
*Assistant Examiner*—Andrew M Tecco
(74) *Attorney, Agent, or Firm*—Procopio, Cory, Hargreaves & Savitch LLP

(57) ABSTRACT

An arm exercise machine for performing isolation arm exercises has a self-aligning pivoting seat or user support on a main frame and an exercise arm for performing biceps curl and/or triceps extension exercises which is linked to the pivoting user support to translate movement of the exercise arm into movement of the user support. The user support is pivotally mounted on the main frame so as to automatically align in order to maintain positioning of the user throughout the exercise motion.

40 Claims, 48 Drawing Sheets

U.S. PATENT DOCUMENTS 4,632,390 A 12/1986 Richey
4,641,833 A 2/1987 Trethewey
4,700,946 A 10/1987 Breunig
4,743,010 A 5/1988 Geraci
4,793,608 A 12/1988 Mahnke et al.
4,822,038 A 4/1989 Maag
4,844,456 A 7/1989 Habing et al.
4,911,438 A 3/1990 Van Straaten
4,944,641 A 7/1990 Alves
4,949,951 A 8/1990 Deola
4,949,958 A 8/1990 Richey
5,100,128 A 3/1992 Mabry
5,106,081 A 4/1992 Webb
5,108,095 A 4/1992 Nichols
5,250,013 A 10/1993 Brangi
5,254,067 A 10/1993 Habing et al.
5,263,914 A 11/1993 Simonson et al.
5,267,930 A 12/1993 Henes
5,299,997 A 4/1994 Chen
5,322,489 A 6/1994 Webb
5,330,404 A 7/1994 Lopeteguy et al.
5,330,405 A 7/1994 Habing et al.
5,334,120 A 8/1994 Rasmussen
5,342,269 A 8/1994 Huang et al.
5,342,270 A 8/1994 Jones
5,346,447 A 9/1994 Stearns
5,352,171 A 10/1994 Lin
5,354,248 A 10/1994 Rawls et al.
5,356,357 A 10/1994 Wang et al.
5,356,358 A 10/1994 Chen
D357,041 S 4/1995 McBride et al.
5,417,634 A 5/1995 Habing
5,421,796 A 6/1995 Jones et al.
5,437,589 A 8/1995 Habing
5,447,480 A 9/1995 Fulks
5,453,066 A 9/1995 Richter, Jr.
5,458,553 A 10/1995 Wu
5,478,298 A 12/1995 Chen
5,499,959 A 3/1996 Holmes et al.
5,503,608 A 4/1996 Chang
5,507,710 A 4/1996 Chen
5,520,599 A 5/1996 Chen
5,527,243 A 6/1996 Chen
5,527,249 A 6/1996 Harris
5,527,250 A 6/1996 Chen
5,533,953 A 7/1996 Lui et al.
5,540,639 A 7/1996 Potts et al.
D372,509 S 8/1996 Yang
5,547,444 A 8/1996 Huang et al.
5,549,530 A 8/1996 Fulks
5,554,086 A 9/1996 Habing et al.
5,562,577 A 10/1996 Nichols et al.
5,573,482 A 11/1996 Wang et al.
5,580,340 A 12/1996 Yu
5,580,341 A 12/1996 Simonson
5,582,563 A 12/1996 Fan
5,603,678 A 2/1997 Wilson
5,616,105 A 4/1997 Wang
5,626,542 A 5/1997 Dalebout et al.
5,643,147 A 7/1997 Huang
5,643,152 A 7/1997 Simonson
5,658,227 A 8/1997 Stearns
5,669,865 A 9/1997 Gordon
5,672,142 A 9/1997 Wu
5,674,161 A 10/1997 Lin
5,676,626 A 10/1997 Huang
5,683,334 A 11/1997 Webber
5,690,593 A 11/1997 Huang
5,695,434 A 12/1997 Dalebout et al.
5,702,328 A 12/1997 Mansvelt
5,720,695 A 2/1998 Eckmann
5,722,918 A 3/1998 Lee
5,733,229 A 3/1998 Dalebout et al.
5,733,232 A 3/1998 Hsu
5,749,813 A 5/1998 Domzalski
5,803,882 A 9/1998 Habing et al.
5,810,698 A * 9/1998 Hullett et al. ..... 482/96
5,810,701 A 9/1998 Ellis et al.
5,827,158 A 10/1998 Drecksel
5,876,095 A 3/1999 Johnston
5,897,467 A * 4/1999 Habing et al. ..... 482/100
5,899,836 A 5/1999 Chen
5,906,564 A 5/1999 Jacobsen
5,938,570 A 8/1999 Maresh
5,938,571 A 8/1999 Stevens
5,944,641 A 8/1999 Habing
5,961,427 A 10/1999 Habing et al.
5,967,954 A 10/1999 Habing
5,971,901 A * 10/1999 Shaw ..... 482/142
5,989,165 A 11/1999 Giannelli et al.
5,997,446 A 12/1999 Stearns
5,997,447 A 12/1999 Giannelli et al.
6,004,247 A 12/1999 Webber
6,024,677 A 2/2000 Siwertz
6,056,678 A 5/2000 Gianelli et al.
6,071,216 A 6/2000 Gianelli et al.
6,074,328 A 6/2000 Johnson
6,080,091 A 6/2000 Habing et al.
6,086,521 A 7/2000 Solland
6,135,930 A 10/2000 Kuo
6,142,914 A 11/2000 Crawford et al.
6,142,917 A 11/2000 Giannelli et al.
6,152,864 A 11/2000 Giannelli et al.
6,162,153 A * 12/2000 Perez et al. ..... 482/96
6,244,995 B1 6/2001 Prsala
6,251,047 B1 6/2001 Stearns et al.
6,264,588 B1 7/2001 Ellis
6,302,832 B1 10/2001 Stearns
6,312,366 B1 11/2001 Prusick
6,387,020 B1 5/2002 Simonson
6,394,937 B1 5/2002 Voris
6,491,609 B2 12/2002 Webber
6,605,024 B2 8/2003 Stearns
6,676,577 B2 1/2004 Stearns
6,752,748 B1 6/2004 Scotti
6,811,522 B1 11/2004 McQuinn
6,855,098 B2 * 2/2005 Reitz et al. ..... 482/142
6,913,565 B2 * 7/2005 Mitchell et al. ..... 482/100
6,916,278 B2 7/2005 Webber
6,966,872 B2 11/2005 Eschenbach
6,971,978 B2 12/2005 Hyder
7,052,444 B2 5/2006 Webber
7,052,446 B2 5/2006 Morris et al.
7,070,545 B2 7/2006 Lull et al.
7,108,641 B2 * 9/2006 Pertegaz-Esteban ..... 482/139
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,357,768 B2 * 4/2008 Marshall ..... 482/148
7,361,125 B2 4/2008 Webber et al.
7,384,381 B2 6/2008 Webber et al.
7,468,024 B2 12/2008 Webber et al.
2002/0013199 A1 1/2002 Giannelli et al.
2002/0103058 A1 8/2002 Webber
2002/0187879 A1 12/2002 Ball et al.
2003/0199362 A1 10/2003 Chamberlin
2004/0005966 A1 * 1/2004 Chen ..... 482/100
2005/0032611 A1 * 2/2005 Webber et al. ..... 482/72
2005/0096196 A1 * 5/2005 Webber et al. ..... 482/94

| | | | | |
|---|---|---|---|---|
| 2005/0096197 | A1* | 5/2005 | Webber et al. | 482/94 |
| 2005/0096198 | A1* | 5/2005 | Webber et al. | 482/97 |
| 2006/0211549 | A1 | 9/2006 | Nohejl | |
| 2006/0247107 | A1 | 11/2006 | Carter | |
| 2006/0276313 | A1 | 12/2006 | Hong | |
| 2007/0232462 | A1 | 10/2007 | Webber et al. | |
| 2007/0293377 | A1 | 12/2007 | Webber et al. | |
| 2007/0293378 | A1 | 12/2007 | Webber et al. | |
| 2008/0058176 | A1 | 3/2008 | Webber et al. | |
| 2008/0132389 | A1 | 6/2008 | Webber et al. | |
| 2008/0153677 | A1 | 6/2008 | Webber et al. | |
| 2008/0182732 | A1 | 7/2008 | Webber et al. | |
| 2008/0214365 | A1 | 9/2008 | Webber et al. | |
| 2008/0214367 | A1 | 9/2008 | Webber et al. | |
| 2008/0220950 | A1 | 9/2008 | Webber et al. | |
| 2008/0234110 | A1 | 9/2008 | Webber et al. | |
| 2008/0242517 | A1 | 10/2008 | Webber et al. | |
| 2008/0248929 | A1 | 10/2008 | Webber et al. | |

FOREIGN PATENT DOCUMENTS

| | | | |
|---|---|---|---|
| SU | 1674874 | A1 | 9/1991 |

OTHER PUBLICATIONS

U.S. Appl. No. 11/849,028, filed Aug. 2007, Webber, et al.
U.S. Appl. No. 11/846,472, filed Aug. 2007, Webber, et al.
U.S. Appl. No. 11/846,437, filed Aug. 2007, Webber et al.
Boss Fitness Brochure, 1993.
Hammer Strength, Hammer Brochure, 1993.
FS-403 Shoulder Press, Flex Brochure, 1995.
Paramount Advanced Performance System—Legg Press AP—2800 (brochure dated 2000).
08003 Rower, Gym 80 Brochure, 2001.
Gym 80 Brochure, 2001.
Leg Press, Cybex International Brochure, 2002.
Flex Fitness Brochure, date unknown.
Pace, 318 Dip/Shrug, Hanley International Brochure, date unknown.
FA-508 Dip Machine, Flex Brochure, date unknown.
Sprint by Hogan Industries, date unknown.
Models 217 and 206-2, Polaris Brochure, date unknown.
Hoist Selectionized Duals HD Series, Hoist Brochure, 2002.
Gravity Gym Instruction Manual, Seated Bench Press, date unknown.
Seated Close Grip Bench Press, Gravity Gym Instruction Manual, date unknown.
Vertical Bench Press Machine, Hoist Brochure, 1993.
Sprint by Hogan Industries, Linear Motion Chest Press, date unknown.
Chest Press and Incline Press, plate-loaded, Cybex Brochure, 1996.
Leg Press Machine, Schwinn Natural Strength, European trade magazine, date unknown.
Low Back Machine, Hoist Brochure, HS1225, 2005.
How It Works Flyer, illustration of exercises performed on U.S. Patent No. 5,527,249 of Harris, date unknown.
Sprint Circuit, Hogan Industries Brochure, date unknown.
Bicep Curl PL-2300 and Tricep Extension PL-2200, Paramount Brochure, 1997.
Biceps Curl and Triceps Extension Stations, Cybex Brochure, 1996.
Dual 100, Hoist Fitness Systems Brochure, approximate date 1997.
210 Bicep Curl and 211 Total Tricep, Polaris brochure, 1996.

* cited by examiner

ARM EXERCISE MACHINE WITH SELF-ALIGNING PIVOTING USER SUPPORT

RELATED APPLICATION

The present application claims the benefit of co-pending U.S. provisional patent application No. 60/824,745 filed Sep. 6, 2006, which is incorporated herein by reference in its entirety.

BACKGROUND

1. Field of the Invention

This invention relates generally to an exercise machine for performing isolation exercises, and is particularly concerned with an arm exercise machine with a self-aligning pivoting user support.

2. Related Art

Two most commonly performed arm exercises are the biceps curl and triceps extension. These are isolation exercises, so-called because they involve a single joint, the elbow; require the movement of just one body part, the lower arm; and target a specific muscle group, biceps (curl) and triceps (extension). Because only one joint action is involved, isolation exercise machines use exercise arms with rotational movement that align the pivoting joint of the user with the pivot axis of the arm. It is important that the user is properly positioned when performing these exercises, in order to reduce joint stress and reduce the risk of injury.

There are three major sticking points or hurdles that a user must overcome in order to perform a biceps curl. The first is in the beginning of the exercise, where starting off with the arms fully extended places the elbows in a bio-mechanically weak position and makes it difficult to initiate the curling motion under load. The second is breaking through the gravitational apex of the movement where the elbow is bent at 90 degrees. The final hurdle is achieving full flexion and properly completing the exercise. When performing the exercise with free weights (barbell or dumbbells) users often overcome these sticking points by performing what is often called "cheat" curls. This requires the user to bend their knees slightly, lean forward at the waist and then explode the weight up by thrusting with the legs, swinging the arms and arching the back rearward. This uses momentum to bring the weight to the top of its arc and complete the exercise. While it is considered one of the best ways to increase muscle mass because it allows the user to handle more weight than normally possible with stricter form, it can be harmful to the low back. This version of a biceps curl also involves other body parts as well as inertia to complete the movement, and does not focus strictly on the biceps. To help maintain a stricter form, most biceps curl machines place the user in a fixed seated position with their arms positioned against a pad. While this prevents the user from involving their legs, back and shoulders in the exercise, focusing strictly on their biceps, it can put too much stress on the elbow.

In order to achieve the full exercise range-of-motion, there must be enough pre-stretch at the beginning of the exercise, but too much forces the elbow to hyper-extend under load. Equally important is achieving full flexion to the elbow and completing the exercise. If the resistance is too heavy at the end of the movement, the user will stop short, barely passing the apex; if the resistance is too light there could be a "caming over" effect, where it feels as if the speed at which the handles are moving increases after they pass the gravitational apex.

The same problem points exist for the user performing a triceps extension as on a biceps curl. The beginning of the exercise places the user's hands in close to their body with the elbow bent. This again is a bio-mechanically weak position and makes it difficult to initiate the pushing motion under load. Next is breaking through the gravitational apex of the movement where the elbow is bent at ninety degrees. The final problem point is achieving full extension and properly completing the exercise.

When performing the triceps extension exercise with free weights (barbell or dumbbells) the user is either standing or lying on their back. They start with their upper arms extended outward, elbows bent and hands at head level. They then straighten their arms, moving only at the elbow. The same "cheat" method of swinging or throwing the weights upward to create momentum and involve other muscle groups (shoulders and/or back) is also used during this exercise.

To maintain a strict form, most triceps extension machines place the user in a fixed seated position, arms positioned against a pad, often with their back supported to help brace against the outward push on the exercise arm. In order to achieve the full exercise range-of-motion, there must be enough pre-load at the beginning of the exercise, but too much makes it difficult to unfold a bent arm under load. Equally important is achieving full extension to the elbow and completing the exercise. If the resistance is too heavy at the end of the movement then the user will stop short, barely passing the apex; if the resistance is too light there could be a "caming over" effect, where it feels as if the speed at which the handles are moving increases after they past the gravitational apex.

In attempting to overcome or reduce the problem points discussed above, prior art biceps and triceps exercise machines have used various angles for the arm support pad, added counter-balancing weight to the exercise arm and installed devices to alter the resistance curve during various stages of the exercise movement.

SUMMARY

An isolation arm exercise machine in one embodiment has a user support which is pivotally mounted on a main frame by a pivotal mounting system and has a primary support portion and a secondary portion which support different locations on a user's body and are fixed relative to one another throughout an exercise movement. A user engagement device having at least one user engaging portion is pivotally mounted on the main frame or user support, and movement of the user engagement device is linked to movement of the user support by a connecting link. A load provides resistance to movement of the user support, exercise arm, and/or connecting link. The pivotal mounting system may be a single pivot mount or a four-bar pivotal linkage.

The arm exercise machine in one embodiment is a biceps curl exercise machine, and in another embodiment it is a triceps extension machine. In yet another embodiment, the machine is designed for selectively performing either biceps curl or triceps extension exercises.

The exercise machine is configured to make it easier for a user to perform the initial lift, break the gravitational apex and fully complete an isolation arm exercise. Because the user support and exercise arm move together, the user tends to maintain the same positioning throughout the exercise. By pivoting the user support and tying its pivoting action to the movement of the exercise arm, the user can be supported in a desired form or position to perform an isolation arm exercise while still experiencing the feel of a free-weight "cheat" movement.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
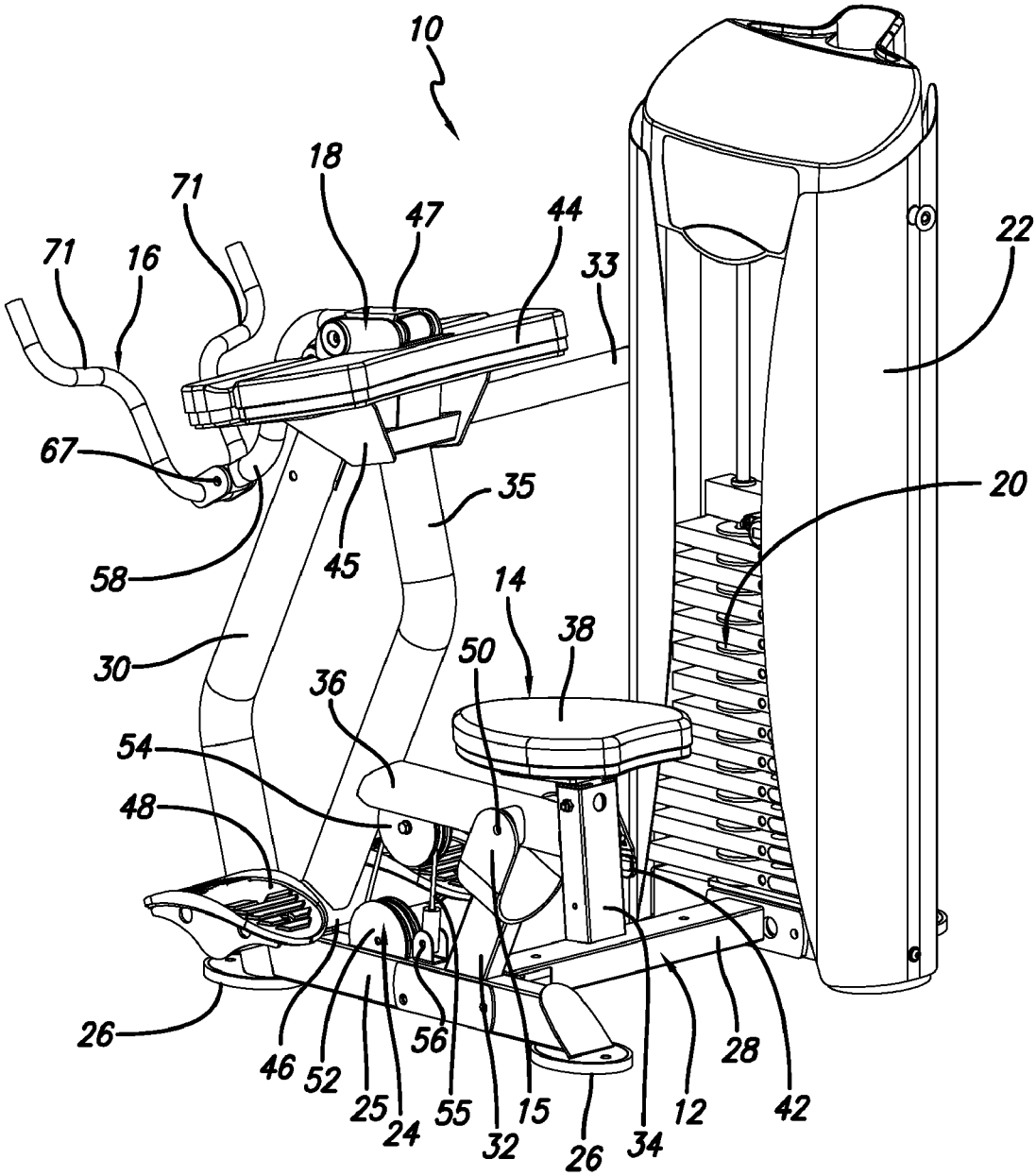
FIG. 1 is a rear perspective view of an arm exercise machine according to a first embodiment.

Certain embodiments as disclosed herein provide for arm exercise machines with a self-aligning pivoting seat or user support, designed for performing isolation arm exercises such as biceps curls or triceps extensions, or both. Triceps extension and bicep curl exercises are isolation exercises in which a single joint is involved, and in which only one body part is moved, specifically the lower arm. They exercise one muscle group, the triceps muscles at the back of the arm in one case, and the biceps muscles at the front of the arm in the other case. In certain embodiments disclosed herein, a pivoting user support is linked to an exercise arm for movement with the arm.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 5 illustrate a biceps curl exercise machine 10 according to a first embodiment. Machine 10 has a main frame 12, a user support 14 pivotally mounted on the frame via a pivot mount 15, and an exercise arm assembly 16 pivotally mounted on the user support and linked to the main frame via a pivoting connecting link 18 so that movement of the exercise arm assembly results in pivoting movement of the user support. The user support 14 is linked to a weight stack 20 mounted in weight stack frame or housing 22 via a cable and pulley linkage 24.

Figure 2:
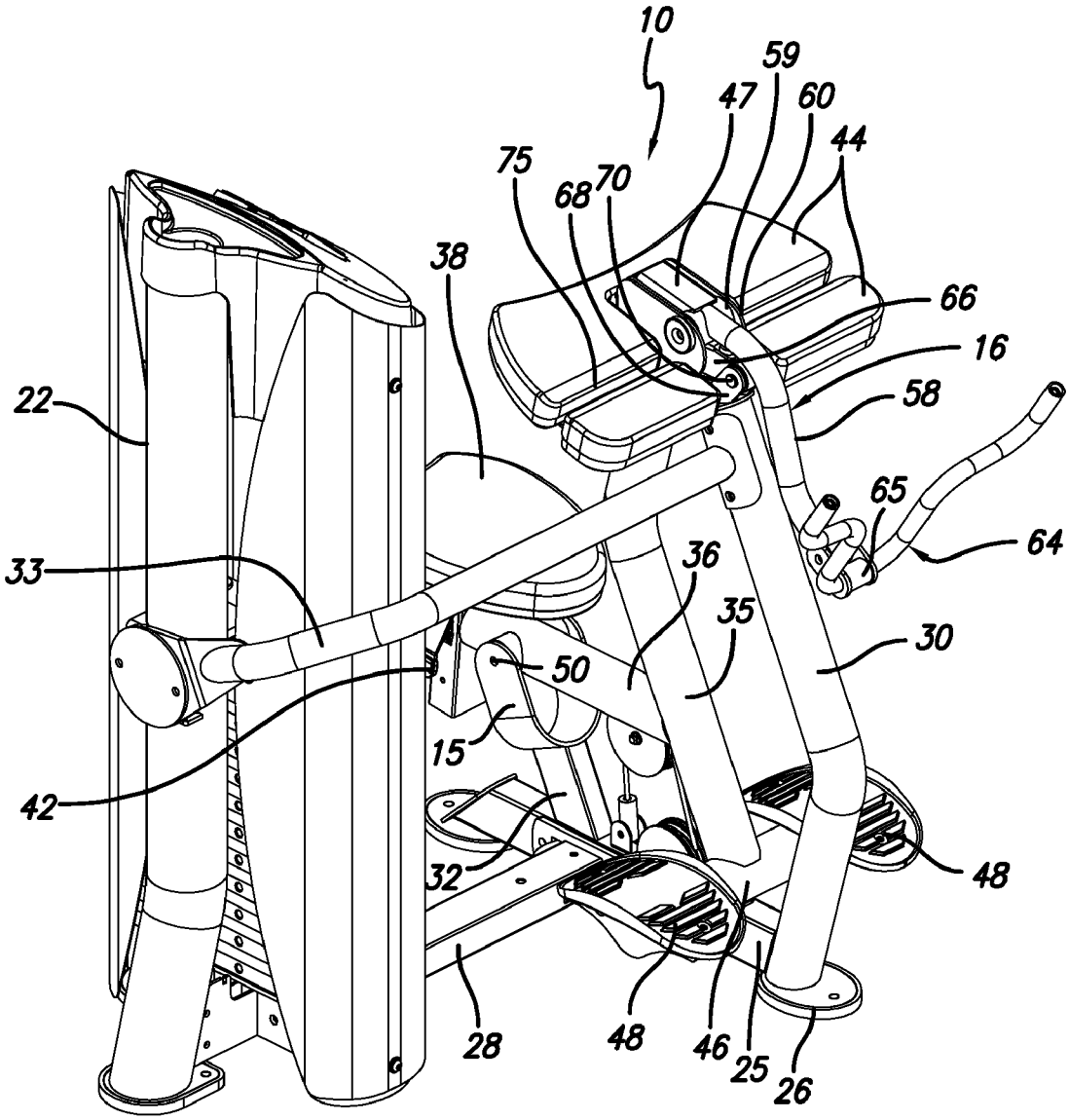
FIG. 2 is a front perspective view of the machine of FIG. 1.
Figure 3:
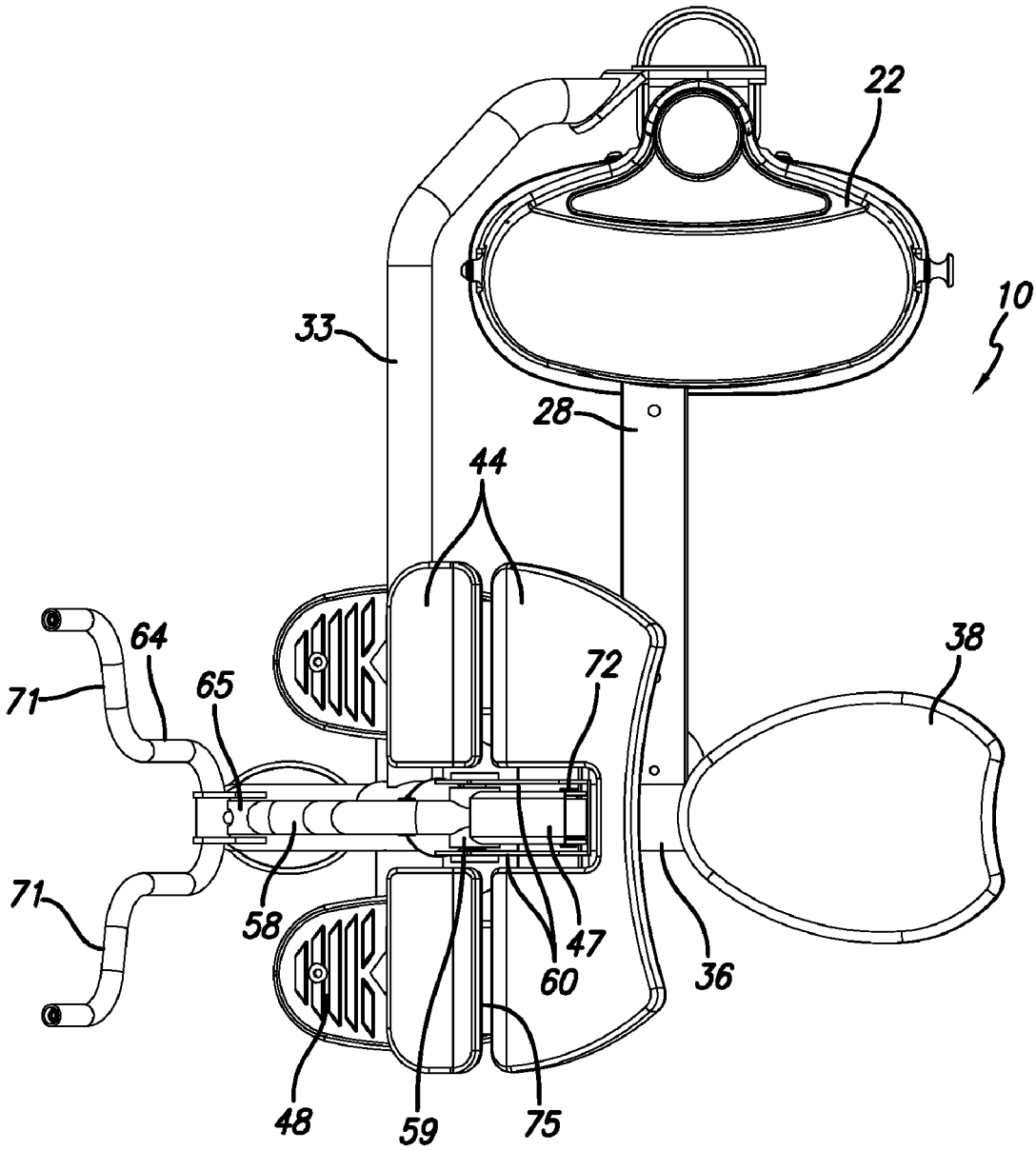
FIG. 3 is a top plan view of the machine of FIGS. 1 and 2.

The main frame 12 has a base section or strut 25 having a ground-engaging pad or foot 26 at each end, a transverse guide tube 28 extending between the strut 25 and the weight stack frame 22, a first upright strut 30 at the forward end of base strut 25, and a rearward inclined, upright post or stand-off 32 at an intermediate point in the length of the strut. Pivot mount or bracket 15 is mounted at the upper end of post 32. A connecting rod 33 extends between forward strut 30 of the main frame and the outer side of the weight stack housing 22, as illustrated in FIG. 2.

User support 14 has a seat support frame comprising a generally upright rear tube 34, a generally upright forward tube 35, and a cross bar or pivot mounting bar 36 extending between tubes 34 and 35. A seat pad 38 is adjustably mounted at the upper end of the rear tube 34 via seat support post 40 which is telescopically engaged in an open upper end of tube 34. Seat support post has a series of openings for releasable engagement with pull pin 42 to adjust the seat pad height based on user size and preference. Arm support pads 44 are mounted at the upper end of forward tube 35 via mounting brackets 45. Adjustment of the seat height accommodates users of different heights by varying the distance between the seat and the arm support pads. A pivot housing 47 extends upwardly from the upper end of the forward tube between the arm support pads. Foot support bar 46 is transversely mounted at the lower end of tube 35 and a foot support 48 is mounted at each end of bar 46 for engagement by a user's feet. Cross support 36 is pivotally attached to pivot mount 15 for rotation about user support pivot axis 50.

Cable and pulley linkage 24 includes a pulley 52 mounted on base strut 25 and a pulley 54 mounted on the underside of user support cross bar 36 approximate its forward end. Cable 55 extends from an anchor 56 on base strut 25, around pulley 54, and then around pulley 52. Cable 55 is then linked to the weight stack through the guide tube 28 in any suitable manner, including additional cables and pulleys.

Exercise arm assembly 16 comprises a main arm 58 having a pivot mount 59 at one end pivotally connected between pivot brackets 60 of the pivot housing 47 at the top of user support forward or upright tube 35 for rotation about first exercise arm pivot axis 62, and a generally U-shaped handle arm member 64 having a central region pivotally attached to a pivot mount 65 at the forward end of main arm 58 for rotation about handle arm pivot axis 67. Each section or arm of the U-shaped handle arm member 64 has an angled step 71 that places the outer ends of the handle arm member at a wider spacing than the inner, web connecting portion. This design allows multiple gripping positions for the user's hands. The pivotal connection between the handle arm member and the main exercise arm enables the user engaging handles to self-align to the user during the exercise and automatically adjust to the user's arm length. A stand-off tube (not visible in the drawings) extends from the main arm pivot mount 59 inside the pivot housing 47 at the top of user support.

Connecting link 18 comprises a link arm or bar 66 which is pivotally attached at one end to a link connecting pivot mount 68 at the upper end of main frame forward upright 30 for rotation about first pivot axis 70. Link 18 is pivotally attached at its second end to a link connecting pivot mount at the end of the stand-off tube of main arm 58 within the housing 47 for rotation about a second pivot axis 72 (see FIG. 3). The first pivot axis 70 of the connecting link is positioned above and forward of the user support pivot axis 50, as best seen in FIG. 4B. A bumper plate 74 with a rubber bumper is mounted on link arm 66 approximate the first pivot point 70 of the link arm 66, as illustrated in FIG. 4B. Exercise arm 58 rests on bumper plate 74 in the rest or exercise start position, as illustrated in FIG. 4A.

In this embodiment, the user support is pivotally mounted to the main frame via the user support pivot mount 15. The exercise arm is pivotally connected by its first pivot mount 59 to the pivot housing 47 located between the user support arm pads. The connecting link pivotally joins the main frame with the exercise arm via the link connecting pivot mount 68 at the upper end of main frame upright 30 and the link connecting pivot mount at the end of the main arm stand-off within pivot housing 47.

Figure 4A:
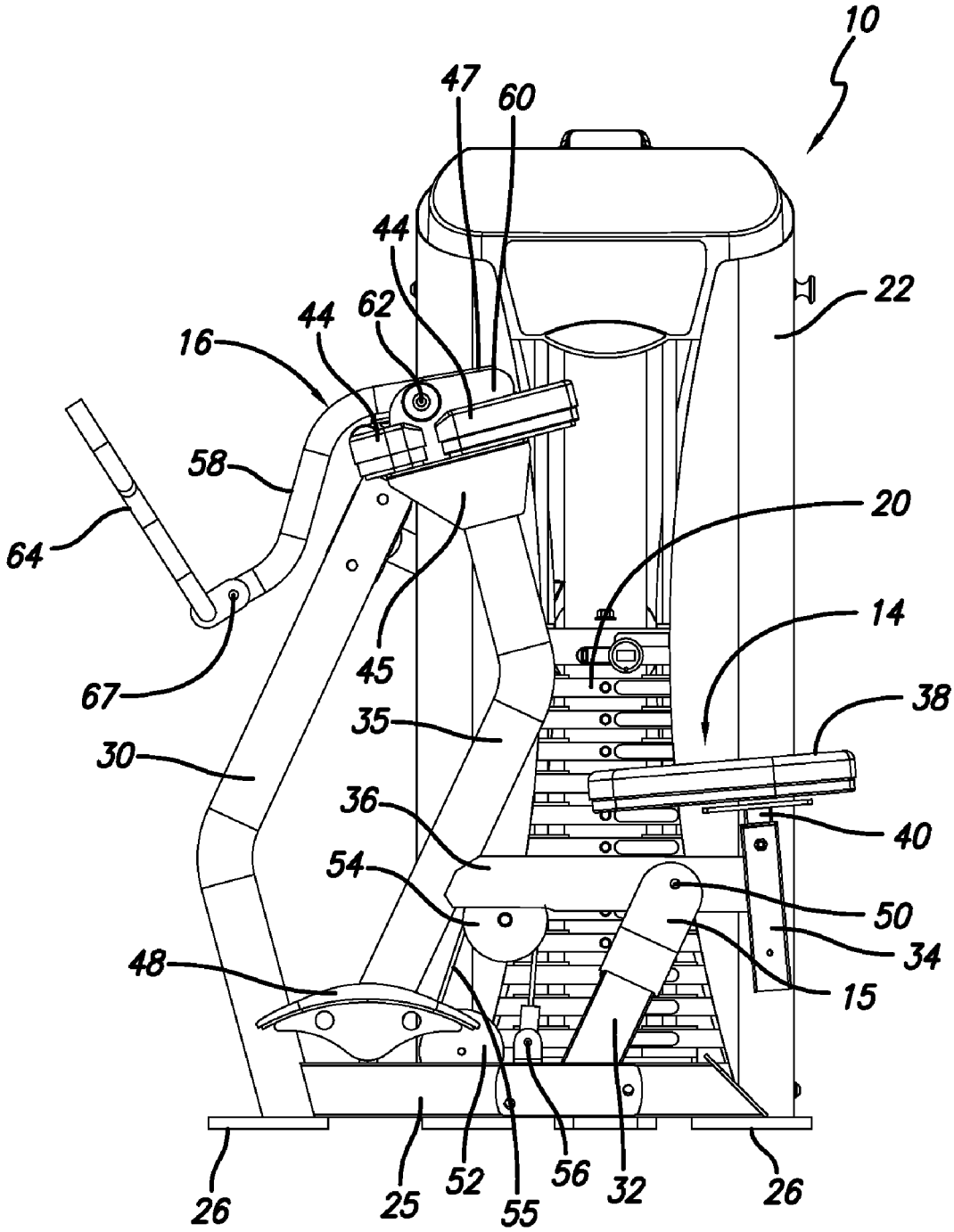
FIG. 4A is a side elevation view of the machine of FIGS. 1 to 3 in a start position for an arm exercise.
Figure 4B:
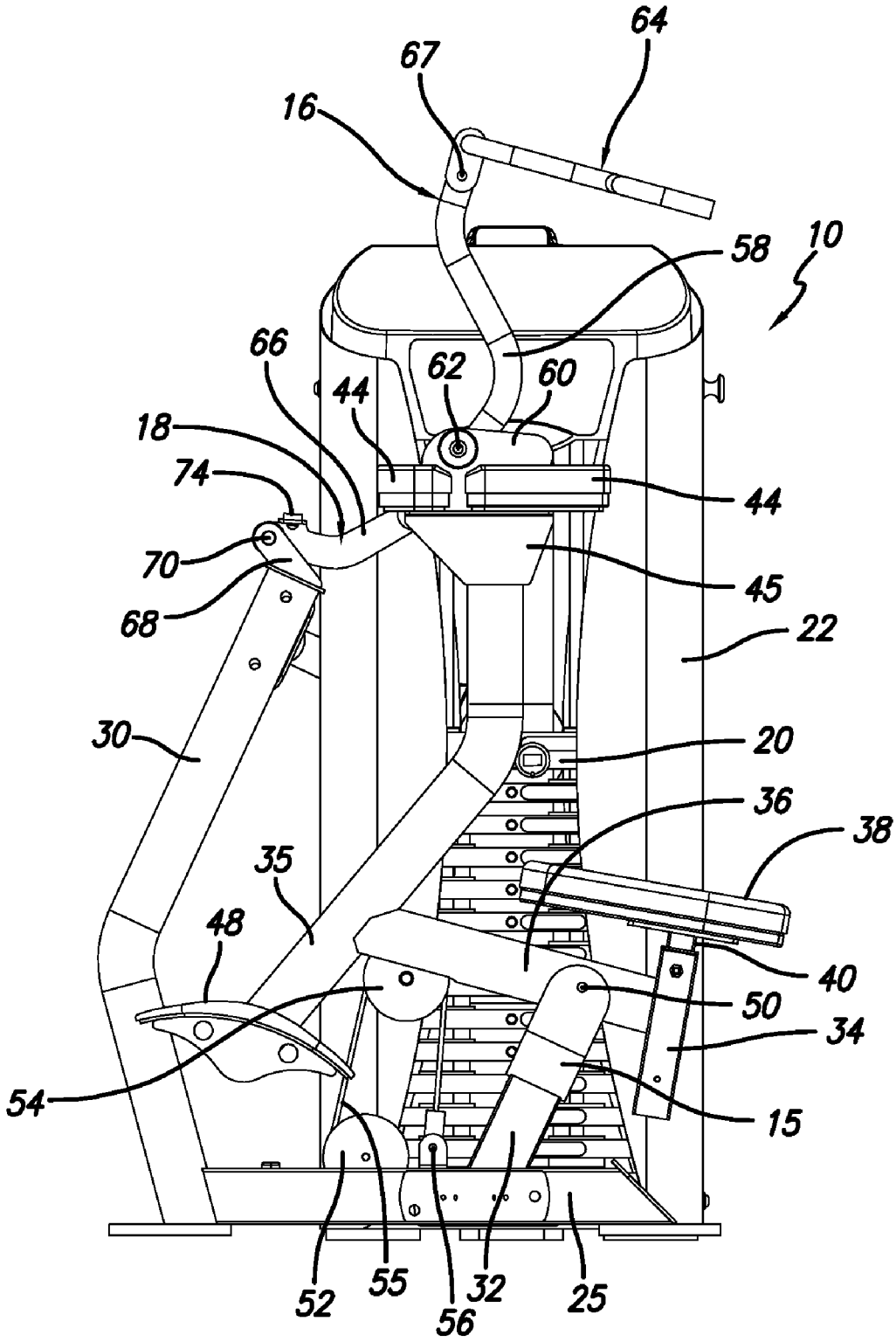
FIG. 4B is a side elevation view of the machine of FIGS. 1 to 3 in a finish position for an arm exercise.
Figure 5A:
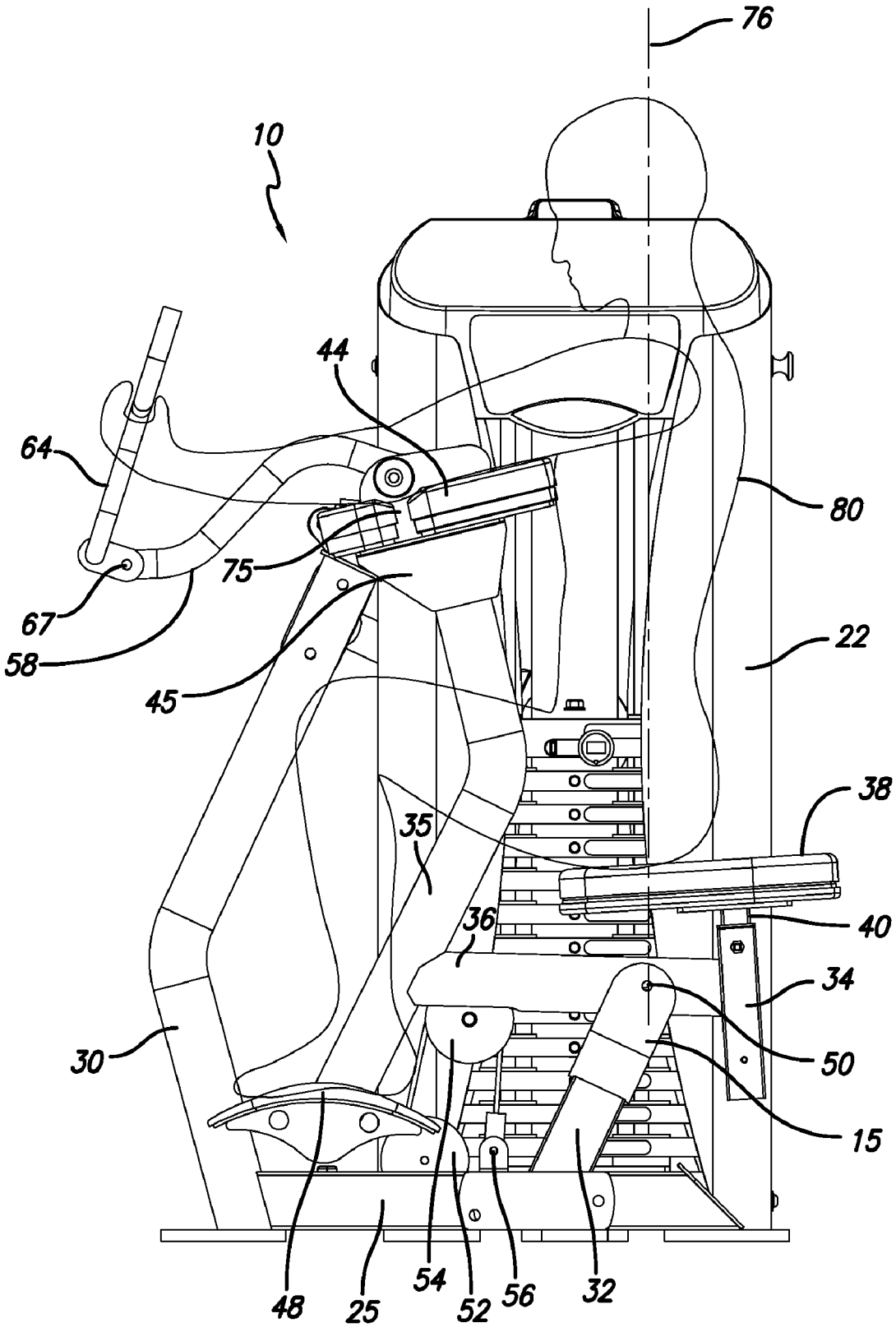
FIGS. 5A and 5B are side elevation views similar to FIGS. 4A and 4B but illustrating a user in position on the machine and performing a biceps curl exercise.
Figure 5B:
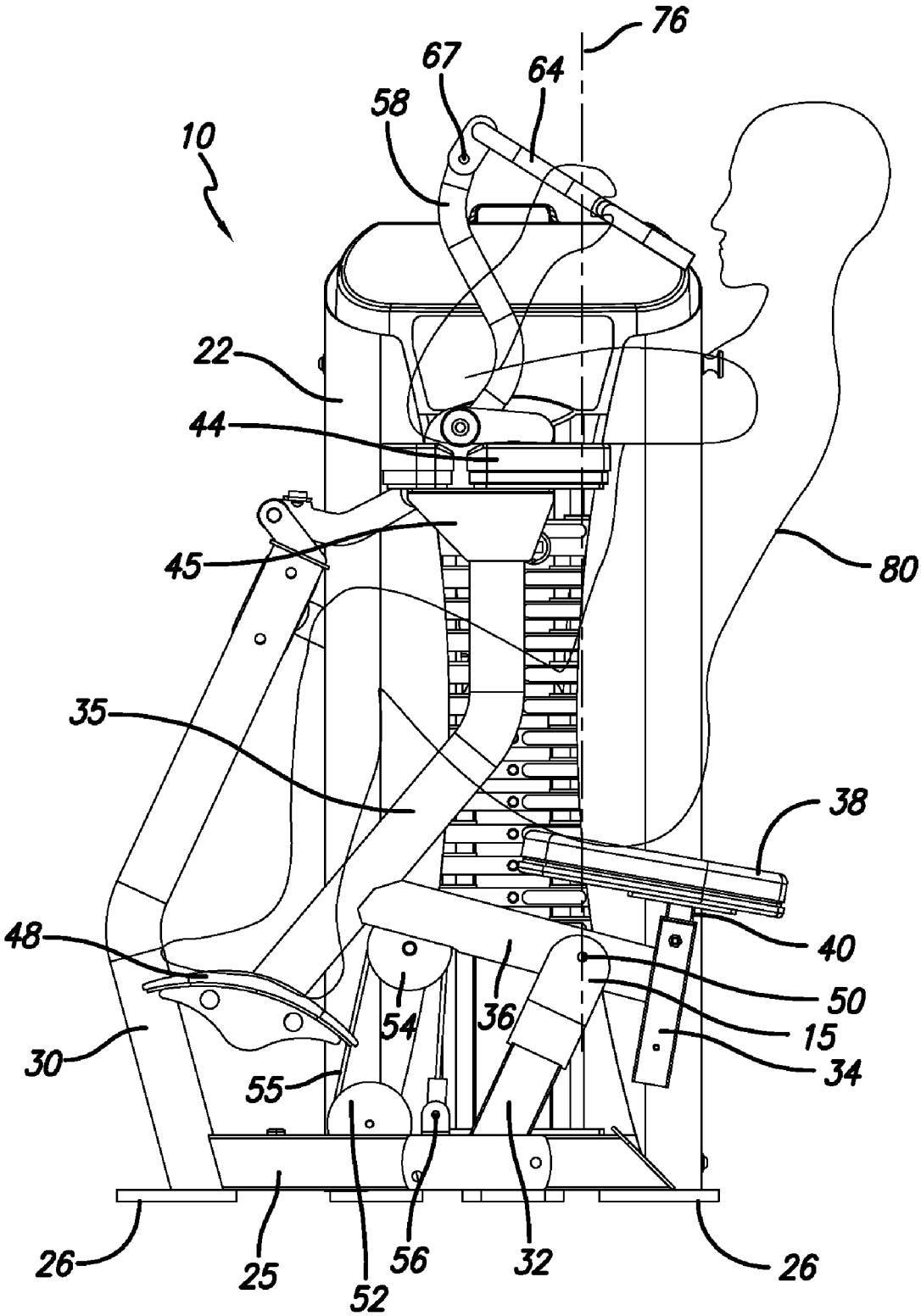

FIG. 4A illustrates the start position for a biceps curl exercise, while FIG. 4B illustrates the finish position. FIGS. 5A and 5B illustrate the same start and finish position with a user 80 seated on the machine and performing a biceps curl exercise. To perform the exercise, the user sits on the seat 38, which rests at a slight forward inclination, places their feet on the foot rests 48 and rests their upper arms on the angled arm support pads 44. The user aligns the pivot of their elbows as closely as possible with the pivot axis 62 at the exercise arm pivotal connection to the user support. Elbow groove 75 in the arm support pads 44 helps align the user. The user then grabs the user engaging handle 64 and starts the exercise movement by pulling the handle upward, towards their head.

This movement causes the exercise arm 16 to pivot about axis 62 relative to the user support, which rotates the stand-off secured to the main arm pivot mount 59 downward. As the stand-off rotates downward, it causes the connecting link 66 to rotate as well as it pivots about its connections to both the exercise arm and the main frame. This in turn forces the user support 14 to rotate, tilting it rearward about the user support pivot axis 50 at the user support's pivotal connection to the main frame. This pivot is designed to reorient the user's position from a forward lean to a rearward lean, duplicating the rearward arching motion of a "cheat" curl. This movement is done without changing the position of the user on the user support. Through out the entire "cheat" movement, the user is in a stabilized position with their feet and upper torso supported. This stabilized position provides a strict exercise movement by preventing the involvement of other muscle groups and focusing effort just on the biceps.

FIGS. 5A and 5B show a user 80 on the machine in the start and finish positions respectively, with the vertical line 76 representing the gravitational centerline of the pivotal movement. This embodiment places a portion of the user and user support on each side of the pivot's gravitational centerline in both the starting and finishing positions. By linking movement of the user support to movement of the exercise arm and positioning the user support pivot so that the combined weight of the user support and user is distributed on both sides of the pivot's gravitational centerline, the user support provides a counter-balancing effect on the exercise arm as it moves and its weight is re-distributed.

In the starting position, more of the combined user and user support weight is distributed towards the front side of the pivot. As the exercise arm is moved, more of this combined weight passes through the gravitational centerline until a more even distribution of weight is achieved. This re-distribution is gradual and continuous throughout the exercise motion and is not noticed by the user. By starting with a portion of the combined weight on the rearward or non-load side of the gravitational centerline, the initial lifting resistance is reduced. Re-distributing more of the combined weight to the non-load side at the end of the exercise increases the counter-balancing effect, lightening the resistive load slightly, which allows the user to come to full flexion and properly complete the exercise movement. This slight counter-balancing move mimics the momentum used on a free weight "cheat" curl to raise the weight to the top of its arc and finish the exercise.

FIGS. 6 to 8 illustrate a second embodiment of a biceps curl exercise machine 100. Machine 100 has a main frame 102, a user support 104 pivotally mounted on the frame via a pivot mount 105, and an exercise arm assembly 106 pivotally mounted on the user support and linked to the main frame via a pivoting connecting link assembly 108 so that movement of the exercise arm assembly results in pivoting movement of the user support. The exercise arm assembly 106 is linked to a weight stack 110 mounted in weight stack frame or housing 112 via a cable and pulley linkage to provide resistance to movement of the arm by a user.

The main frame 102 comprises a base section 114 for engaging the floor and an upright tube 115 located at the forward end of the base section. Upright tube has a rearward inclined upper section 113. A swivel plate 116 is pivotally mounted to a swivel plate bracket approximate the end of upright tube 115 for rotation about pivot axis 117. Swivel plate 116 forms part of the pivoting link assembly 108. A stand-off tube 118 is mounted at an intermediate position on frame base section 114 and user support pivot mount 105 is located at the upper end of stand-off post 118.

The user support 104 has a generally horizontal base tube 120 with user supporting foot rests 122 mounted at or adjacent its forward end and a seat adjuster tube 124 mounted at its second or rearward end in a generally T-configuration. An upright tube or strut 125 with user supporting arm pads 126 mounted at its upper end extends upwardly from the base tube 120 at an intermediate location between foot rests 122 and the seat adjuster tube 124. A pivot housing 128 protrudes upward from the center of the arm support pads 126. A first link connecting pivot mount 130 is located at an intermediate point along upright tube 125 between the base tube 120 and arm pads 126. The base tube 120 of the user support is pivotally attached to the user support pivot mount or bracket 105 for rotation about user support pivot axis 132. A seat post 134 is telescopically engaged in the seat adjuster tube 124 and has a mounting plate 135 at its upper end on which a seat pad 136 is mounted for supporting a seated user. This provides vertical adjustment to the seat and is designed to accommodate users of different heights by varying the distance between the seat and the arm support pads.

Figure 8D:
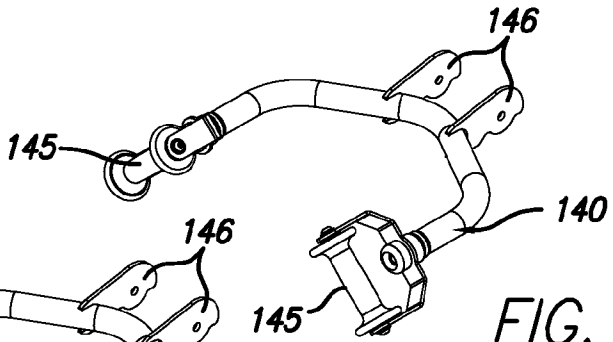
FIGS. 8A to 8D are perspective views of the self-aligning handle of the machine of FIGS. 6 and 7, illustrating various different hand grip positions.
Figure 8C:
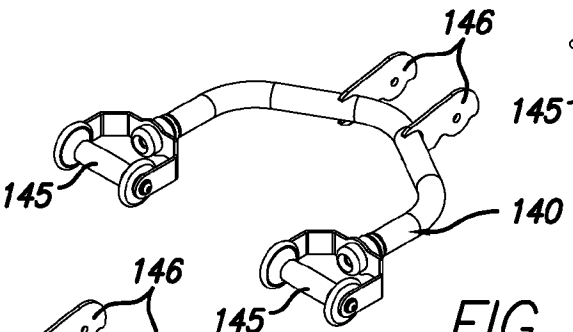
Figure 8B:
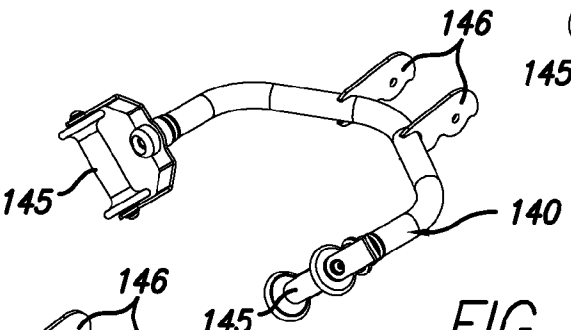
Figure 8A:
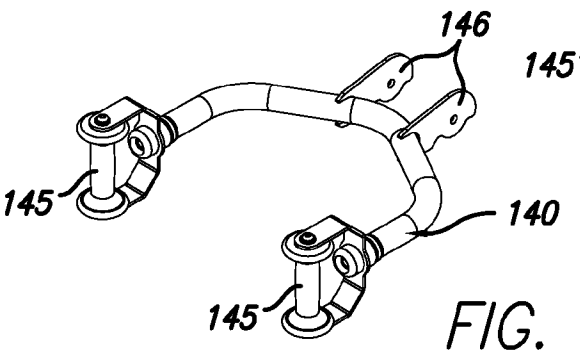
Figure 8E:
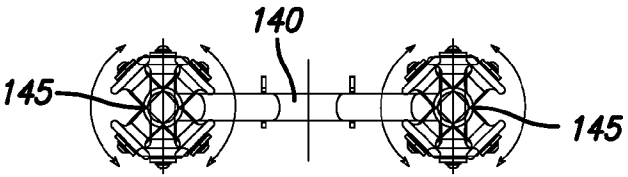
FIG. 8E is a front elevation view of the handle of FIGS. 8A to 8D, showing the range of movement of the rotating hand grips.

The exercise arm 106 has a main tube 138, a user engaging handle bar 140 (illustrated in more detail in FIG. 8), and a stand-off 142. The stand-off 142 is mounted to the main tube at a location intermediate the ends of the tube. The main tube is pivotally attached at its first end to the pivot housing 128 at the top of the user support upright strut 125 for rotation about a first pivot axis 144. The second end of main tube 138 is pivotally connected to the user engaging handle bar 140. The user engaging handle bar 140 is illustrated in more detail in FIG. 8 and is of general "U" shape with user engaging handgrips 145 rotatably mounted at the end of each leg of the handle bar. This arrangement allows multiple gripping positions for the user's hands, and FIGS. 8A to 8D illustrate some of the possible gripping positions. The grips can be positioned at any angle through 360 degrees, as indicated in FIG. 8E. This provides wrist pronation and supination during the exercise movement.

Pivot connecting brackets 146 are located at the central web of the "U" shaped handle, and brackets 146 are pivotally connected to the second end of main tube 138 for rotation about pivot axis 148. This connection enables the user engaging handles to self-align to the user during the exercise and automatically adjust to the user's arm length. A cam 149 (see FIG. 6B) is located approximate the first end of the main tube 138 for receiving a load bearing cable of the cable and pulley linkage.

The connecting link assembly 108 comprises a first and second linkage bar 150, 152 and the swivel plate 116 pivoted at the end of the main frame upright 115. The first linkage bar 150 is shorter than the second linkage bar 152. The first linkage bar is pivotally attached to the pivot mount 130 on the user support upright 125 at one end, for rotation about pivot axis 154. The second end of the first linkage bar is pivotally attached to the swivel plate 116 for rotation about pivot axis 155. The first end of the second linkage bar is pivotally attached to the exercise arm stand-off 142 for rotation about pivot axis 156. The second end of the second linkage bar is pivotally attached to the swivel plate 116 for rotation about pivot axis 158 (see FIG. 6B). The connecting link assembly 108 therefore pivotally links both the exercise arm and the user support to the main frame. The main user support pivot axis 132 beneath seat 136 is positioned lower than and rearward of the pivot axis 154 of the first linkage bar of the connecting link assembly.

In this embodiment, the user support 104 is pivotally mounted to the main frame via the user support pivot mount 105. The exercise arm is pivotally connected by its first pivot mount at axis 144 to the pivot housing 128 located between the user support arm pads 126. The first connecting linkage bar 150 pivotally joins the user support to the swivel plate 116 and the second linkage bar 152 pivotally joins the exercise arm to the swivel plate. The cable and pulley linkage which connects the weight stack to the exercise arm cam 149 includes a pulley 165 mounted on stand-off tube 118 on base section 114 of the main frame and a pulley 166 mounted on the underside of the user support. A cable (not illustrated) runs from pulley 165 to pulley 166, and then attaches to the cam 149 on the exercise arm main tube 138 (see FIGS. 6B and 7B).

Figure 6A:
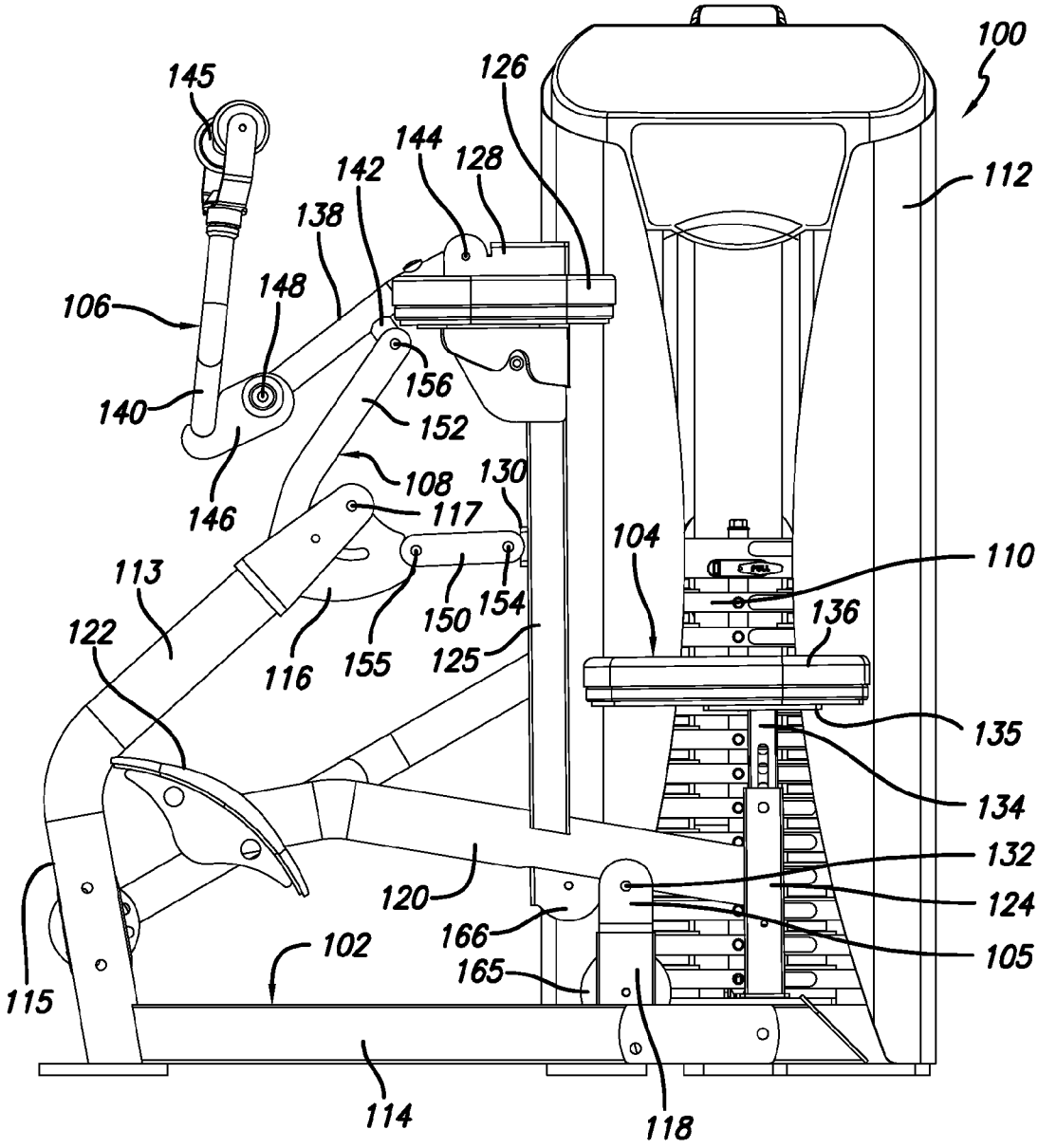
FIG. 6A is a side elevation view of a biceps curl exercise machine according to another embodiment, illustrating an exercise start position.
Figure 6B:
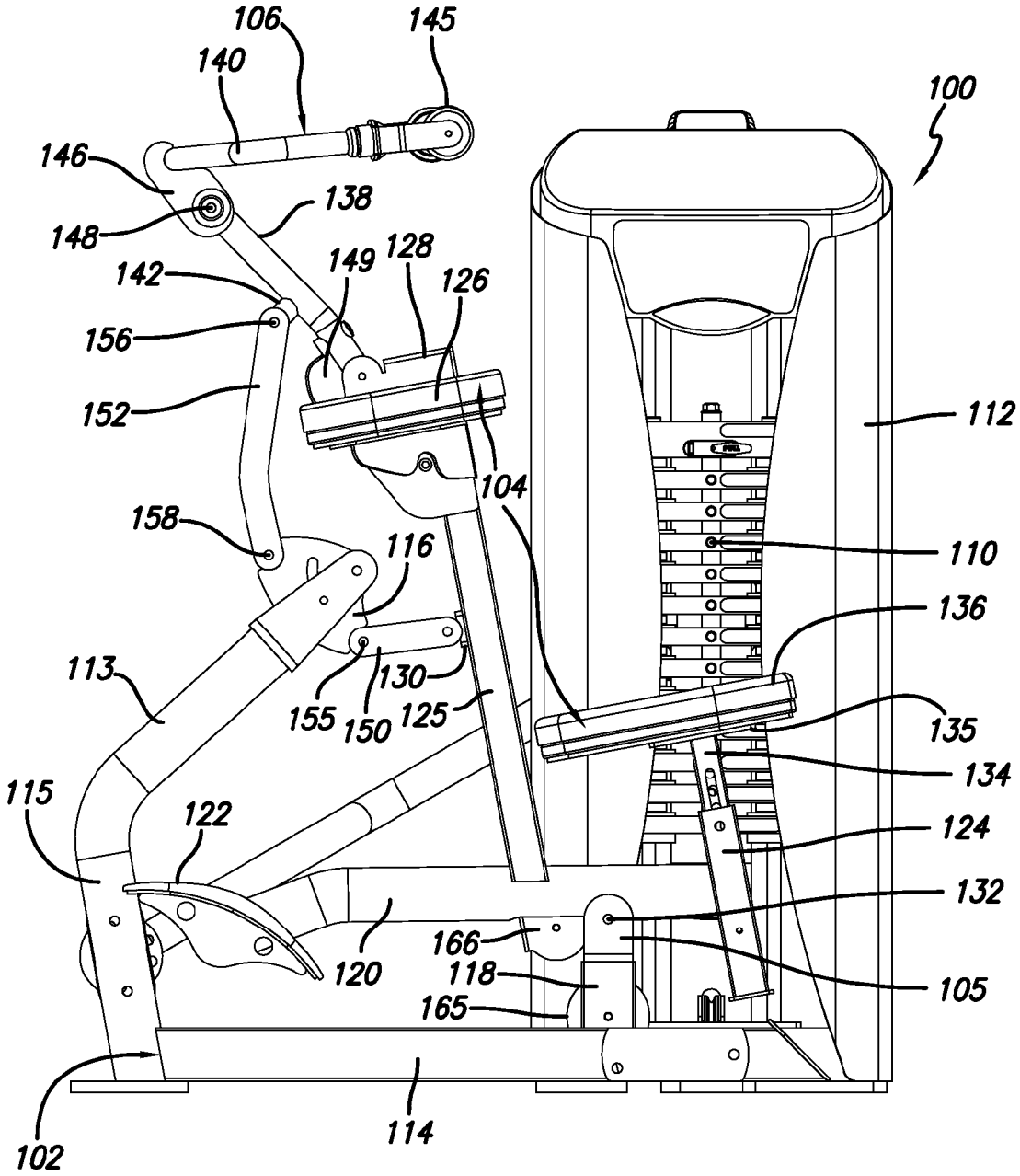
FIG. 6B is a side elevation view the machine of FIG. 6A, illustrating a finish position for a biceps curl exercise.
Figure 7A:
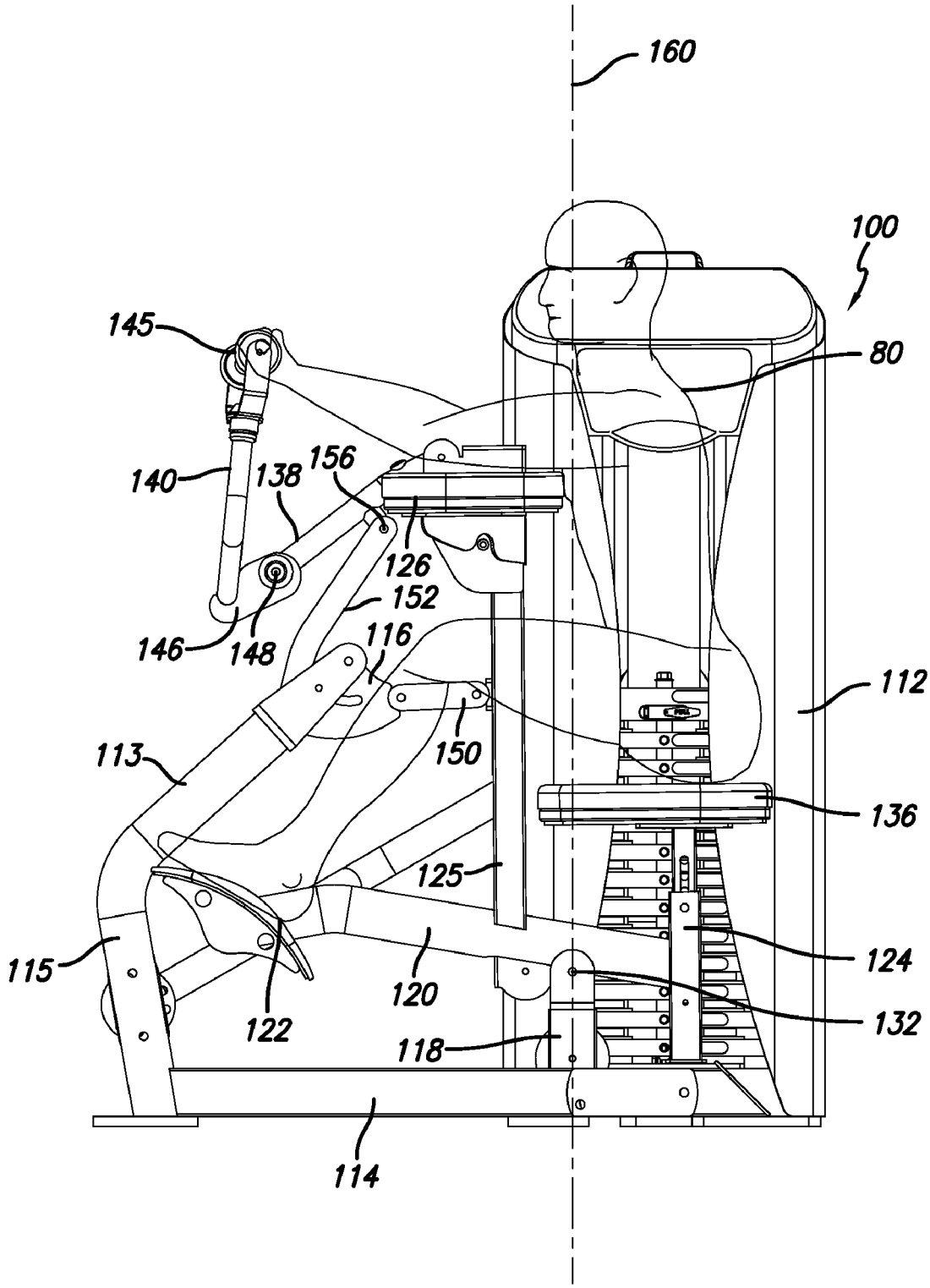
FIG. 7A is a side elevation view of the machine in the position of FIG. 6A, illustrating a user in position on the machine.
Figure 7B:
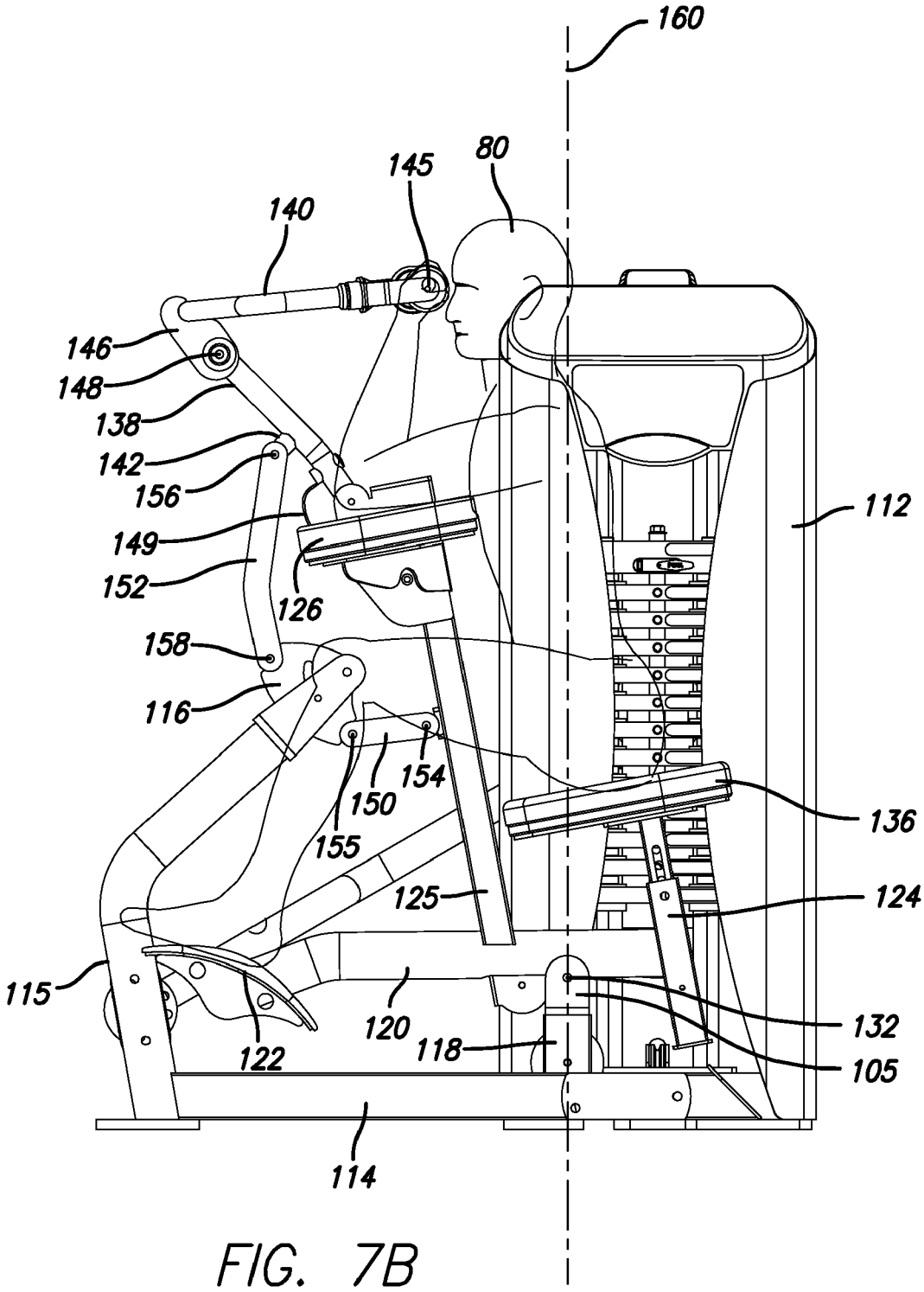
FIG. 7B is a side elevation view of the machine in the finish position of FIG. 6B, with a user positioned on the machine.

FIGS. 6A and 7A illustrate a start position for a biceps curl exercise on machine 100 while FIGS. 6B and 7B illustrate an exercise finish position. A user 80 is shown in position on the machine in FIGS. 7A and 7B. The gravitational centerline 160 of the user support pivot is shown in dotted lines in FIGS. 7A and 7B. To perform the exercise, the user sits on the seat 136, which rests in a substantially horizontal position, places their feet on the foot rests 122, and rests their upper arms on the horizontal arm support pads 126. They then grab the user engaging hand grips 145 and start the exercise movement by pulling the handle upward, towards their head. In carrying out this exercise, the user aligns the pivot of their elbows as closely as possible with the exercise arm pivot axis 144 to the user support. In order to assist the user in properly aligning their elbow for this exercise, an indicating decal can be used to identify the pivot point or axis 144 of the exercise arm.

This movement causes the exercise arm 138 to pivot about its connection to the user support, which pulls the second connecting link bar 152 upwards, causing the swivel plate 116 to rotate about its connection to the upright tube 115 of the main frame. As the swivel plate 116 rotates, it pulls the first connecting linkage bar 150 forward, which in turn pulls the user support 104, causing it to rotate forward about its connection to the main frame at pivot axis 132, unlike the previous embodiment where the user support rotates rearward.

This different movement direction results from the attachment of the multi-part connecting link to the forward end of the user support. FIGS. 6B and 7B illustrate a finish position for a biceps curl exercise on machine 100.

This pivotal action is designed to reorient the user's position from a generally upright position (see FIG. 7A) to a forward lean (see FIG. 7B). This movement feels like it is bringing the user and the exercise arm handles together at a quicker pace, simulating the speed found in the explosive inertia or momentum of a free weight "cheat" curl. However, because the exercise arm is mounted to, and travels with, the user support, it is the sensation of leaning forward as the handles approach the user that creates the feeling of momentum. Because the load is connected to the exercise arm, resistance remains substantially constant during the exercise, with the only variation being the small amount of combined weight (user and user support) that passes through the gravitational centerline 160.

The rocking movement of the user support is achieved without changing the position of the user on the user support. Through out the entire "explosive" movement, the user is in a stabilized position with their feet and upper torso supported. This stabilized position provides a strict exercise movement by preventing the involvement of other muscle groups and focusing effort just on the biceps.

FIGS. 7A and 7B show the portion of the user and user support on each side of the gravitational centerline 160 of the user support pivot in both the starting and finishing positions and how the combined weight is re-distributed during the exercise. By linking movement of the user support to movement of the exercise arm and positioning the user support pivot so that the combined weight of the user support and user is distributed on both sides of the gravitational centerline 160, the user support provides a counter-balancing effect on the exercise arm as it moves and its weight is re-distributed. This slight re-distribution is gradual and continuous throughout the exercise motion and barely noticed by the user. Because the user support falls forward towards the load during the exercise, the portion of the user and user support on the load side, forward of the user support pivot, acts as a counter-balance, helping to reduce the initial lifting resistance. Re-distributing more of the combined weight to the load side at the end of the exercise increases the counter-balancing effect, lightening the resistive load slightly, which allows the user to come to substantially full flexion and complete the exercise movement. This slight counter-balancing move, coupled with the user's forward leaning orientation, mimics the explosive movement used on a free weight "cheat" curl.

FIGS. 9 to 14 illustrate a third embodiment of a biceps curl machine 180. Machine 180 has a main frame 182, a user support 184 pivotally mounted on the main frame by means of a pivot mount 185, an exercise arm assembly 186 pivotally mounted on the user support, a connecting link assembly 188 pivotally connecting the exercise arm assembly to the main frame, and a weight stack 190 housed in a vertical weight stack support frame 192 for providing exercise resistance. The weight stack 190 is linked to the user support by a cable and pulley linkage, part of which is visible in the drawings.

In machine 180, the starting position of the user has changed from a generally upright orientation to a slightly reclined orientation and the roughly horizontal arm support pads positioned in front of the user have been replaced with generally vertical pads placed alongside the user. The user support has a back pad in addition to a seat pad. However, apart from these changes, the same major elements are present in this machine as are found in the other embodiments.

In machine 180, the main frame 182 comprises a base section 194 for engaging the floor and an upright, rearward inclined tube or strut 195 located at the rearward end of the base section. A short upright post 196 with a bumper pad 198 at its upper end is located at the forward end of base section 194. A stand-off post 200 is mounted at an intermediate position on rear strut 195, and user support pivot mount 185 is associated with the outer end of stand-off post 200. A connecting rod 202 is secured between rear strut 195 of the main frame and the outer face of weight stack frame 192. A guide tube 204 for the cable and pulley linkage extends between the base section 194 of the main frame and the weight stack frame or housing 192.

The user support comprises a generally "L" shaped seat support tube 205 with foot rests 206 mounted at the end of the forwardly extending leg 208 of support tube 205. An adjuster tube 210 is vertically mounted on forwardly extending leg between the foot rests 206 and the bend in the L-shaped tube. A seat post 212 is telescopically engaged in the open upper end of adjuster tube 210. Pull pin 213 extends through tube 210 for engagement in an aligned opening in seat post 212 and can be released in order to adjust seat height. Seat pad 214 is secured to a mounting plate at the upper end of seat post 212. This arrangement accommodates users of different heights by varying the distance between the seat and the user engaging handles of exercise arm assembly 186.

Figure 10:
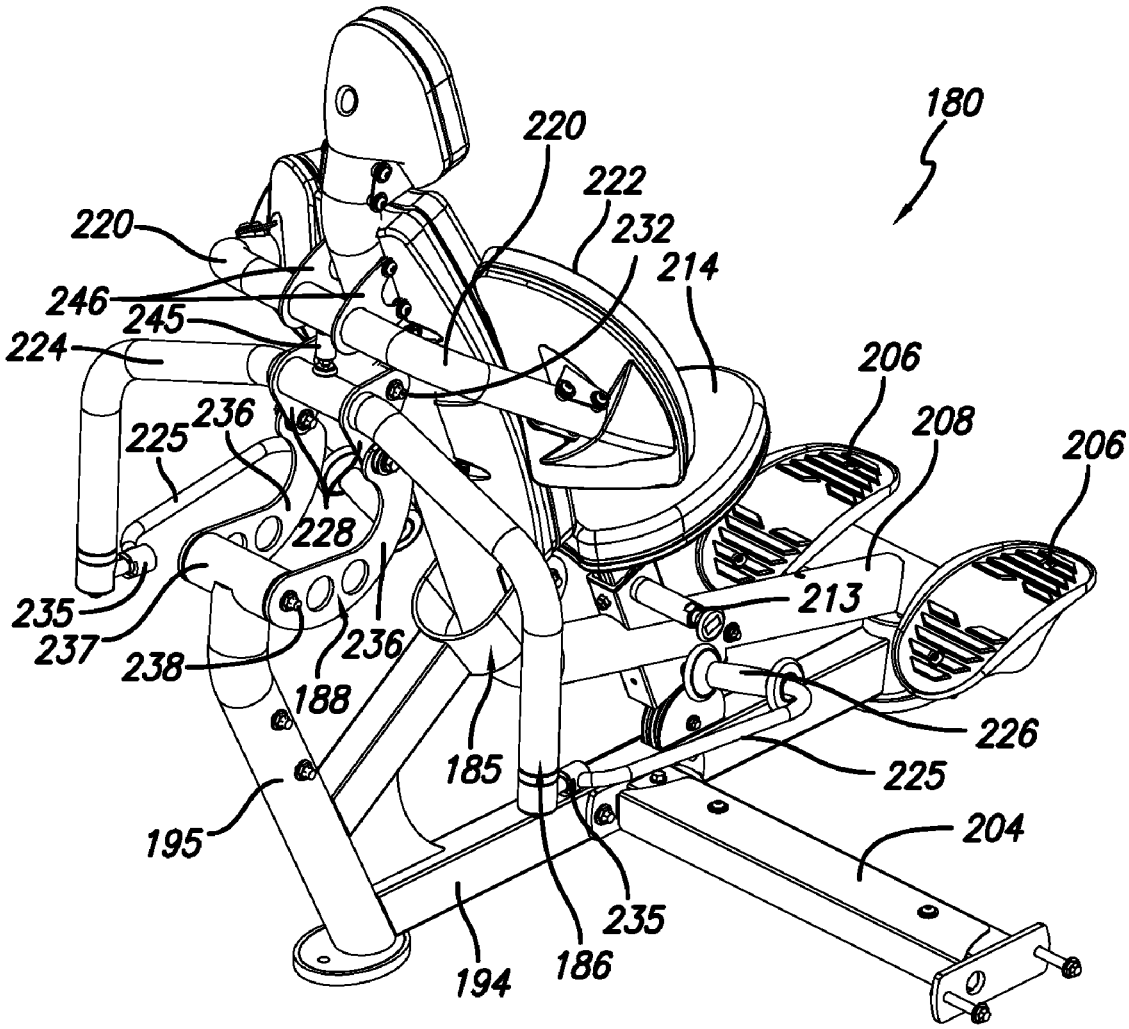
FIG. 10 is a rear perspective view of the machine of FIG. 9.
Figure 11:
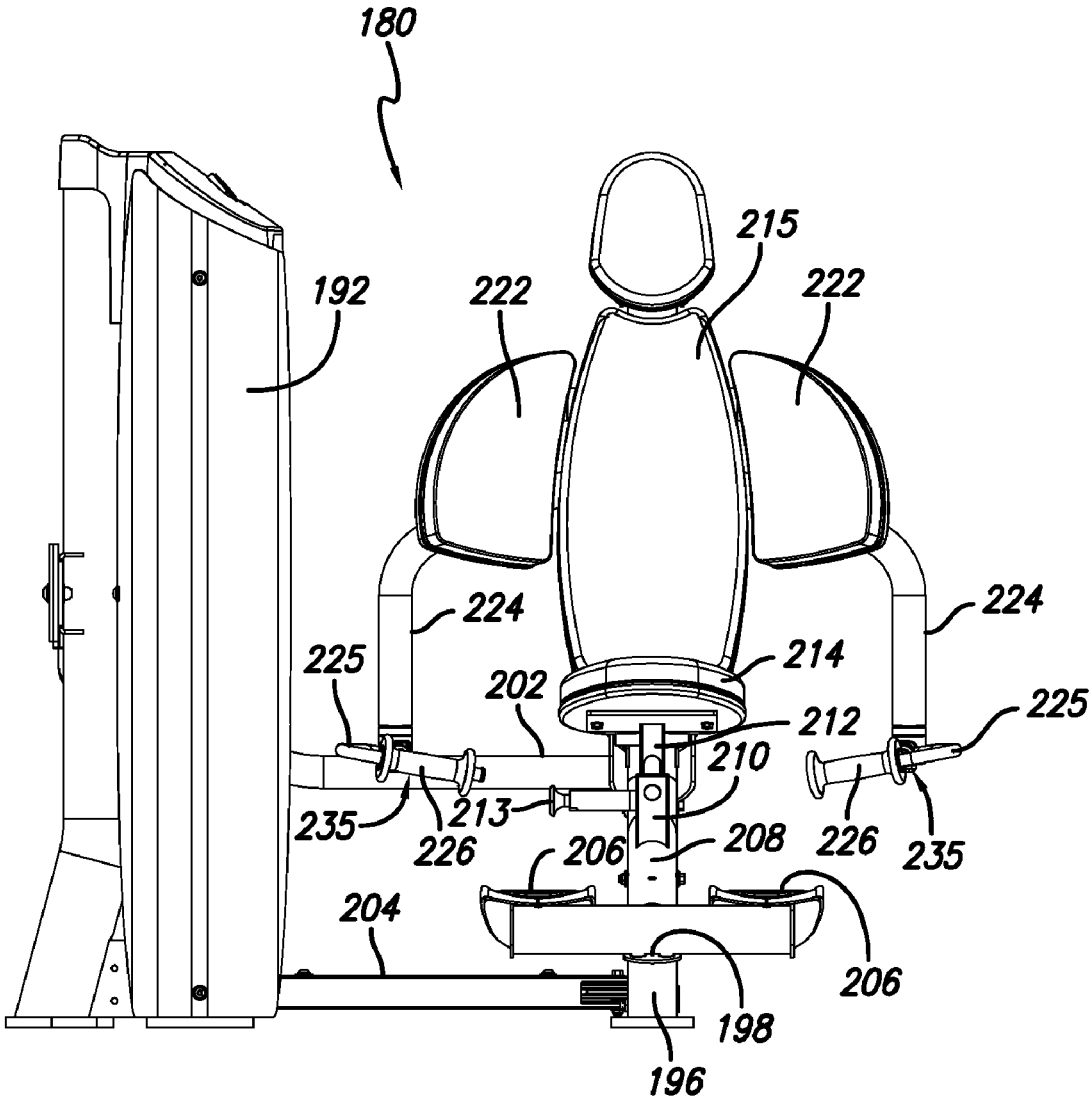
FIG. 11 is a front elevation view of the machine of FIGS. 9 and 10.
Figure 12:
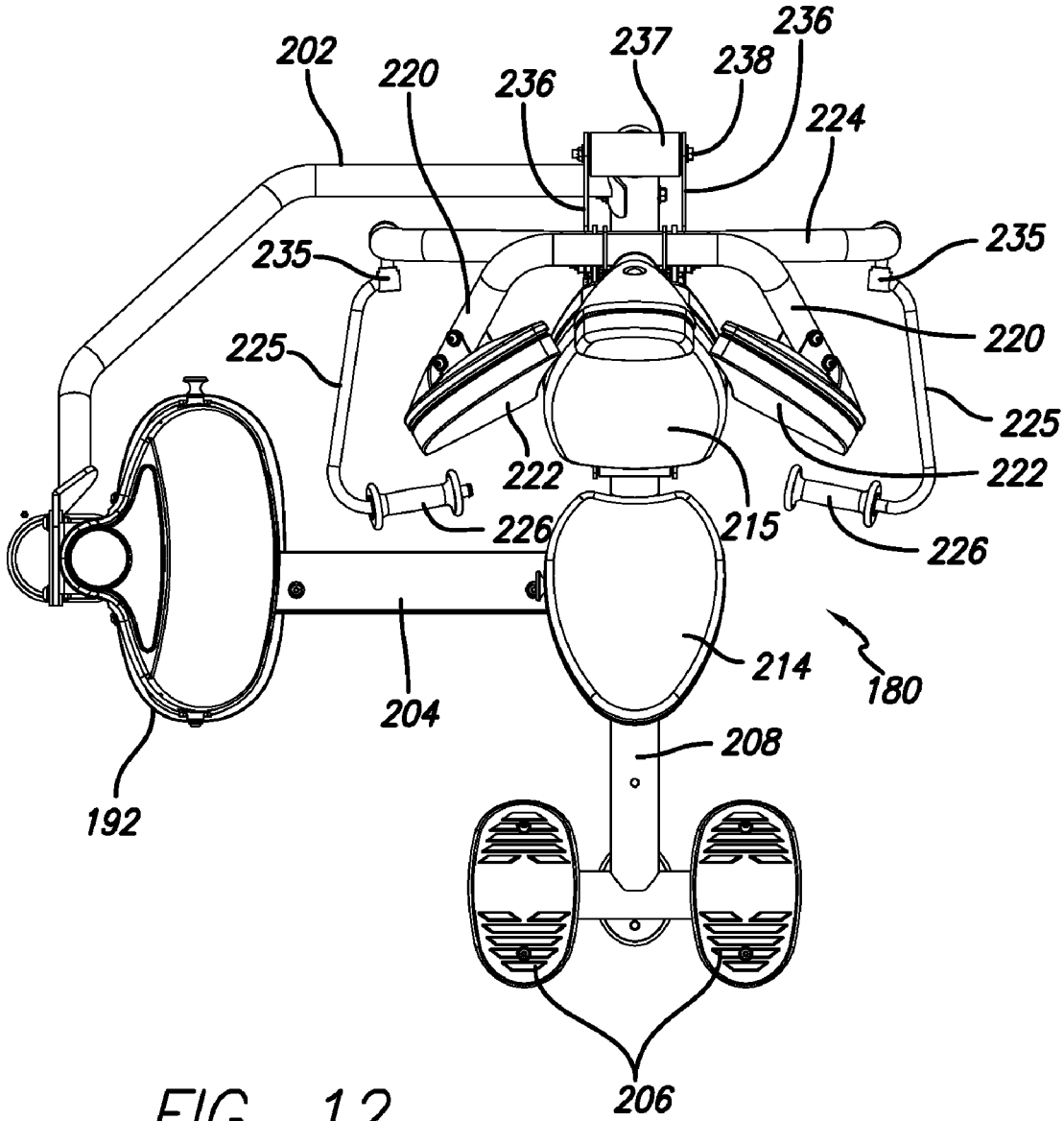
FIG. 12 is a top plan view of the machine of FIGS. 9 to 11.

A back pad 215 is mounted on the upright leg 216 of the L-shaped user support tube. The L-shaped tube is pivotally attached to user support pivot mount or bracket 185 at a location just above the bend in the tube via pivot sleeve 207 for rotation about user support pivot axis 218. A pair of downwardly angled arm supports 220 with arm support pads 222 mounted at their respective first ends are fixedly mounted to the upper portion of the upright leg 216 of the seat support tube at their respective second ends, as best illustrated in FIG. 10. Arm support pads 222 extend on opposite sides of the back pad in a generally vertical orientation and at an angle to the back pad, as best seen in FIG. 12.

The exercise arm 186 has a generally "U" shaped main tube or arm 224 and a pair of user engaging handle arms 225 pivotally attached at each end of the main tube, with a hand grip 226 at the end of each handle arm. The main arm 224 has a pair of connecting brackets 228 located at the central web of the U-shape, as best illustrated in FIG. 10. Each bracket is pivotally attached to a stand-off post or tube 230 located on the upright leg 216 of the seat support tube for rotation about a first pivot axis 232. Stand-off tube 230 is located between the user support pivot axis 218 and the attachment point for the arm supports 220. Each bracket 228 is also pivotally attached to the connecting link assembly 188 for rotation about a second pivot axis 234 spaced from pivot axis 232, as explained in more detail below. Arm 224 has opposite side portions which extend generally downward from the pivot attachment to the user support in the start or rest position of FIG. 13A.

The two user engaging handle arms 225 are generally L-shaped and are each connected to respective pivot mounts 223 at each end of the main tube 224 at the end of the longer leg of the L-shape via a universal pivot joint 235. Hand grips 226 are each rotatably and telescopically mounted over the shorter leg of the L-shape to provide rotational movement for the hand grip on the handle arm. The universal pivot joints 235 are designed to enables the user engaging handles to self-align to the user during the exercise and automatically adjust to the user's hand position by providing minor adjustments in width positioning and wrist pronation/supination.

The connecting link 188 comprises a pair of generally L-shaped connecting plates 236 which are pivotally attached at one end to the handle arm connecting brackets 228 for rotation about pivot axis 234, as best illustrated in FIG. 10. Each connecting plate 236 is pivotally attached at the other end to pivot mount 237 at the upper end of main frame upright 195 for rotation about pivot axis 238. It can be seen in FIGS. 10, 13A and 13B that the user support pivot point or axis 218 is positioned lower than and forward of the connecting link pivot axis 238.

Figure 13A:
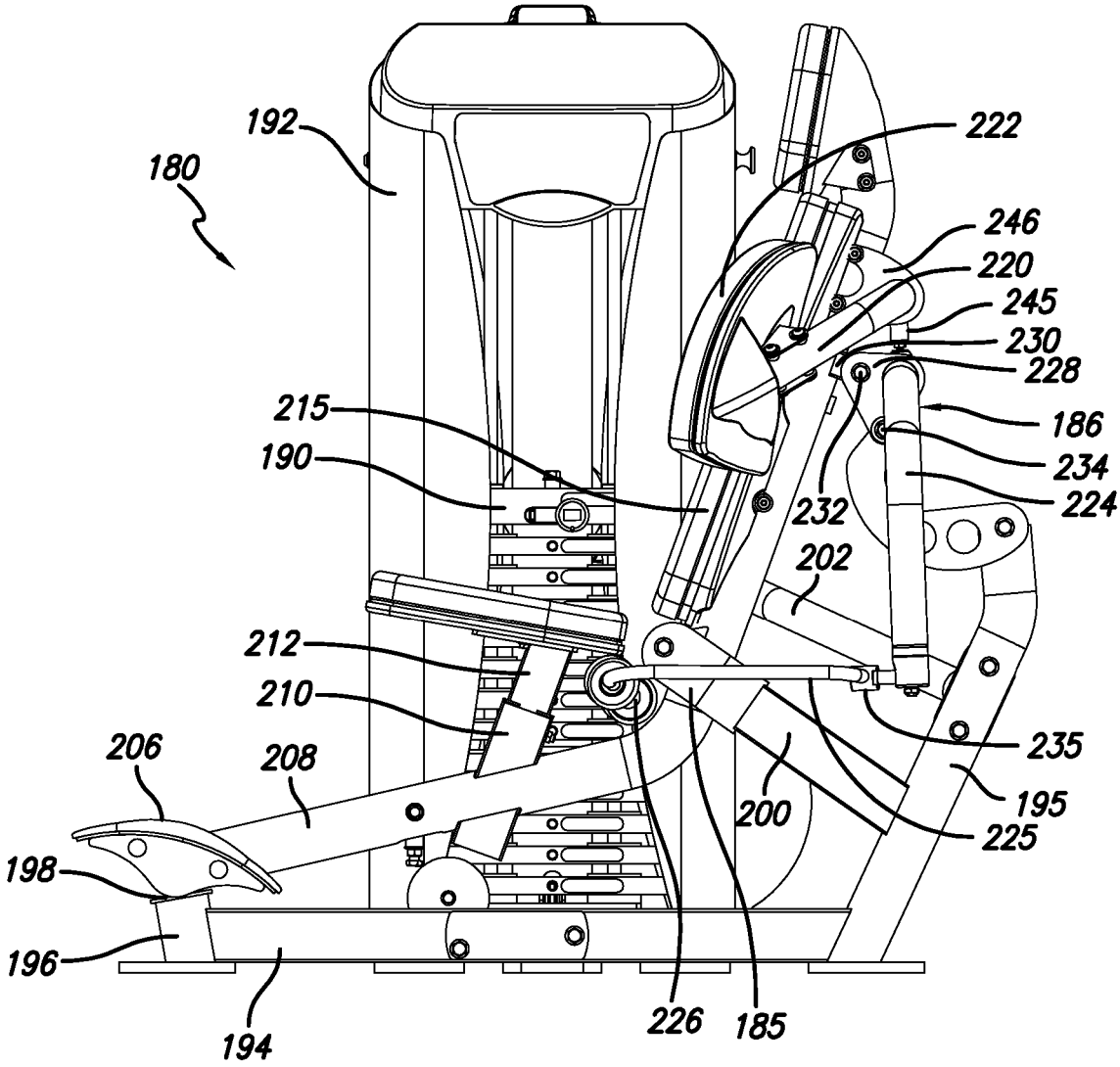
FIG. 13A is a side elevation view of the machine of FIGS. 9 to 12 in a start position for a biceps curl exercise.
Figure 13B:
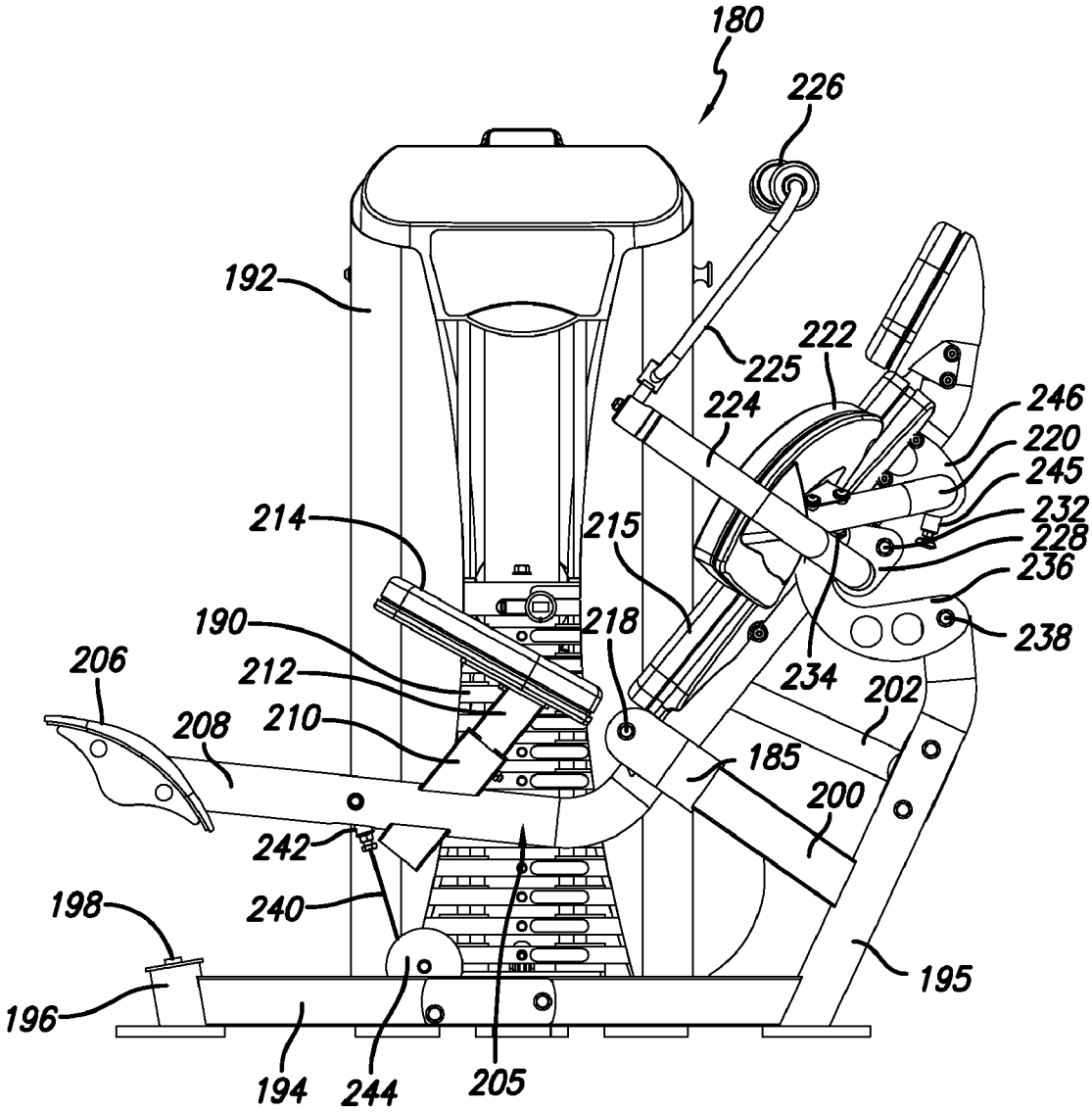
FIG. 13B is a side elevation view of the machine of FIGS. 9 to 12 in a finish position for a biceps curl exercise.

In this embodiment, the user support is linked to the weight stack via a pulley and cable linkage which includes a cable 240 extending from an anchor 242 on the underside of the forwardly extending leg 208 of the seat support frame and around a pulley 244 on the base section 194 of the main frame (see FIG. 13B). Cable 240 is linked in any suitable manner to the weight stack through guide tube 204.

User support 184 in this embodiment is pivotally mounted to the main frame via the user support pivot system. The exercise arm is pivotally mounted on the user support by pivotally attaching the exercise arm connecting brackets 228 to the pivot connection on stand-off 230 on the rear of the upright leg 216 of the seat support frame. The connecting link pivotally joins a pivot mount on the main frame with a second pivot connection on the exercise arm connecting brackets 228.

Figure 9:
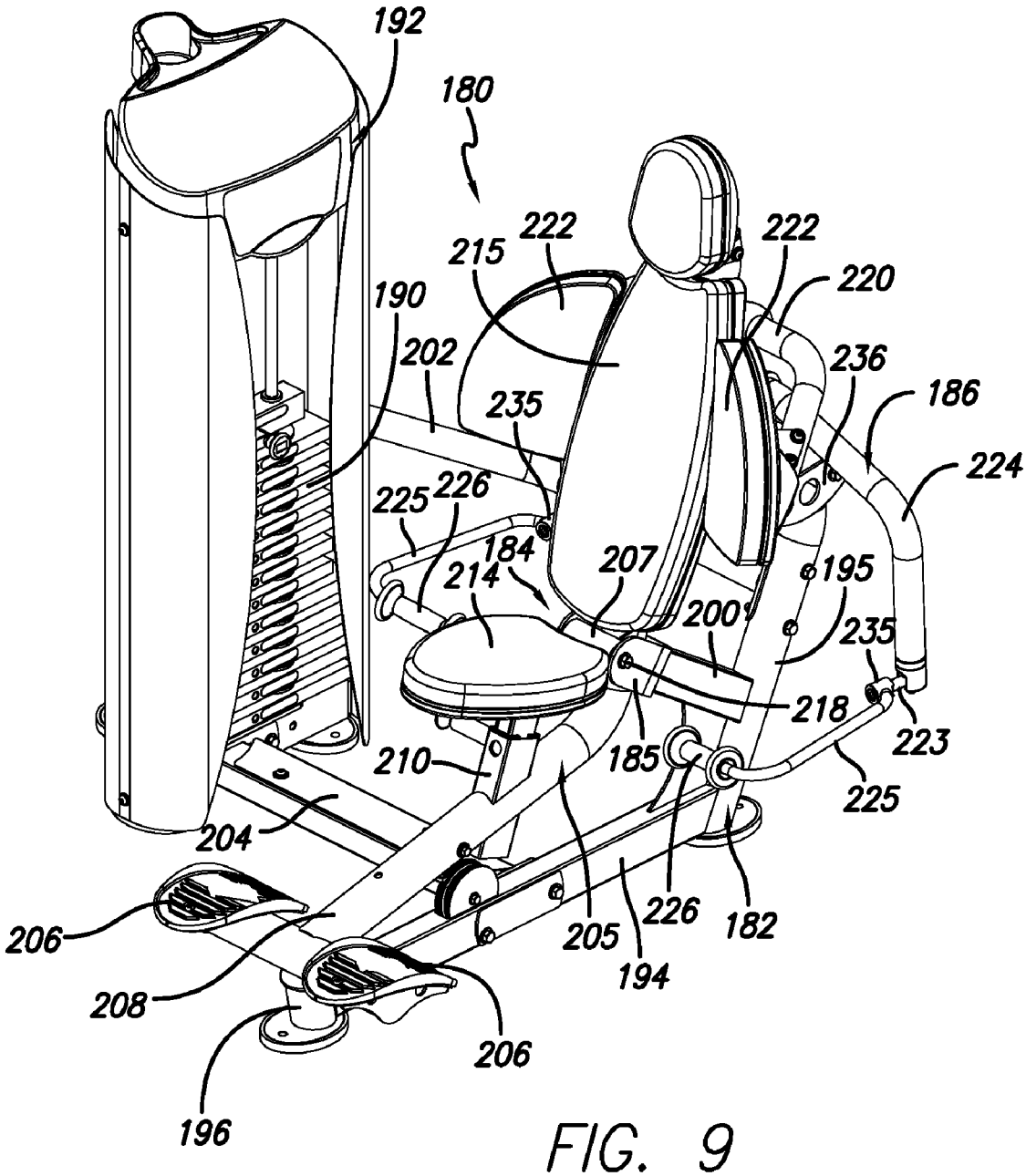
FIG. 9 is a front perspective view of a third embodiment of a biceps curl exercise machine.
Figure 14A:
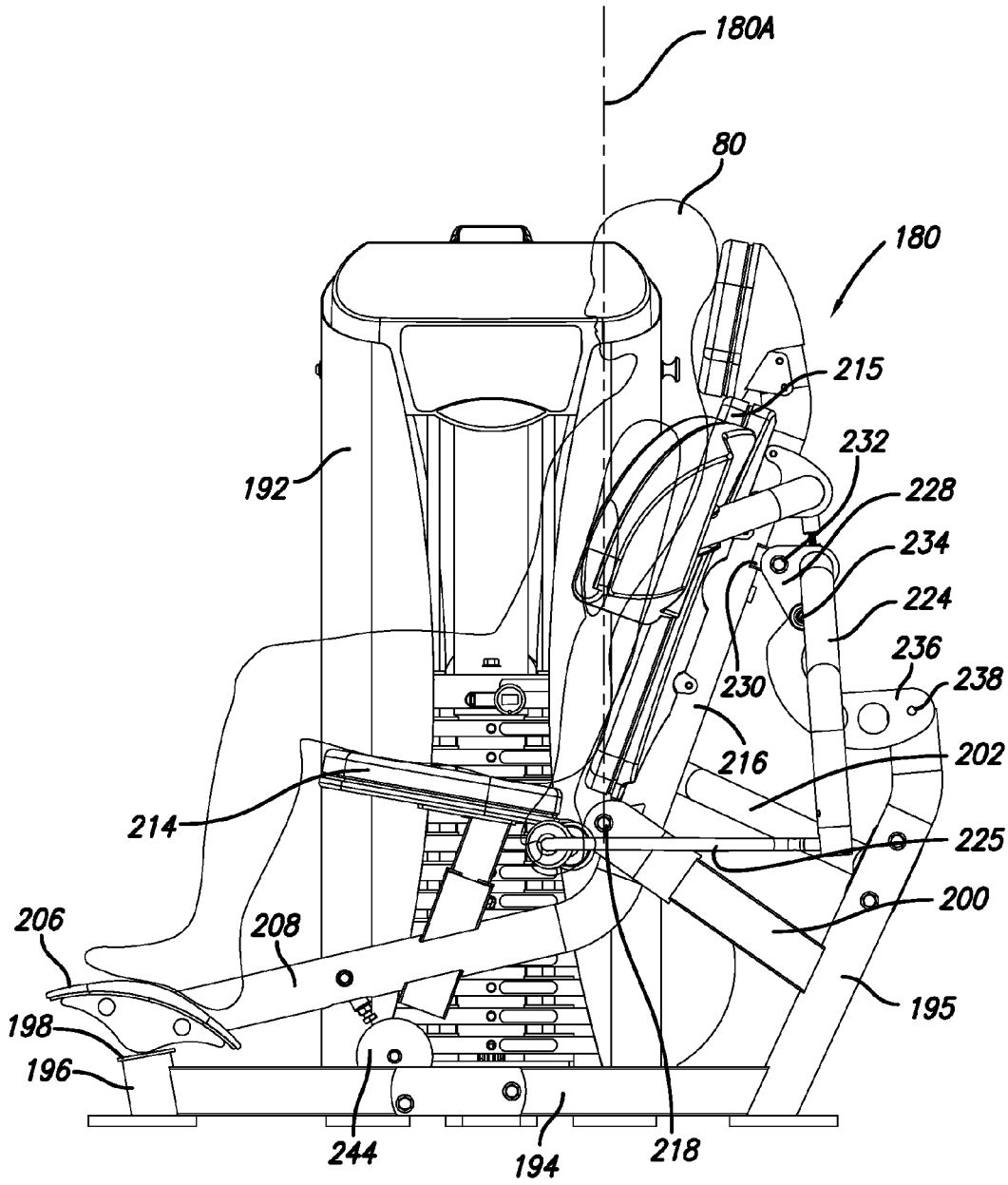
FIGS. 14A and 14B are side elevation views similar to FIGS. 13A and 13B but illustrating a user in position on the machine and performing a biceps curl exercise.

FIGS. 13A and 14A illustrate the start position for a biceps curl on the machine 180, with a user 80 seated on the machine in FIG. 14A. A stand-off 245 on connecting brackets 246 which rigidly connect the arm supports 220 to the rear or upright back pad support leg 216 restricts rearward movement of the exercise arm beyond the start position of FIG. 13A, to place the exercise arm in a convenient position at the start of an exercise. The handle arms 225 extend forward in a generally horizontal orientation on opposite sides of the seat in the start position of FIG. 13A. The forwardly extending leg 208 of the seat support frame rests on the bumper pad 198 in the exercise start position, as illustrated in FIGS. 9 and 13A.

To perform a biceps curl exercise, the user 80 sits on the seat 214 with their back against the back pad 215, upper arms against the arm support pads 222, and feet on the foot rests 206. This places the user in a slightly reclined starting position, as illustrated in FIG. 14A. They then grab the user engaging hand grips 226 and start the exercise movement by pulling the handles upward. In this machine, there is no pivot point for alignment with the user's elbows. The universal connections or joints 235 on the user engaging handle arms 225 compensate for this and automatically adjust to the user arm length and hand position.

Pulling the handle arms 225 upward causes the exercise arm 224 to pivot about its connection to the user support at pivot point or axis 232, as well as at its pivotal connection to the connecting link 236 at pivot point or axis 234, and causes the user support to be pulled rearward, rotating about pivot axis 218 at its pivotal connection to the main frame. This pivotal action is designed to reorient the user's position from a slight recline to a substantial recline and duplicate the rearward arching motion of the "cheat" curl. This movement is done without changing the position of the user on the user support. Throughout the entire movement, the user is in a safe stabilized position with their feet and upper torso supported. This stabilized position provides a strict exercise movement by preventing the involvement of other muscle groups and focusing effort just on the biceps.

Figure 14B:
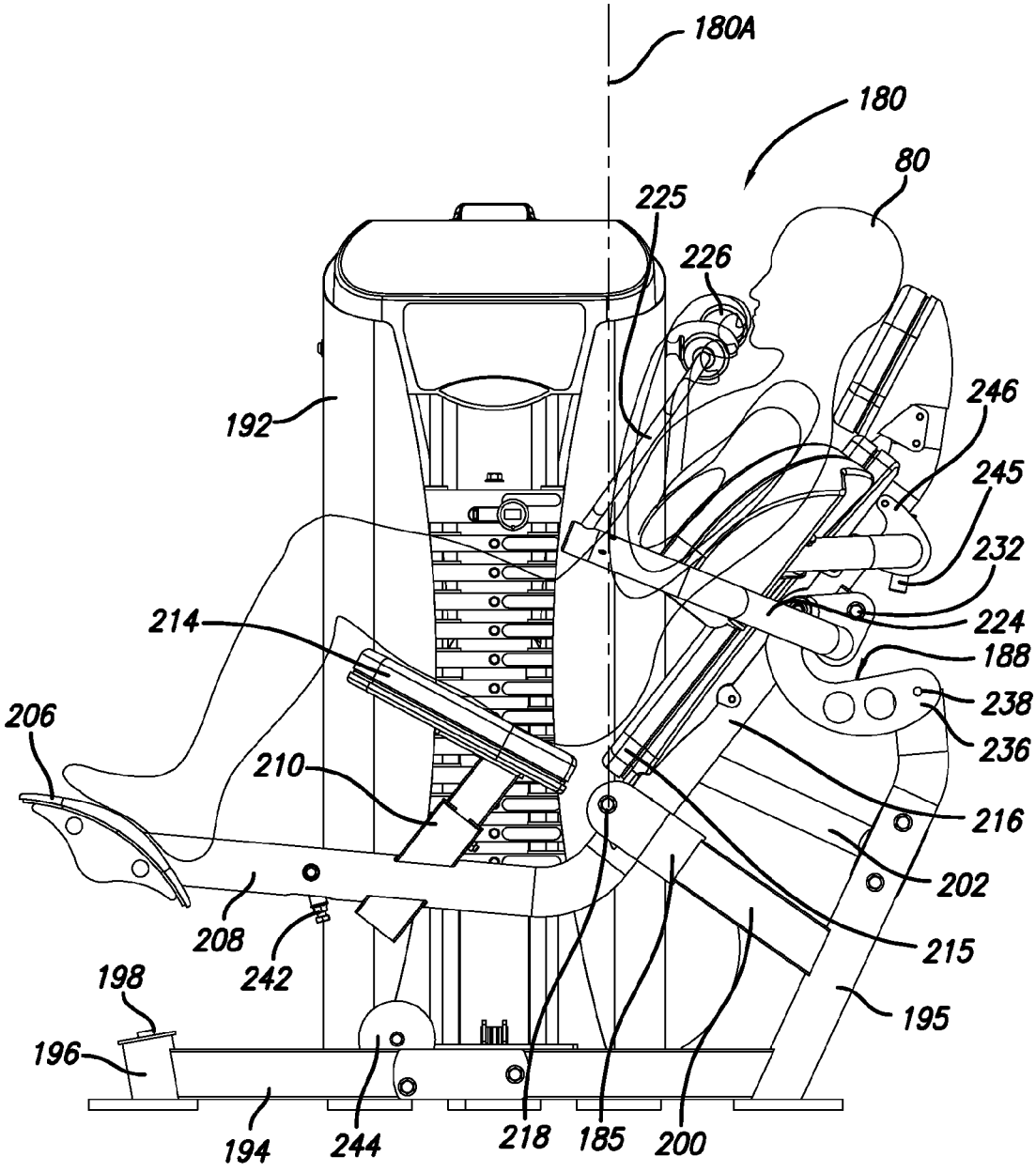
Figure 15:
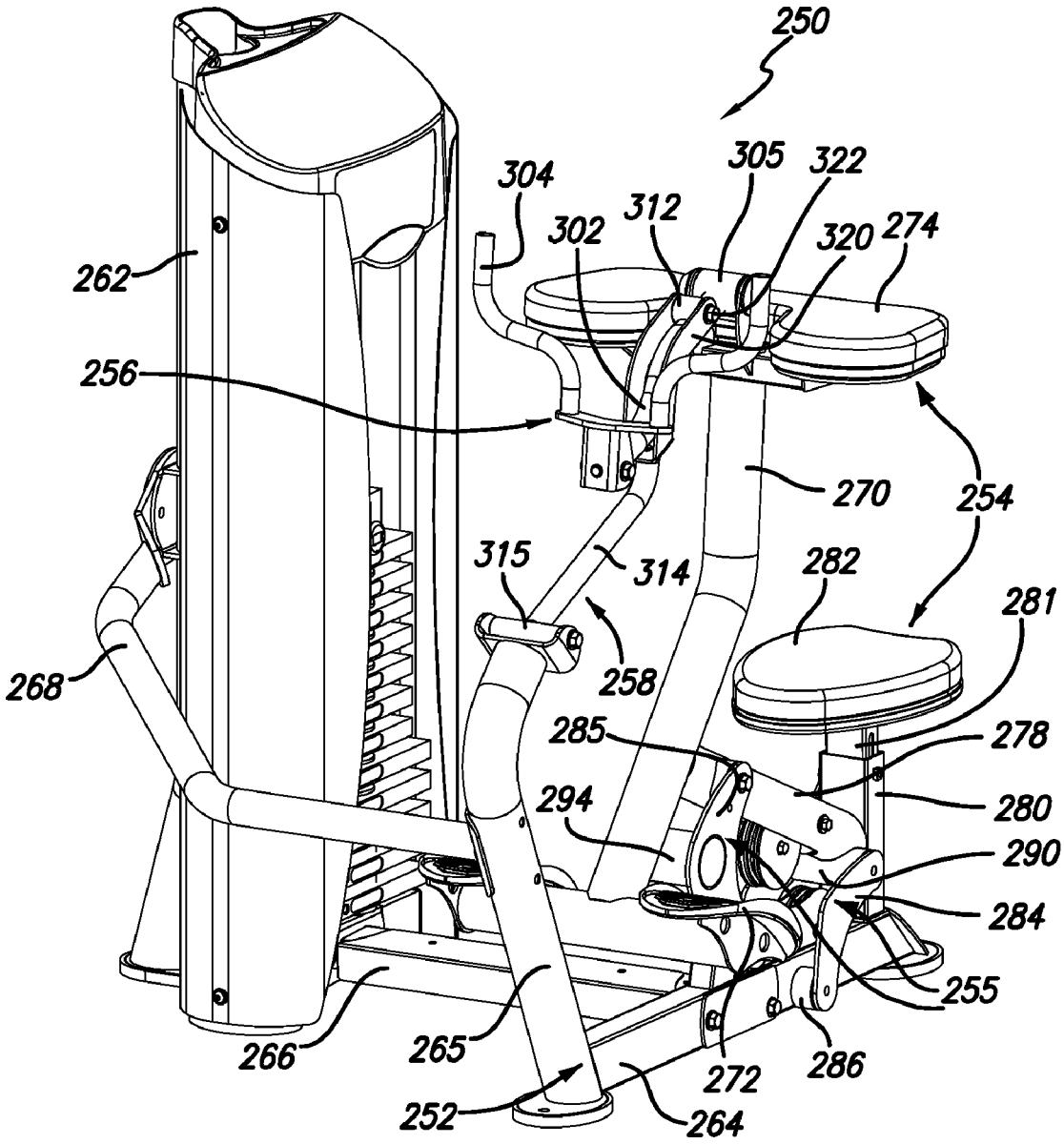
FIG. 15 is a front perspective view of a biceps curl exercise machine according to a fourth embodiment.

As in the previous embodiments, the user support pivot mount in this embodiment is arranged so that part of the combined weight of the user support and user is positioned on both sides of the gravitational center line 180A of the pivotal movement in both the start position and end position (see FIGS. 14A and 14B). As in the first embodiment, more weight is positioned forward of the gravitational center line 180A in the start position of FIG. 14A than in the end position of FIG. 14B.

A fourth embodiment of a biceps curl machine 250 is illustrated in FIGS. 15 to 18. This embodiment has some similar features to the embodiment of FIGS. 6 to 8, but the single pivot mount of that embodiment is replaced in this embodiment with a four-bar pivot linkage 255, and the exercise arm design is somewhat different. The machine 250 has a main frame 252, a user support 254 pivotally mounted on the main frame by a four-bar pivot linkage 255, an exercise arm assembly 256 pivotally mounted on the user support, and a pivoting connecting link 258 joins the exercise arm assembly to the main frame. A weight stack 260 mounted in weight stack frame or housing 262 is linked to the user support by a cable and pulley linkage to provide exercise resistance, in a similar manner to the previous embodiments.

The main frame 252 has a base section 264 for engaging the floor and an inclined upright tube 265 located at the forward end on the base section. The base section 264 is connected to the weight stack support frame 262 by a guide tube 266 for the cable and pulley linkage. A connecting rod 268 is connected at one end to the upright tube 265 and at the other end to the outer face of the weight stack support frame 262.

Figure 16:
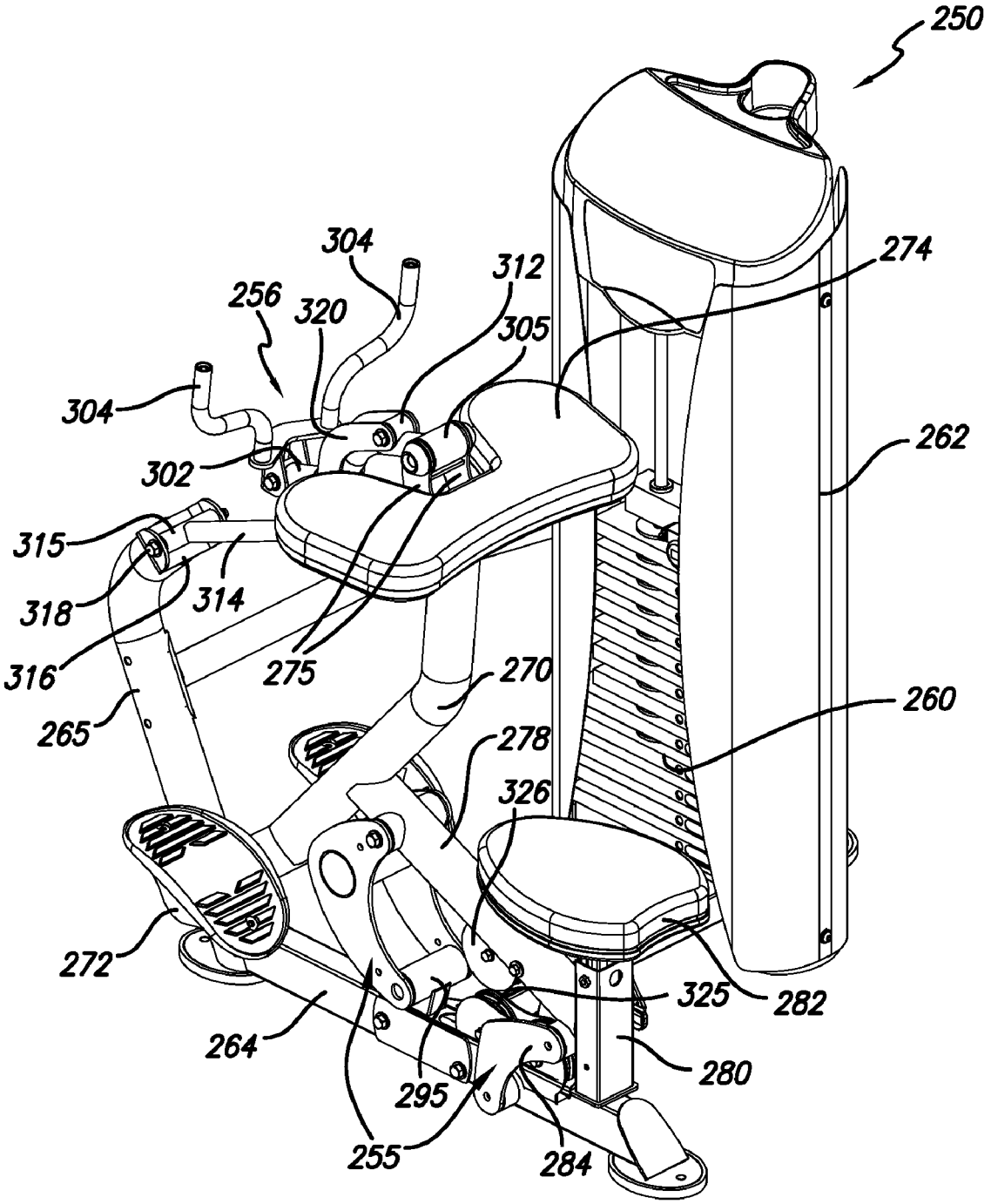
FIG. 16 is a rear perspective view of the machine of FIG. 15.

The user support 254 has an angled upright tube 270 at its forward end with user supporting foot rests 272 mounted on its lower end and a user supporting arm pad 274 mounted at its upper end. A pair of pivot brackets 275 protrude upward from the user support 254 through a recess at the center of the arm support pad 274, as best illustrated in FIG. 16. A downwardly angled seat support tube 278 is attached by welding or other fastening means at an intermediate position along upright tube 270 and projects rearward from the tube 270. A seat pad support tube 280 is attached transversely to the rear end of seat support tube 278 and has an open end in which a seat post 281 is telescopically engaged. Seat post 281 has a mounting plate at one end for attaching seat pad 282 for supporting a user. This arrangement is designed to accommodate users of different heights by varying the distance between the seat and the arm support pads.

The user support four-bar pivot linkage system 255 comprises two spaced, parallel rearward links 284 and a single forward link 285. The rearward links are pivotally connected at one end to a pivot housing 286 on main frame base section 264 for rotation about first pivot axis 288, and are pivotally connected at the other end to a pivot housing 290 on the underside of seat support tube 278 for rotation about second pivot axis 292. The forward link 285 comprises two spaced plates connected by a central connecting tube 294. Link 285 is pivotally connected at one end to a pivot housing 295 at the upper end of a stand-off 296 on the base section 264 of the main frame, for rotation about third pivot axis 298 spaced forward and upward from first pivot axis 288. The opposite end of link 285 is pivotally connected to the seat support tube 278 for rotation about a fourth pivot axis 300 spaced forward from second pivot axis 292. By using the four-bar linkage as the user support pivot system, all the pivoting action can take place under the user with the pivot mounts conveniently located on the main frame and user support. However, the theoretical pivot for the user support is actually located elsewhere. The theoretical pivot is the point where a single pivot would have to be located in order to mimic the same user support movement and gravitational centerline of the user support movement, as described in more detail below in connection with FIG. 19.

The advantage of the four-bar pivot system with the theoretical pivot is that it takes the movement pattern of a single point pivot that might normally be located in an area impossible to access due to either structural or user interference and provides pivot mounts in accessible locations which together provide for rotation of the user support about the otherwise inaccessible location.

The exercise arm assembly 256 comprises a main arm 302 and user engaging handles 304. The main arm 302 has a first pivot mount 305 at a first end pivotally attached to the pivot brackets 275 at the upper end of the forward upright tube 270 of the user support for rotation about pivot axis 306.

The user engaging handles 304 each have an angled step that places the outer ends wider than their lower, inner ends. This design allows multiple gripping positions for the user's hands. A connecting bracket 308 located at the lower ends of the handles is connected to the second end of the main arm 302 at a second pivot mount for rotation about pivot axis 310. This connection enables the user engaging handles to self-align to the user during the exercise and automatically adjust to the user's arm length. A link connecting third pivot mount 312 is mounted on the main arm at a location intermediate its ends (see FIG. 16).

The connecting link 258 comprises an elongate main tube 314 having a pivot mount 315 at its first end which is pivotally attached to a pivot bracket 316 at the end of main frame upright 265 for rotation about a first link pivot axis 318, and a U-shaped bracket 320 attached to the second end of the main tube 314 at the center web of the U-shape. The ends of the U-shaped bracket 320 are pivotally connected to the pivot mount 312 on exercise arm 302 for rotation about a second link pivot axis 322.

In this embodiment, the user support 254 is pivotally mounted to the main frame via the user support pivot system 255. The exercise arm is pivotally connected by its first pivot mount 305 to the pair of pivot brackets 275 at the center of the user support arm pad 274. The connecting link 258 joins the exercise arm 256 with the main frame 252. The user support 254 is linked to the weight stack via the cable and pulley linkage which includes a double pulley 325 on the base section 264 of the main frame and a pulley 326 on the underside of the seat support tube 278. A cable (not illustrated) extends from an anchor on seat support tube 278, around a first pulley of the double pulley 325, around pulley 326 on the seat support tube 278, and then around the second pulley of double pulley 325 in a similar manner to some of the previous embodiments, and is linked through the guide tube to the weight stack in any suitable manner.

Figure 17A:
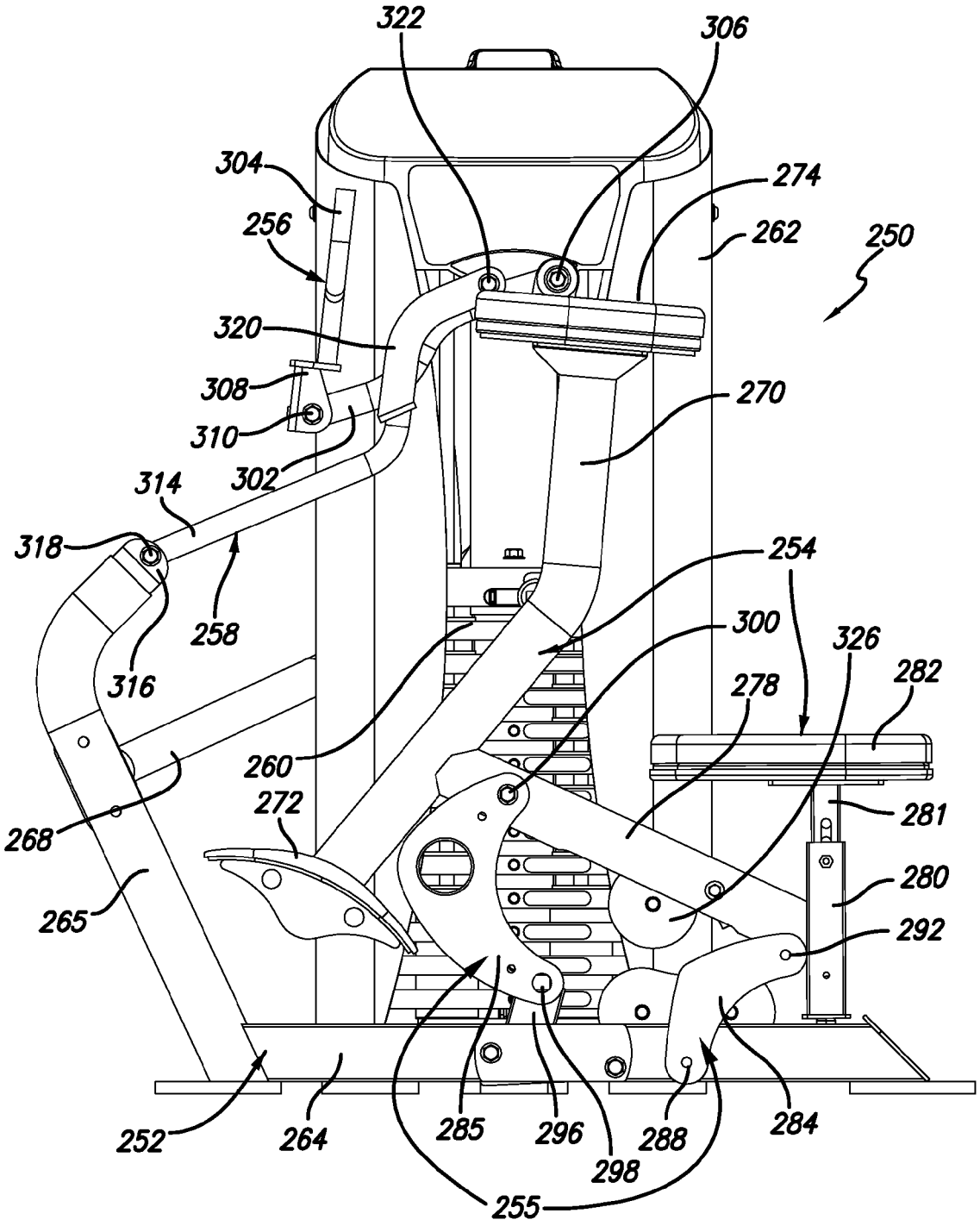
FIG. 17A is a side elevation view of the machine of FIGS. 15 and 16 in a start position for a biceps curl exercise.
Figure 17B:
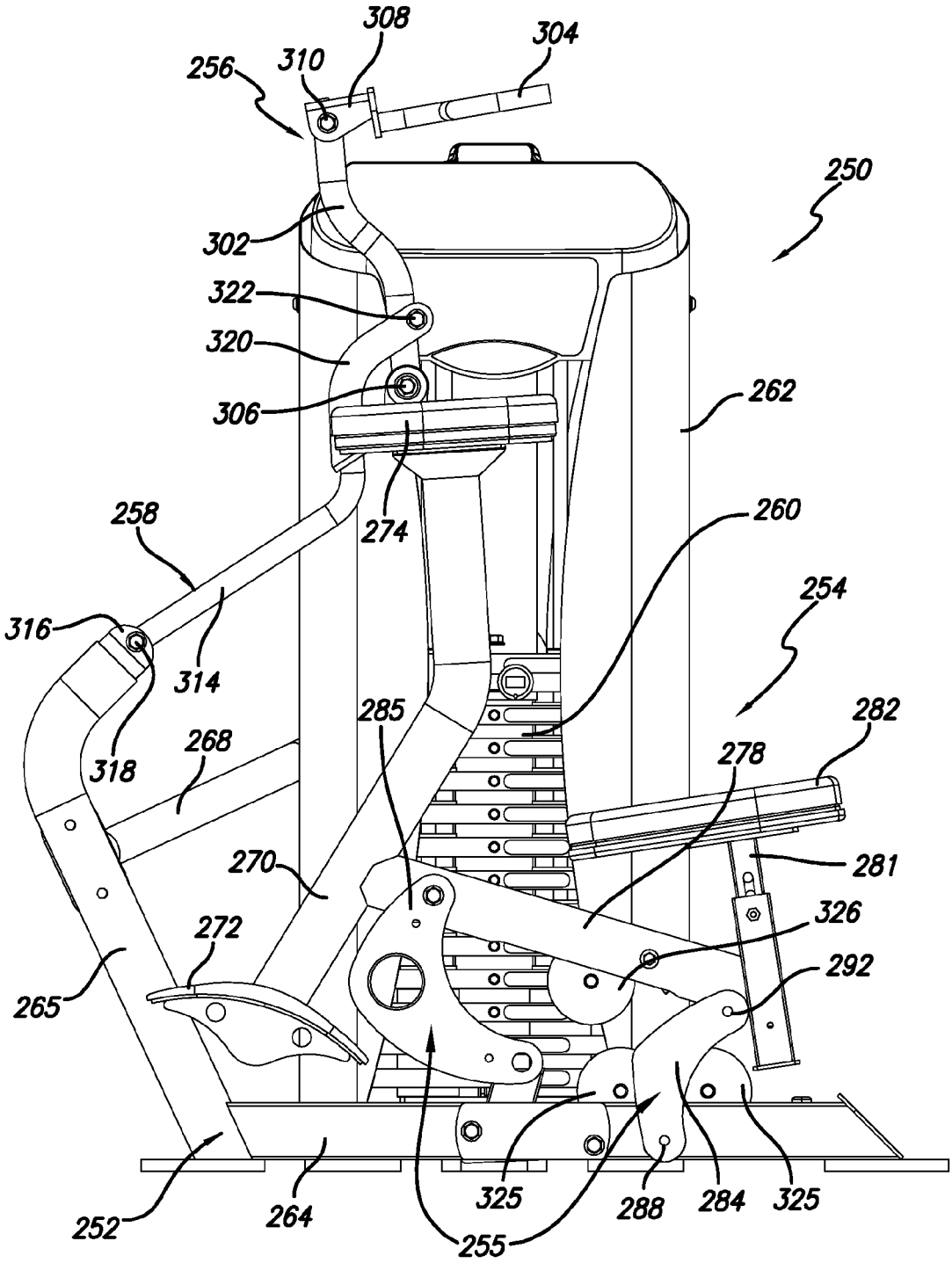
FIG. 17B is a side elevation view similar to FIG. 17A illustrating a finish position for a biceps curl exercise.
Figure 18A:
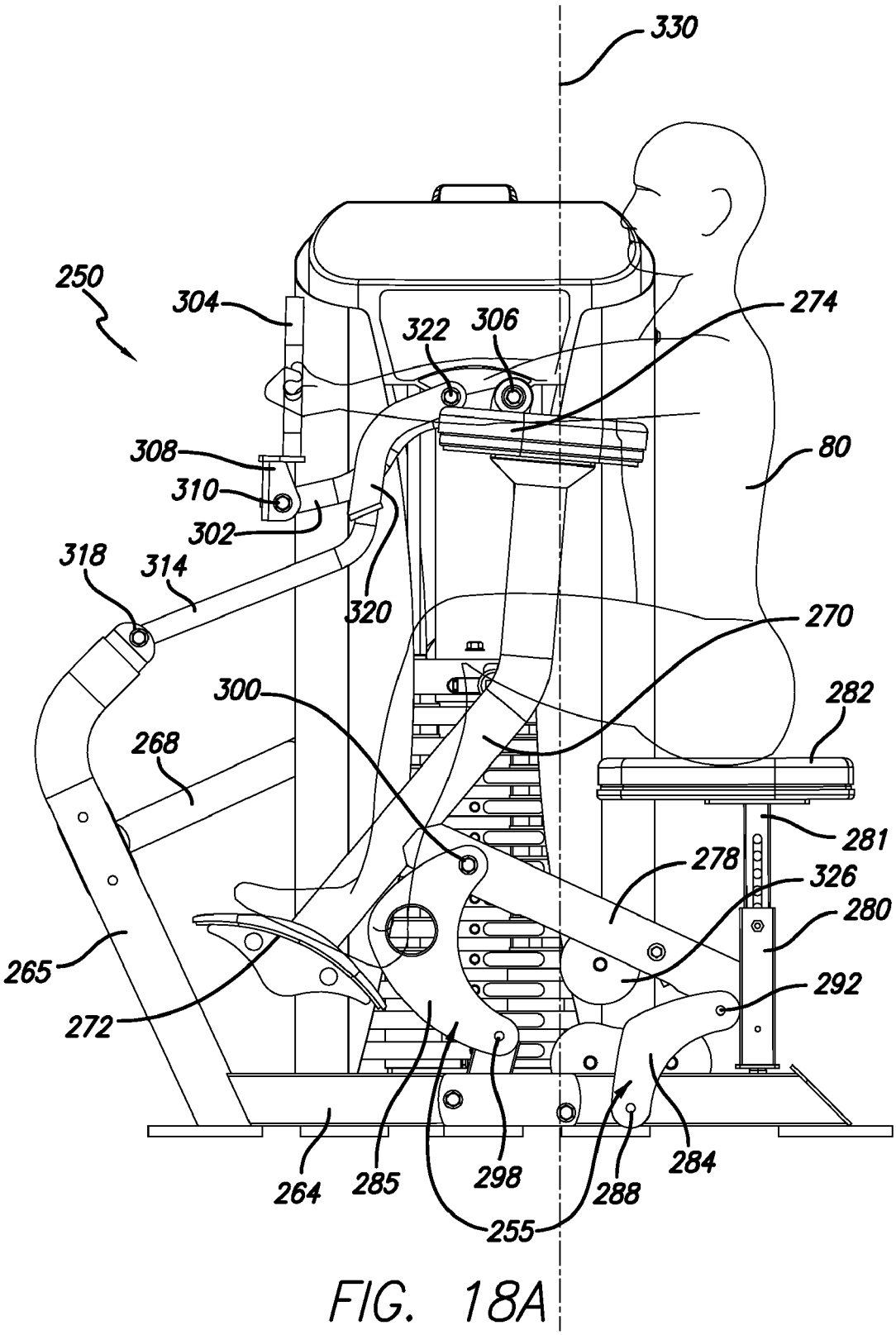
FIGS. 18A and 18B are side elevation views similar to FIGS. 17A and 17B but illustrating a user in position on the machine and performing a biceps curl exercise.
Figure 18B:
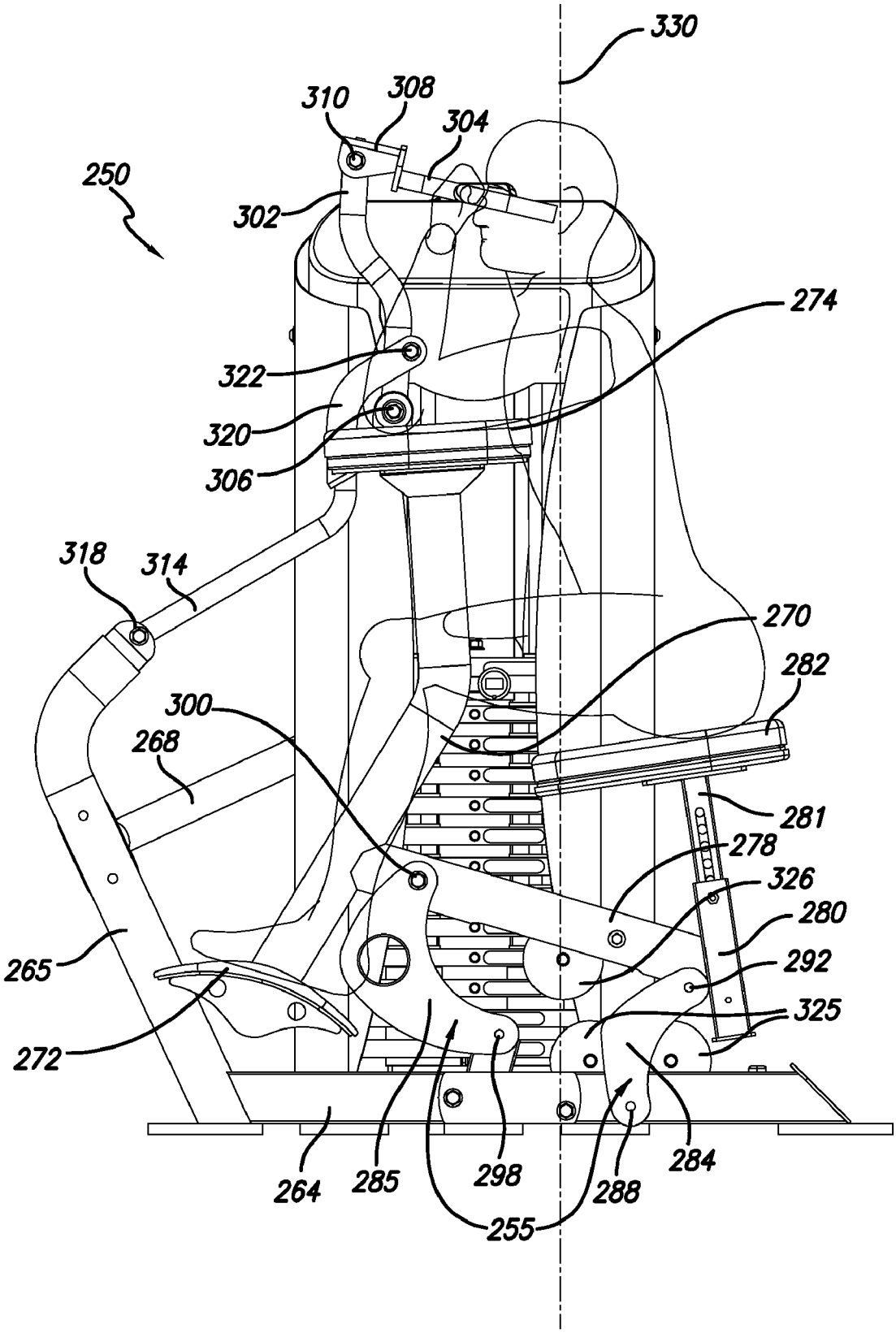

FIGS. 17A and 18A illustrate the biceps curl machine 250 in a start position for a biceps curl exercise, with a user 80 shown seated on the machine in FIG. 18A. To perform the exercise, the user sits on the seat 282, which rest in a horizontal position, place their feet on the foot rests 272, and rests their upper arms on the horizontal arm support pad 274. This places the user in a generally upright orientation, as illustrated in FIG. 18A. They then grab the user engaging handles 304 and start the exercise movement by pulling the handles upward, towards their head, until they reach a finish position for the exercise as illustrated in FIGS. 17B and 18B. It is desirable for the user to align the pivot of their elbows with the exercise arm's pivotal connection to the user support at axis or pivot point 306 (FIG. 17A). A position indicating decal may be placed on the arm support pad to help a user to identify the pivot point 306 of the exercise arm for alignment purposes.

The exercise movement causes the exercise arm to pivot about pivot axis 306 at its connection to the user support. This in turn pulls the connecting link at its connection to the exercise arm, causing the link to rotate about pivot axis 318 at its connection to the upright tube 265 of the main frame. This action pulls the user support forward and downward, causing it to rotate forward about its four-bar pivot connection to the main frame.

This pivotal action of the user support is designed to reorient the user's position from a generally upright position to a forward lean. This movement feels like it is bringing the user and the exercise arm handles together at a quicker pace, simulating the speed found in the explosive inertia or momentum of the free weight "cheat" curl. However, because the exercise arm is mounted to, and travels with, the user support, it is only the sensation of leaning forward as the handles approach that creates the feeling of momentum. Because the load is connected to the user support, the resistance remains constant during the exercise, with the only variation being the small amount of combined weight (user and user support) that pass through the gravitational centerline.

This rocking movement is done without changing the position of the user on the user support. Through out the entire "explosive" movement, the user is in a stabilized position with their feet and upper torso supported. This stabilized position provides a strict exercise movement by avoiding or substantially avoiding the involvement of other muscle groups and focusing effort just on the biceps.

As mentioned above, FIGS. 18A and 18B illustrate a user 80 on the machine in the start and finish positions respectively. The dotted line 330 represents the gravitational centerline of the pivotal movement. In performing the exercise, the user goes from an upright orientation to a forwardly inclined orientation as their arms go from an extended to a flexed (bent at the elbow) position. A portion of the user and user support is balanced on each side of the gravitational centerline 330 in both the start and finish positions.

Figure 19:
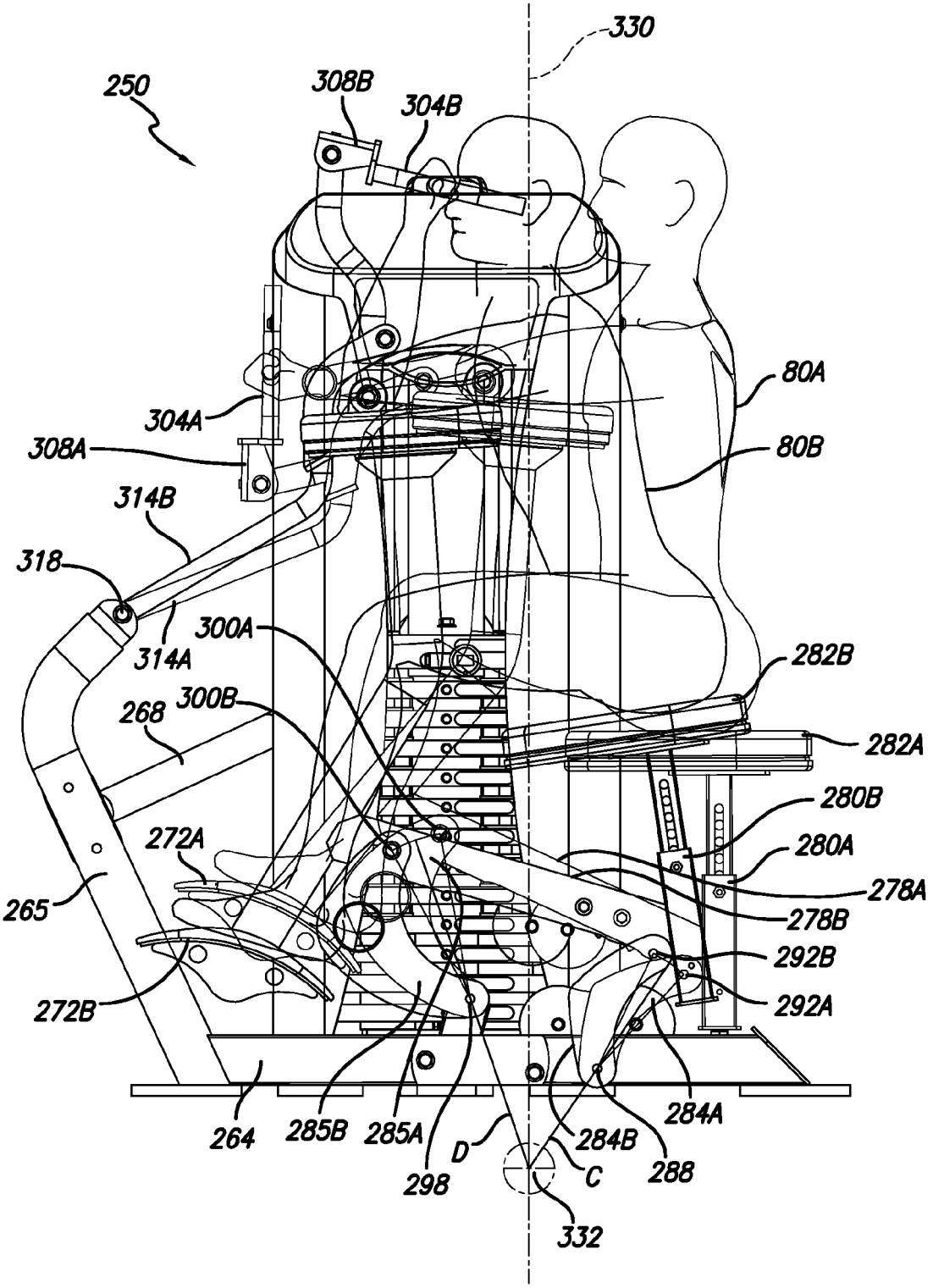
FIG. 19 is a side elevation view similar to FIGS. 18A and 18B but illustrating the start and finish position for a biceps curl superimposed.

FIG. 19 illustrates plotting of the theoretical pivot point 332 for the user support four bar pivot linkage 255. In this drawing, the start and finish positions of the machine and user in FIGS. 18A and 18B are overlapped. Moving parts of the machine are indicated by an A after the reference number for the start position and a B after the reference number for the finish position. In order to plot the theoretical pivot point 332, the centerline of the arcing movement for each link 284, 285 of the user support pivot system is calculated. The centerline C of the movement of link 284 extends from the center of the line joining the start and finish positions of second pivot axis 292A, 292B through the first pivot axis 288, which is fixed. The centerline D of the movement of link 285 extends from the center of the line joining the start and finish positions 300A, 300B of the fourth pivot axis through the fixed third pivot axis 298. The point in space where the two centerlines C and D intersect is the theoretical pivot point 332 of the user support. The gravitational centerline 330 is the vertical line extending through theoretical pivot point 332. A single fixed pivot would not work for machine 250 as it would be located below ground level, as seen in FIG. 19. This would force the machine to be raised approximately eight inches in order to duplicate this pivoting movement using a single fixed pivot and would make entering and exiting the user support more difficult.

FIGS. 20 to 27 illustrate a dual function arm exercise machine 350 according to another embodiment. This machine can perform both biceps curl and triceps extension exercises, with FIGS. 20 to 23 depicting a biceps curl and FIGS. 24 to 27 depicting a triceps extension. The general frame work and movement pattern of this machine is similar to that of the previous embodiment, except that it has a bi-directional exercise arm and a flexible line is used as a connecting link.

In this embodiment, the main frame and user support pivot system, and the weight stack and weight stack frame attachment to the main frame are the same as in the embodiment of FIGS. 15 to 19, and like reference numbers have been used for like part as appropriate. The user support 352 is pivotally mounted on the main frame base section 264 by a four-bar pivotal linkage system, as in the previous embodiment. An exercise arm assembly 354 is pivotally mounted on the user support, and a connecting link comprising a cable and pulley system 355 extends between the main frame, user support, and exercise arm, as explained in more detail below.

As in the previous embodiment, the user support 352 has an angled upright tube 356 at its forward end, with user supporting foot rests 358 mounted on the lower end of tube 356 and a user supporting arm pad 360 mounted at the upper end. The arm pad 360 has an indented region at its center, and a pair of cam mounting pivot brackets 362 protrude upward from tube 356 through the center of the arm support pad 360, replacing the pivot brackets 275 of the previous embodiment. A downwardly angled seat support tube 364 extends rearward from upright tube 356 at a location spaced above foot rests 358, and a seat pad support tube 365 is attached transversely to the rear end of seat support tube 364. Seat pad support tube 365 has an open end in which a seat post 366 is telescopically engaged. Seat post 366 has a mounting plate at one end for attaching seat pad 368 for supporting a user. This arrangement is designed to accommodate users of different heights by varying the distance between the seat and the arm support pads.

The exercise arm assembly 354 has a curved main tube or arm 370, user engaging handles 372, and a range-of-motion (ROM) adjuster 374. The main tube 370 has a first pivot mount 375 attached at a first or outer end. The user engaging handles 372 have an angled step that places the outer ends wider than the lower, inner ends. This design allows multiple gripping positions for the user's hands. A connecting bracket 376 is located at the lower ends of the handles 372 and is pivotally connected to the main arm 370 at first pivot mount 375 for rotation about pivot axis 378. This connection enables the user engaging handles to self-align to the user during the exercise and automatically adjust to the user's arm length. A pair of mounting brackets (not visible in the drawings) project outward from the main tube near the second end of the main tube or arm 370. The ROM adjuster 374 comprises a round cam which is pivotally mounted together with the mounting brackets on the end of main arm 370 to the cam mounting pivot brackets 362 on the user support for rotation about pivot axis 400. The ROM adjuster cam 374 has spaced adjustment holes around its perimeter, and an adjuster pin or pull pin 379 is mounted approximate the second end of exercise arm main tube 370 for selective engagement in the cam adjustment holes to secure the exercise arm at a selected position around cam 374, depending on the exercise to be performed. This arrangement is designed to provide bi-directional exercise movement. A cam lever arm 380 pivotally associated with the cam 374 has a pulley 382 mounted on is outboard edge.

As noted above, the connecting link in this embodiment comprises a pulley and cable system. The connecting link pulley and cable system 355 has a first cable or flexible line 385 attached to the upright tube 356 of the user support at anchor 386 and then reeved around a pulley 388 mounted on a link connecting pivot mount 390 on the main frame upright 265. The cable 385 is then reeved around a pulley 392 mounted on user support upright tube 356 at a location above the cable attachment point or anchor 386. The cable is then reeved around the pulley 382 located on the outer edge of cam lever arm 380 before finally attaching to cam 374.

The user support 352 is linked to the weight stack by a load-bearing cable 394 which extends from an anchor or attachment point 395 on the seat support 364 around a first pulley 396 on main frame base section 264, then around a pulley 398 on the underside of seat support 364 forward of anchor 395, and finally around pulley 399 on base section 264, before linking to the weight stack 260 through guide tube 266 in any suitable manner.

Figure 20:
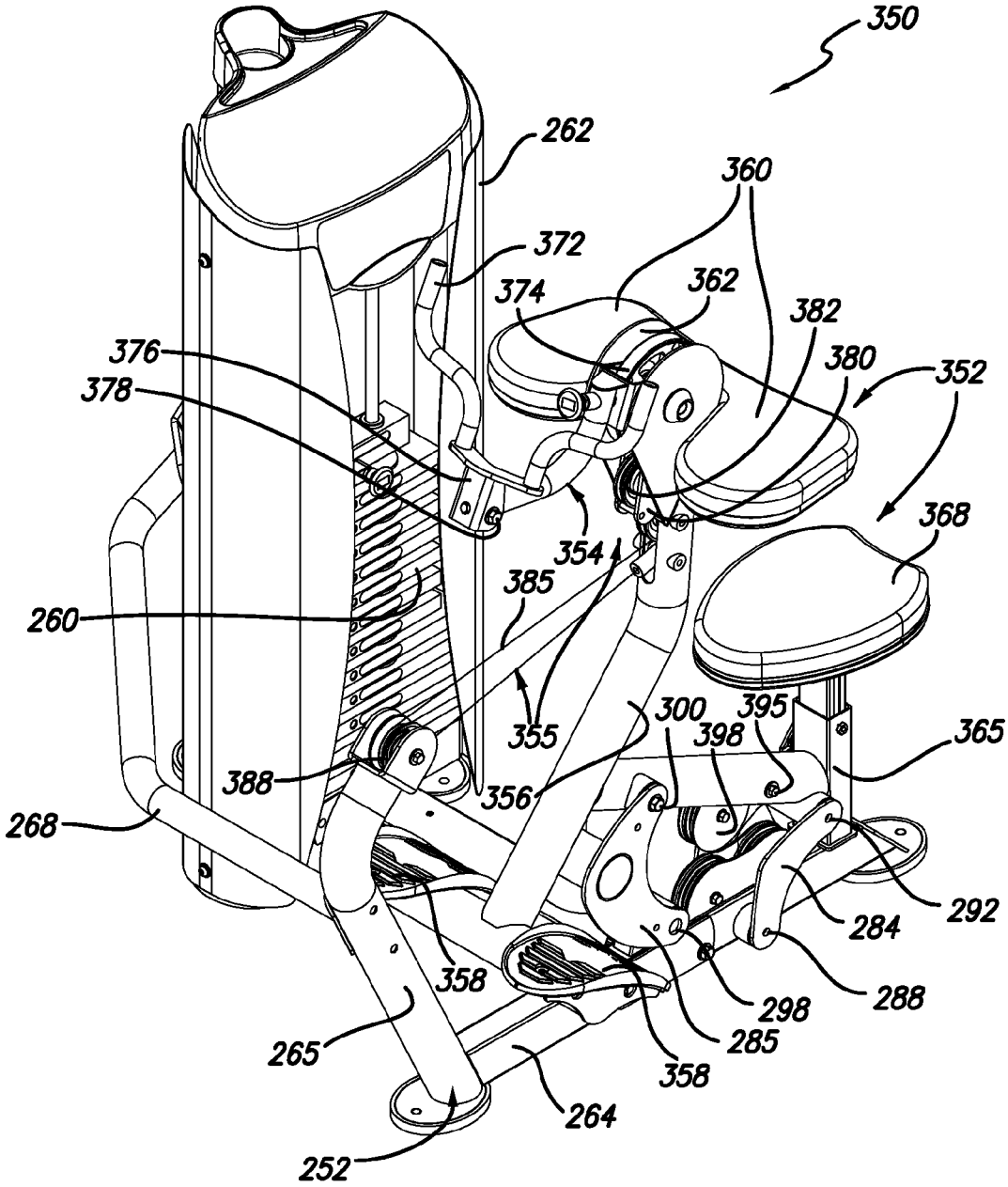
FIG. 20 is a front perspective view of a combination biceps curl/triceps extension exercise machine according to another embodiment, with the machine in a starting position for a biceps curl exercise.
Figure 21:
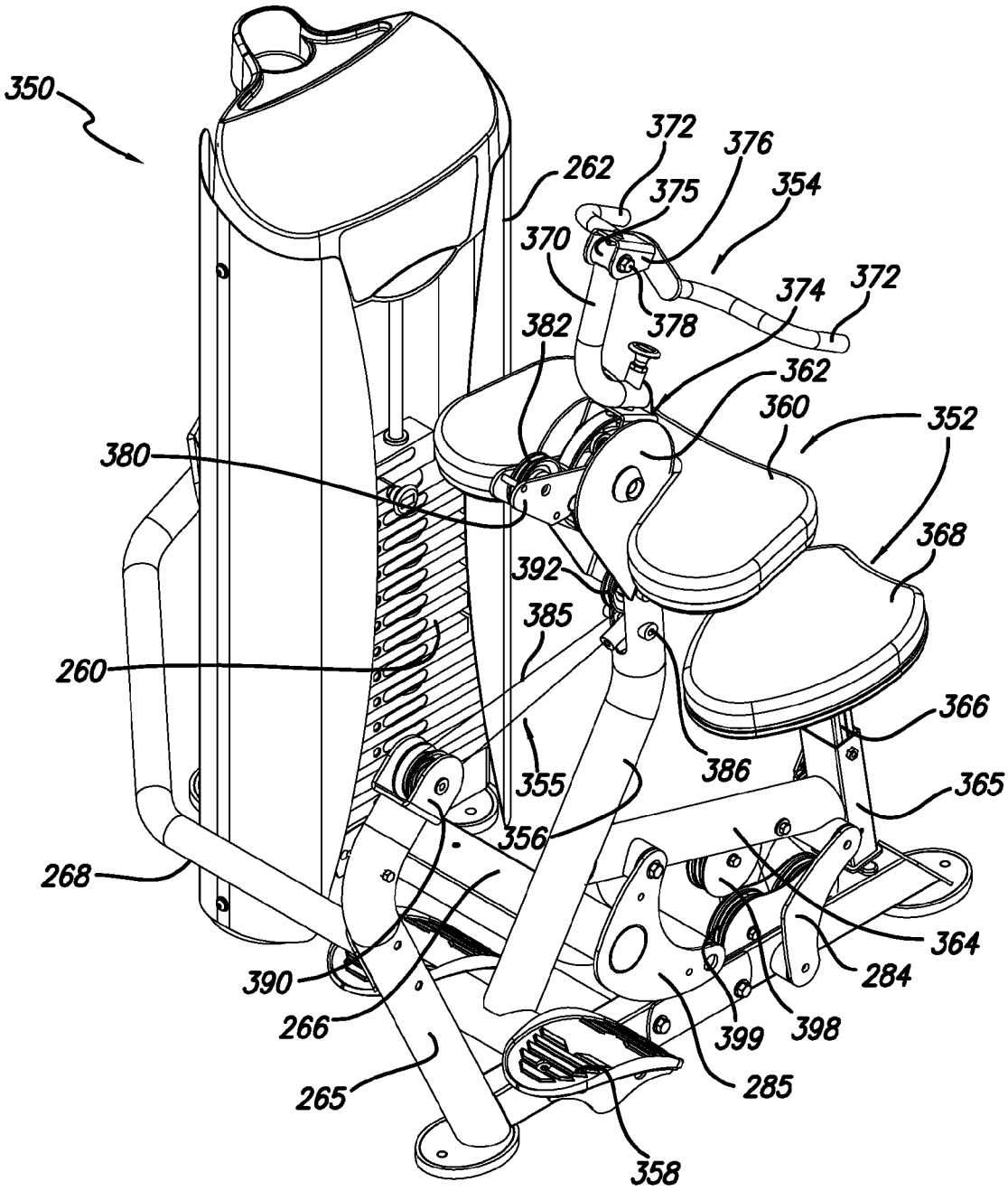
FIG. 21 is a front perspective view of the machine in the finish position for a biceps curl exercise.
Figure 22A:
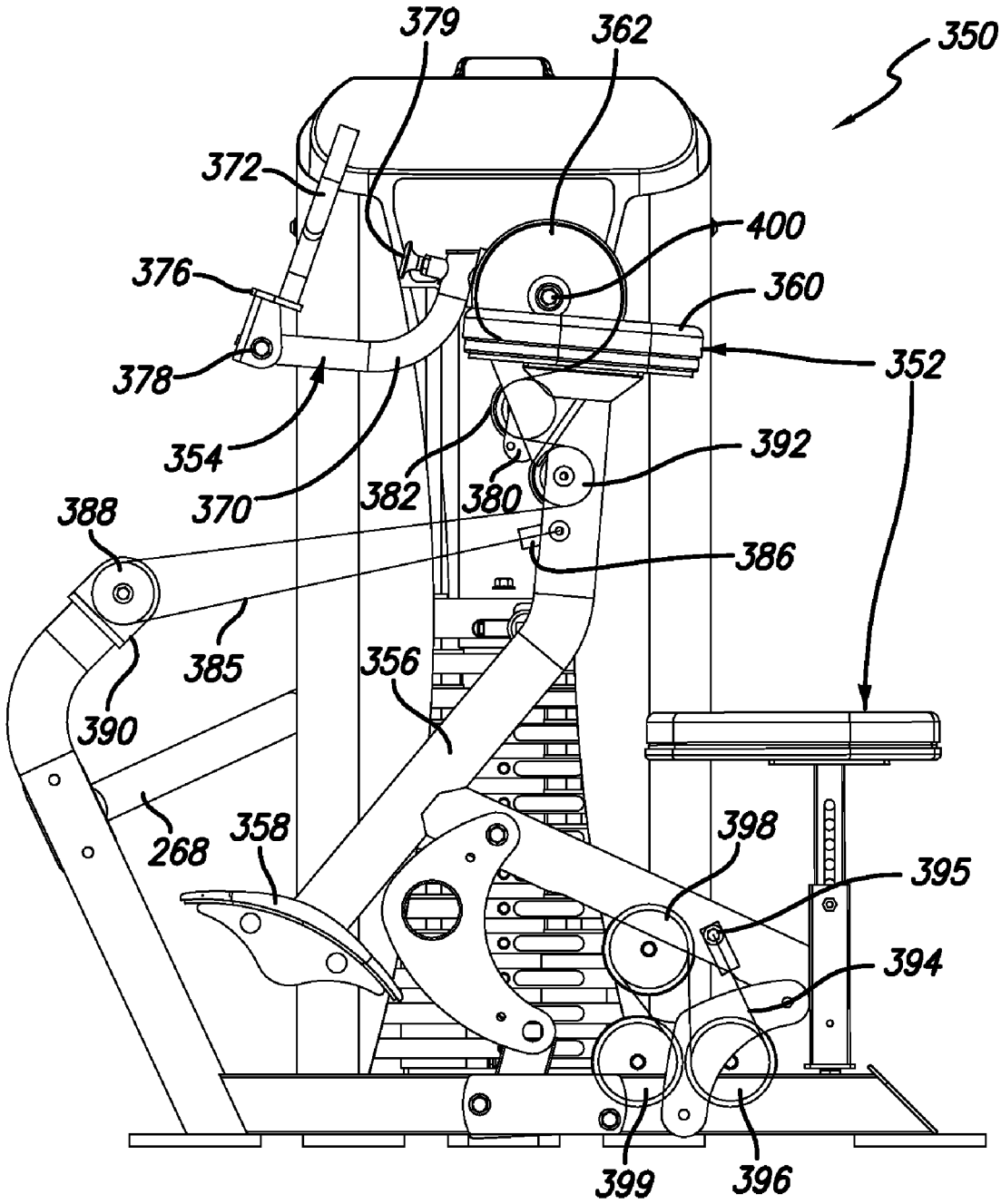
FIG. 22A is a side elevation view illustrating the machine in the start position of FIG. 20.
Figure 22B:
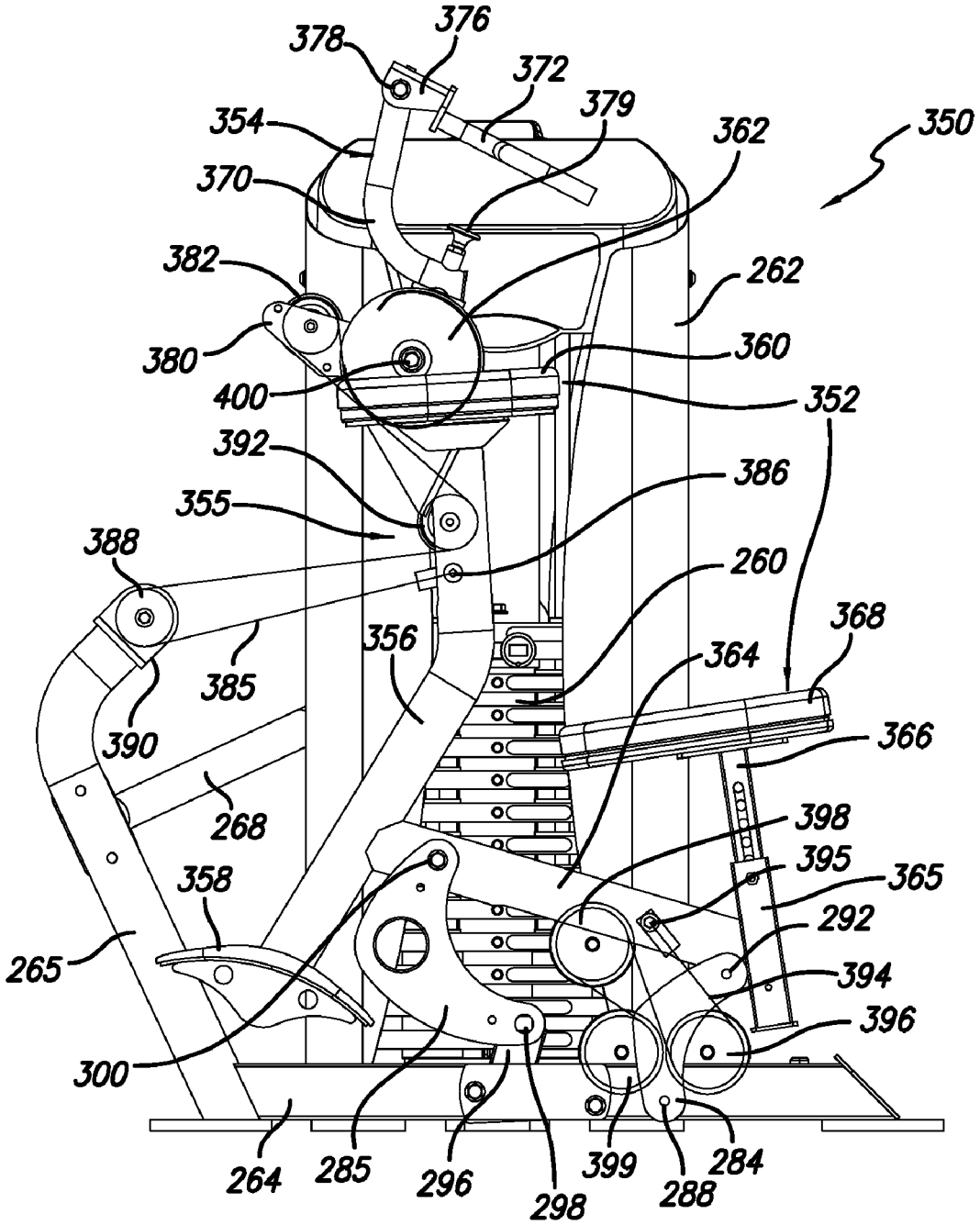
FIG. 22B is a side elevation view similar to FIG. 22A illustrating a finish position for a biceps curl exercise.
Figure 23A:
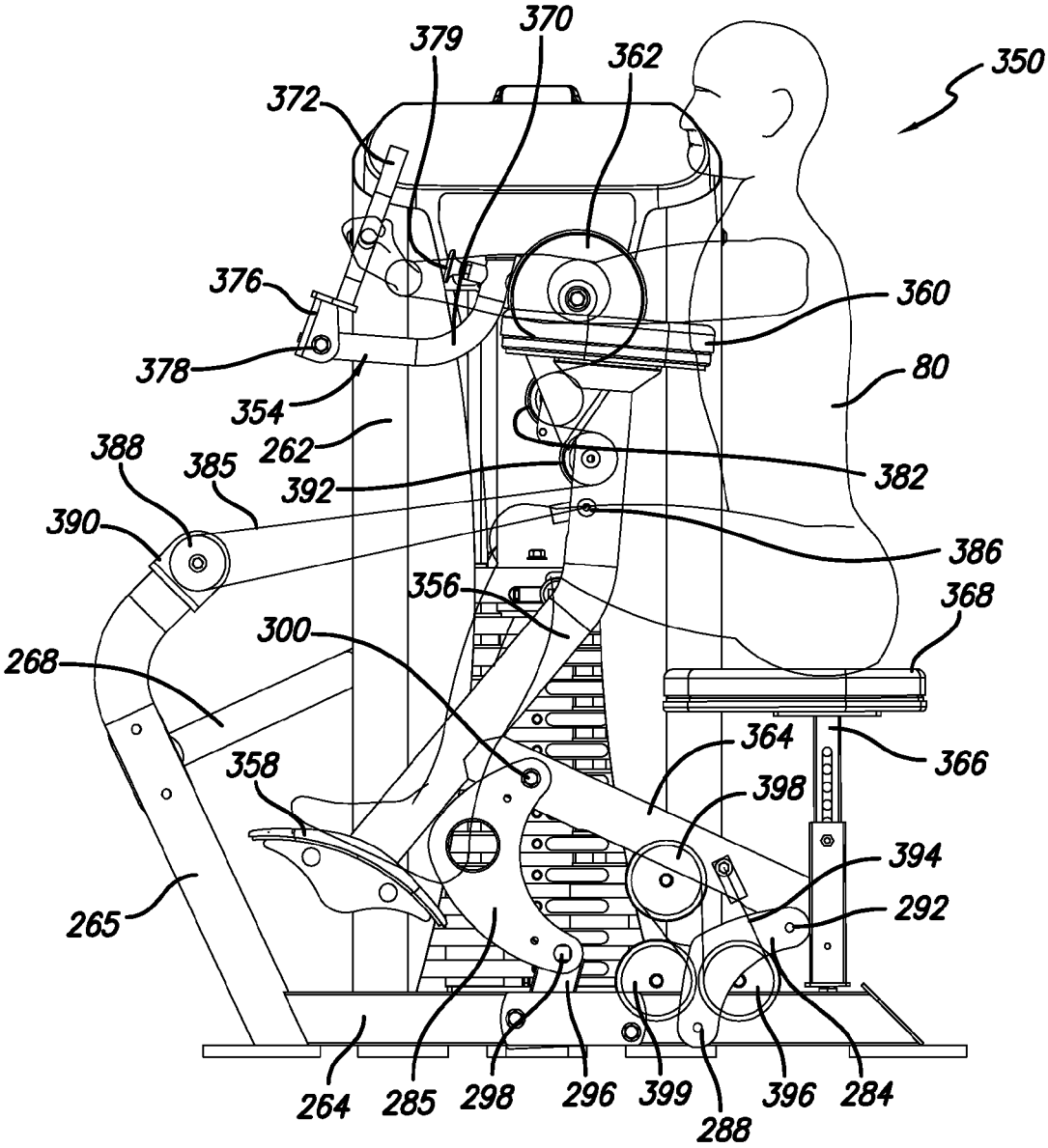
FIG. 23A is a side elevation view similar to FIG. 22A with a user seated on the machine and ready to perform the exercise.
Figure 23B:
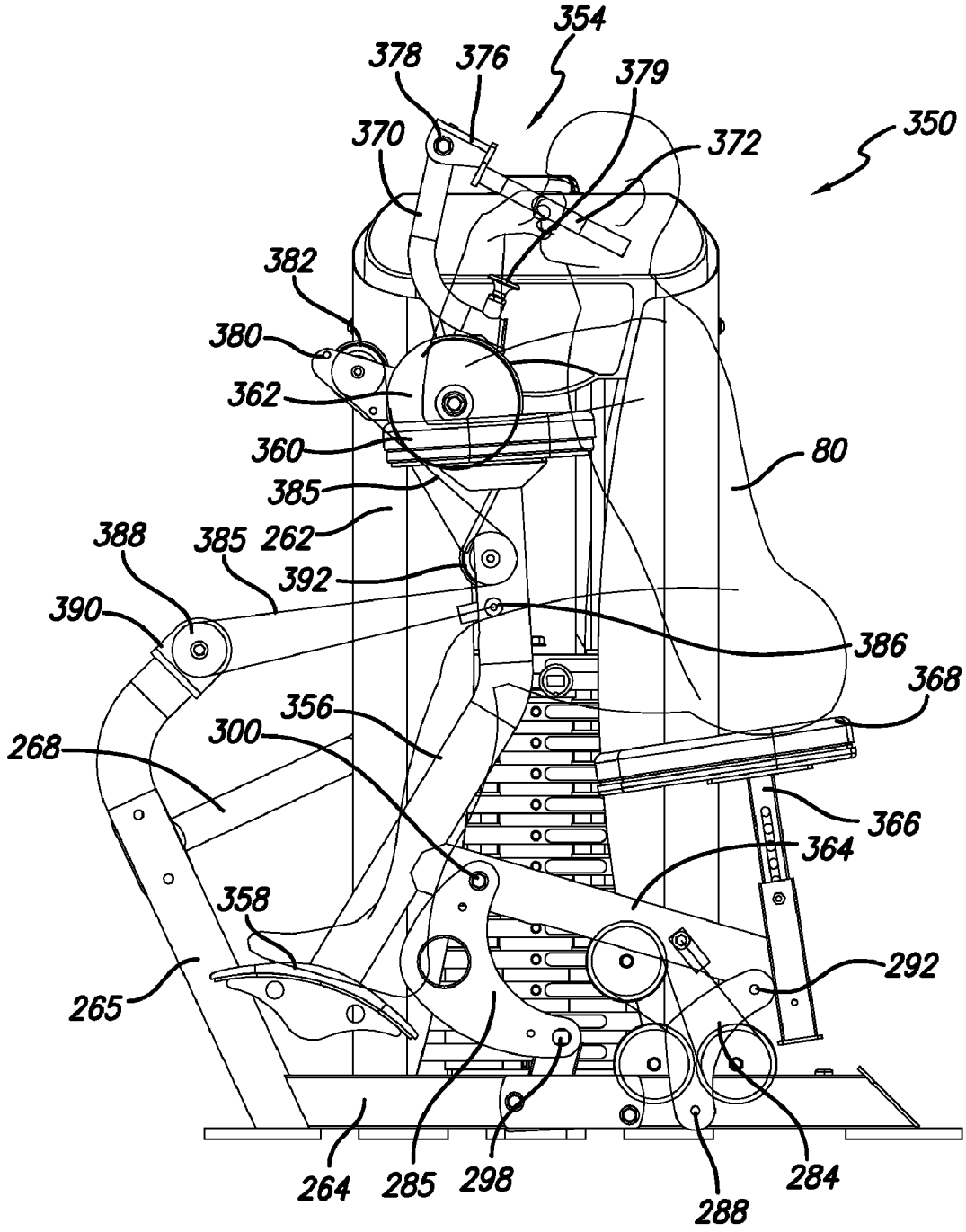
FIG. 23B is a side elevation view similar to FIG. 23A but illustrating a finish position for the biceps curl exercise.

FIGS. 20, 22A, and 23A illustrate the machine 350 configured for performing a biceps curl exercise, with a user 80 shown seated on the machine in FIG. 23A. In order to perform this exercise, the exercise arm assembly 354 is positioned as indicated in FIGS. 20, 22A and 23A, with the main arm 370 extending downward and the handles 372 pivoted into a generally upright, slightly rearward inclined orientation. To perform a biceps curl exercise, the user 80 sits on the seat, places their feet on the foot rests 358 and rests their upper arms on the arm support pad 360. This places the user in a generally upright orientation. They then adjust the exercise arm to extend downward, by pulling lock pin or pull pin 379 out of the aligned opening in cam or ROM plate 374, rotating the exercise arm assembly to the desired start position of FIG. 23A, and then releasing the pin to re-engage in another opening in the cam or ROM plate. The user 80 then grabs the user engaging handles 372 with their arms extending straight and starts the exercise movement by pulling the handle upward, towards their head. This movement causes the exercise arm, cam and cam lever arm to pivot about their connection to the user support at pivot point 400, which pulls the connecting link cable 385 as it wraps around the cam. This causes the user support to pivot about its connection to the main frame, tilting forward and pulling the load bearing cable 394. The rotation continues until the finish position of FIGS. 21, 22B and 23B is reached, with the user's arms bent and their hands adjacent their head.

Figure 24:
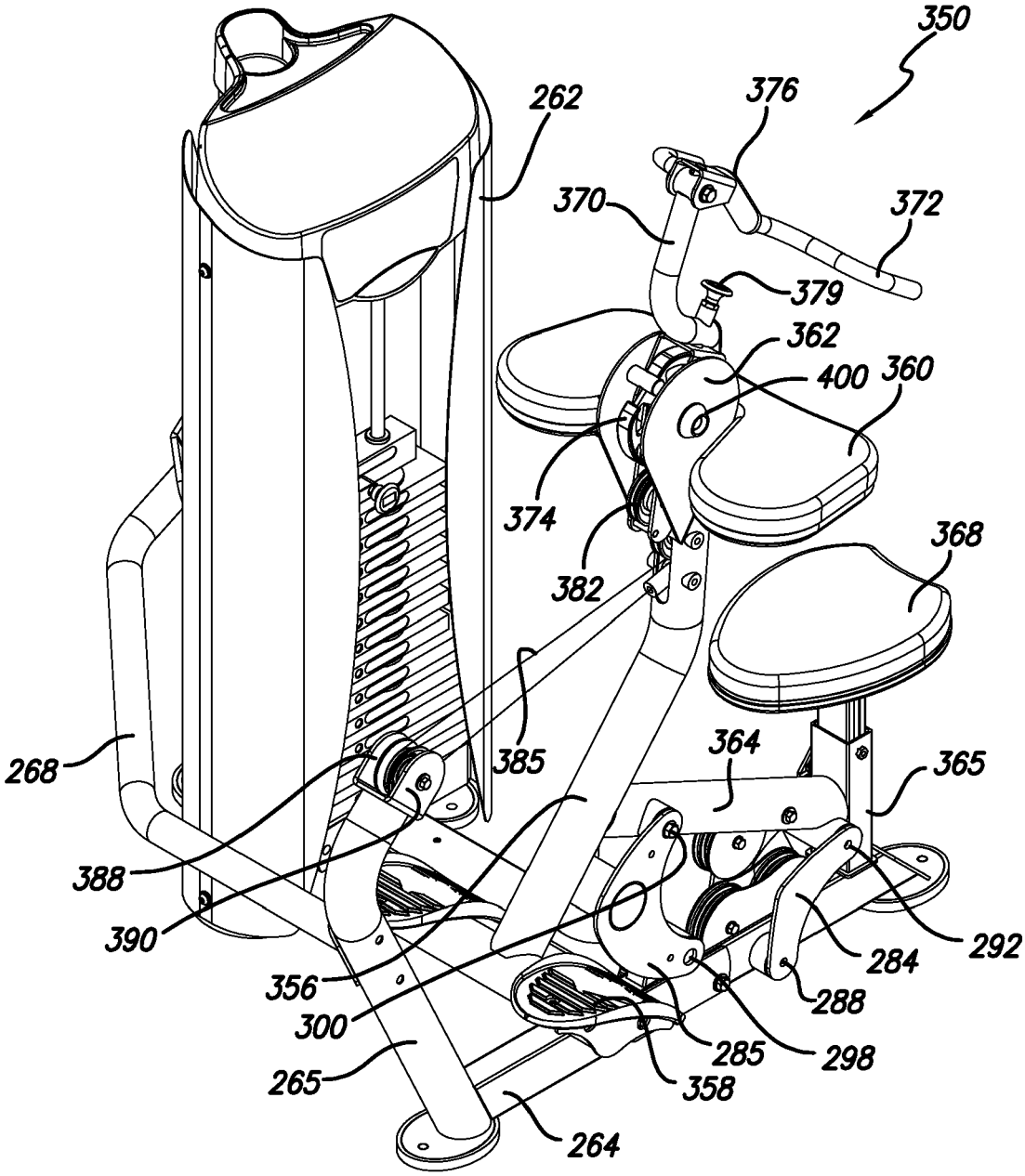
FIG. 24 is a front elevation view of the machine of FIGS. 20 to 23 in a start position for a triceps extension exercise.
Figure 25:
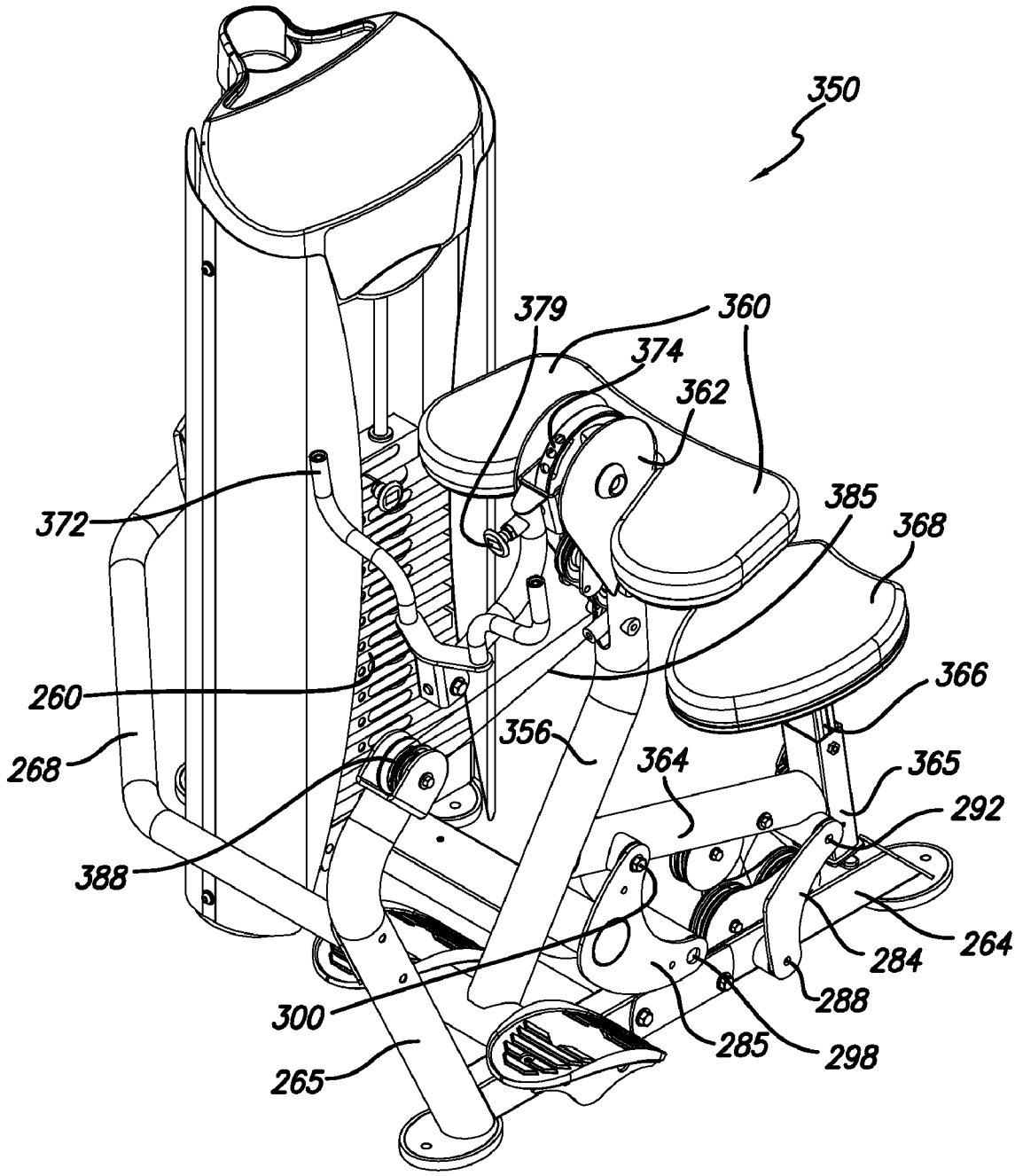
FIG. 25 is a front perspective view of the machine of FIG. 24 in the finish position.
Figure 26A:
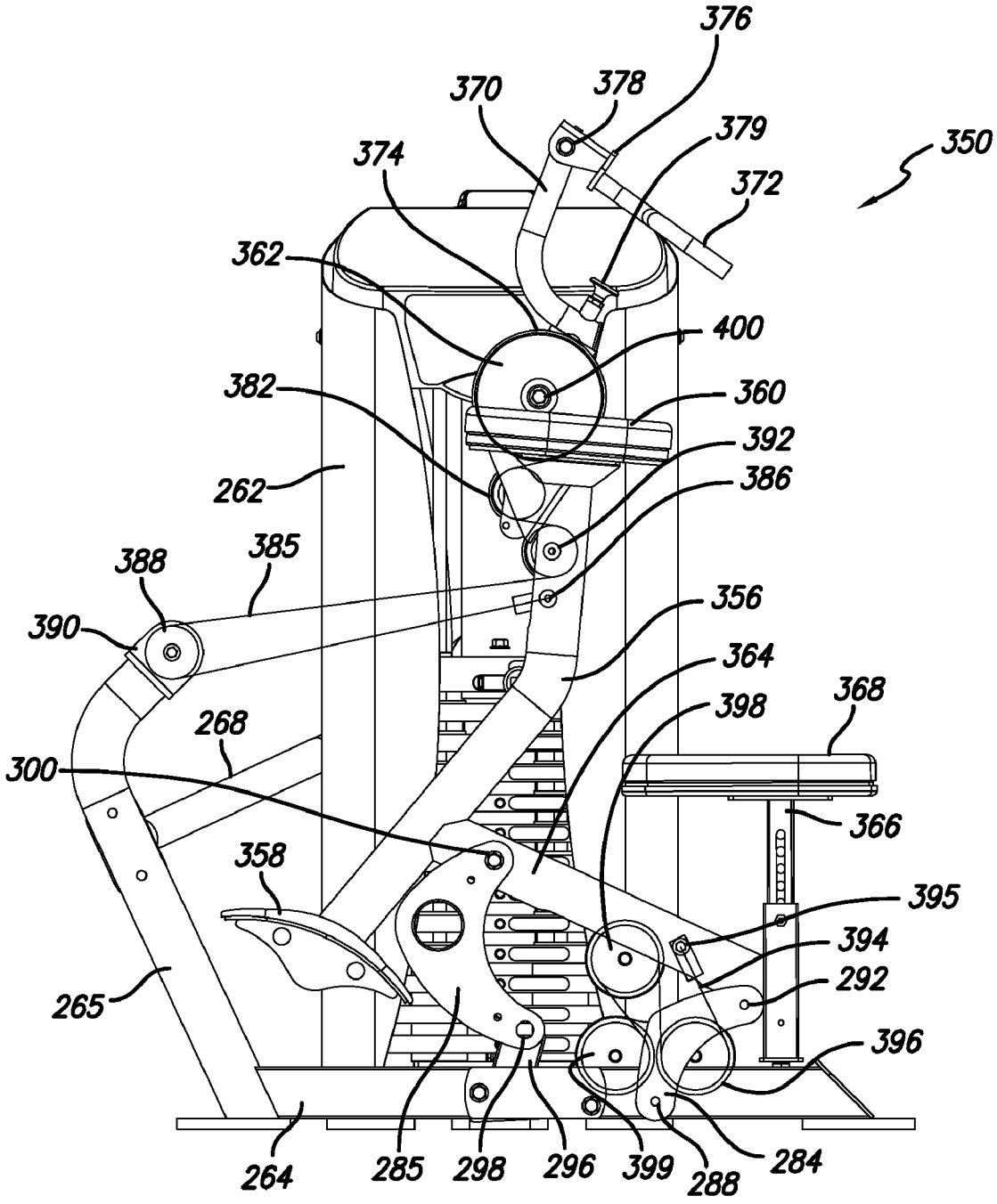
FIG. 26A is a side elevation view illustrating the machine in the start position of FIG. 24 for a triceps extension exercise.
Figure 26B:
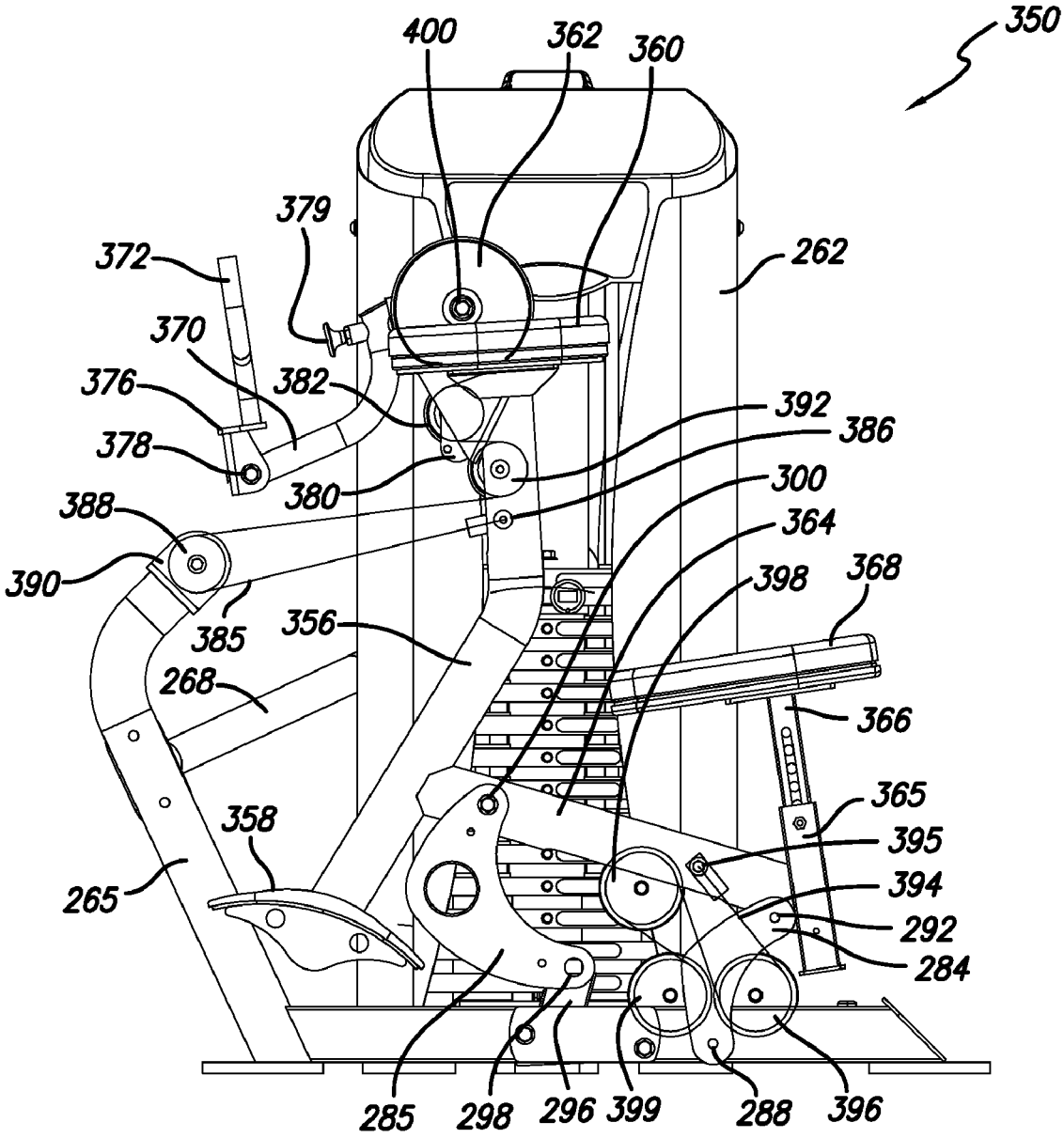
FIG. 26B is a side elevation view similar to FIG. 26A but illustrating the finish position of a triceps extension exercise.
Figure 27A:
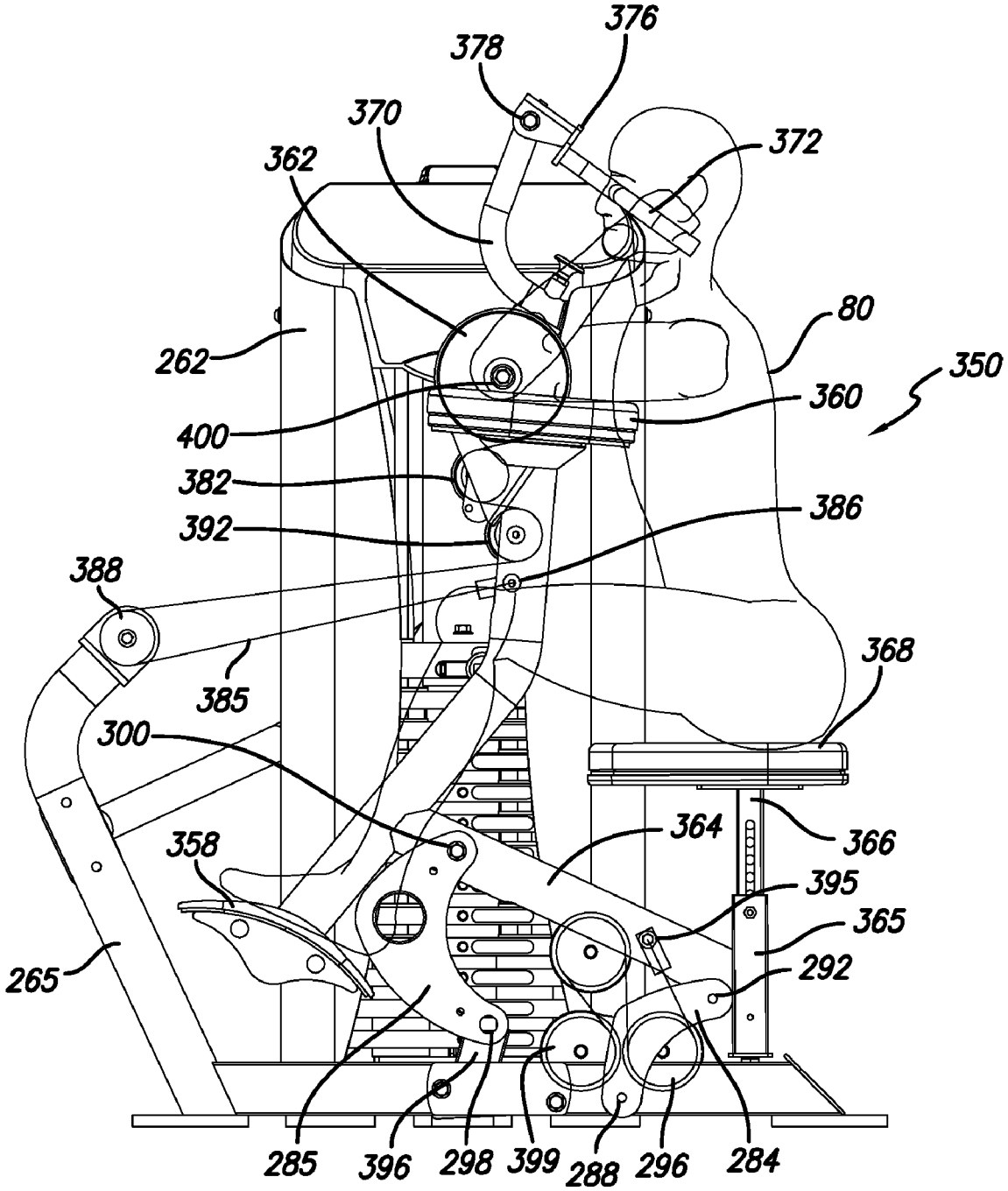
FIG. 27A is a side elevation view of the machine in the position of FIG. 26A but with a user seated on the machine and ready to perform the triceps extension exercise.
Figure 27B:
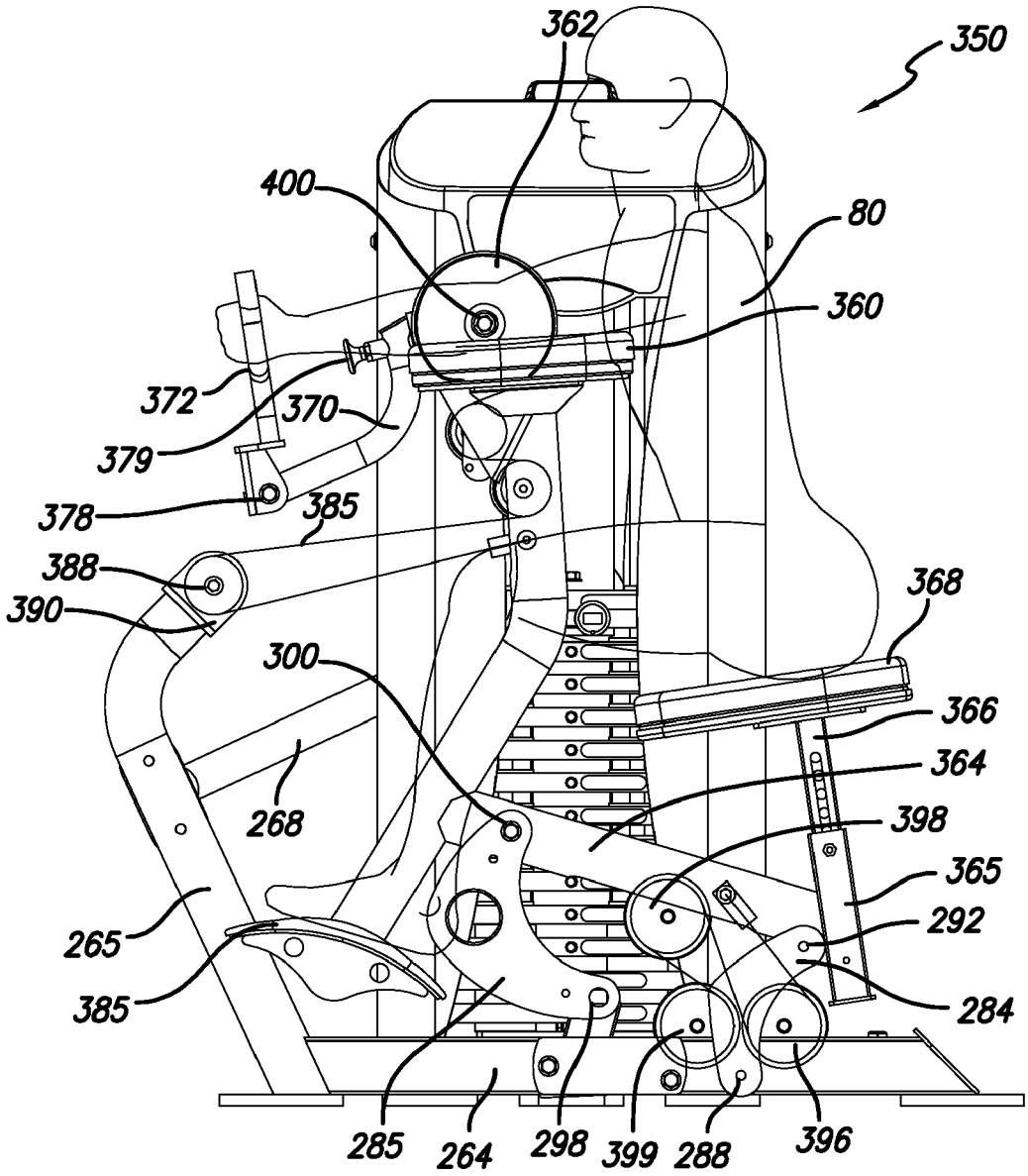
FIG. 27B is a side elevation view similar to FIG. 27A but illustrating a machine and user finish position for a triceps extension exercise.
Figure 28:
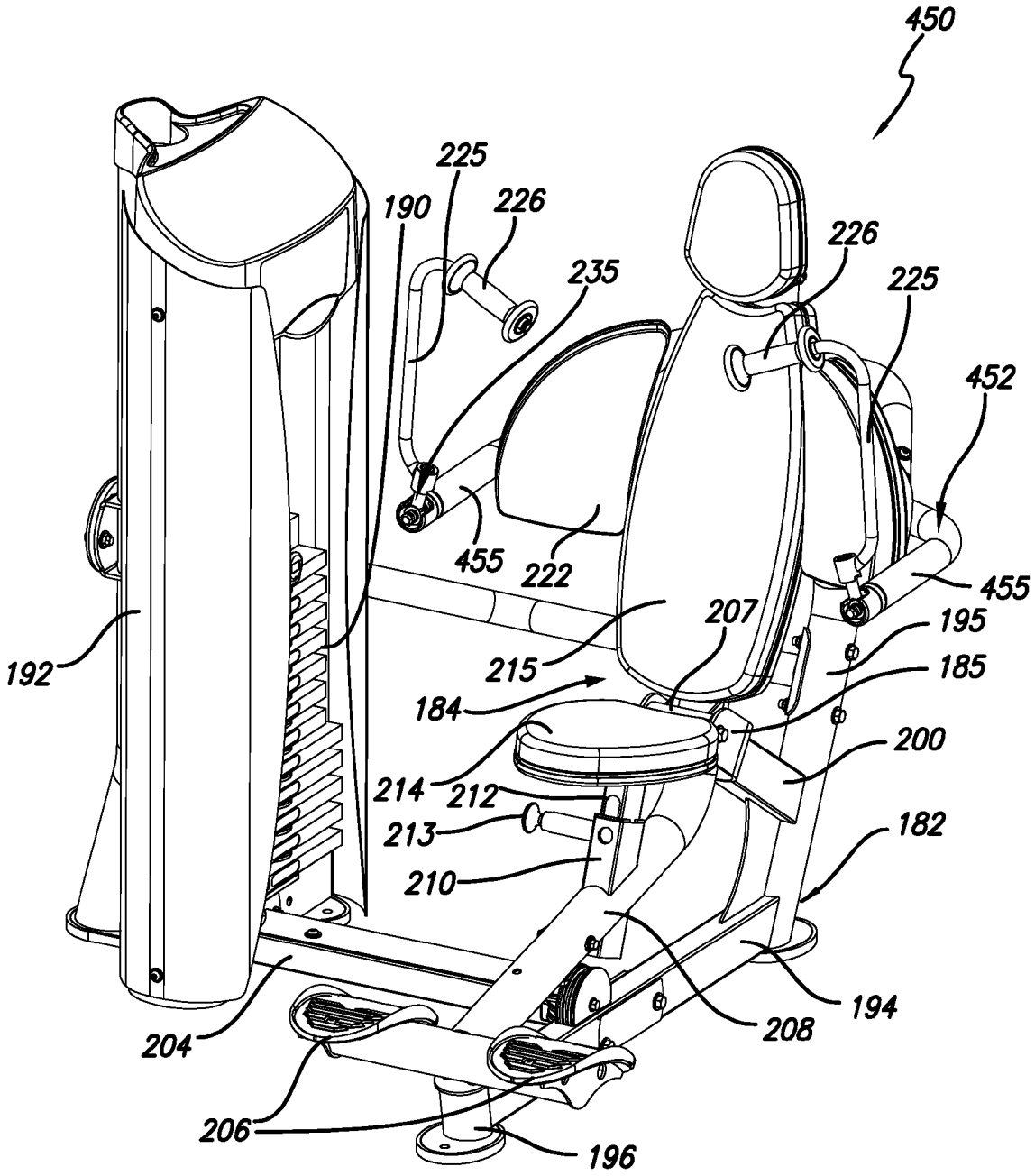
FIG. 28 is a front perspective view of a triceps extension exercise machine according to another embodiment, with the machine in a start position for a triceps extension exercise.
Figure 29:
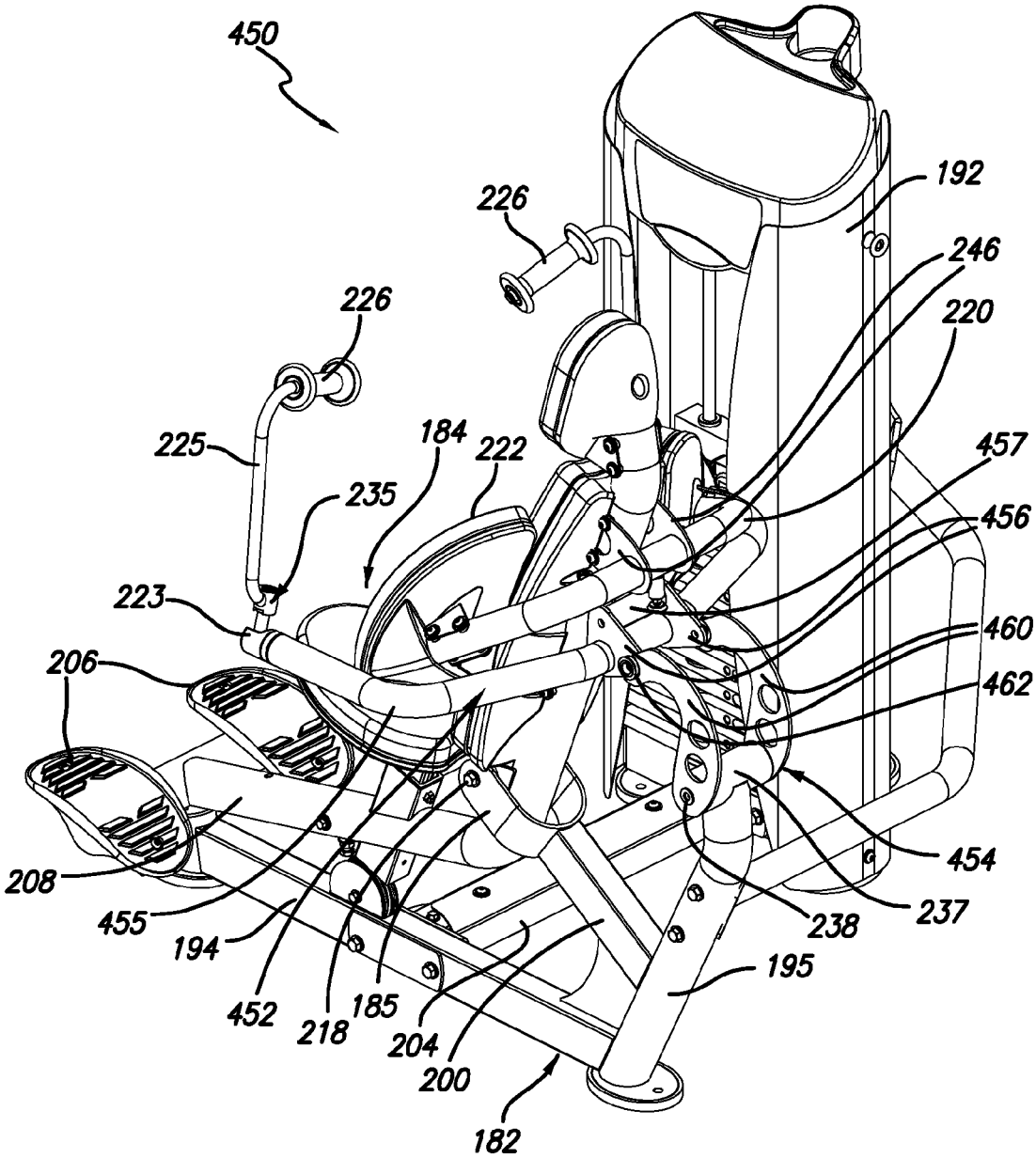
FIG. 29 is a rear perspective view of the machine in the position of FIG. 28.
Figure 30:
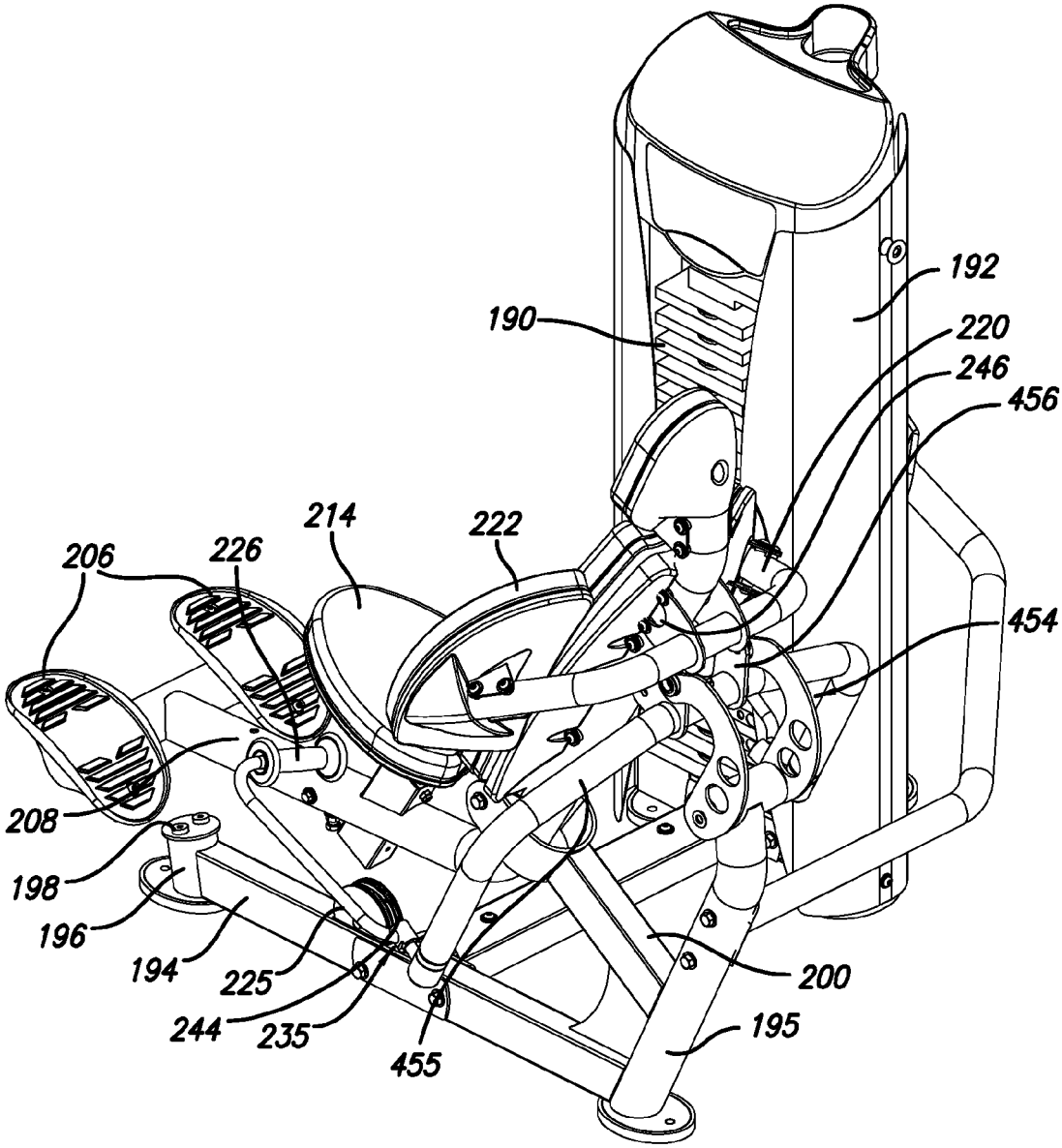
FIG. 30 is a rear perspective view similar to FIG. 29 illustrating a finish position for a triceps extension exercise.
Figure 31:
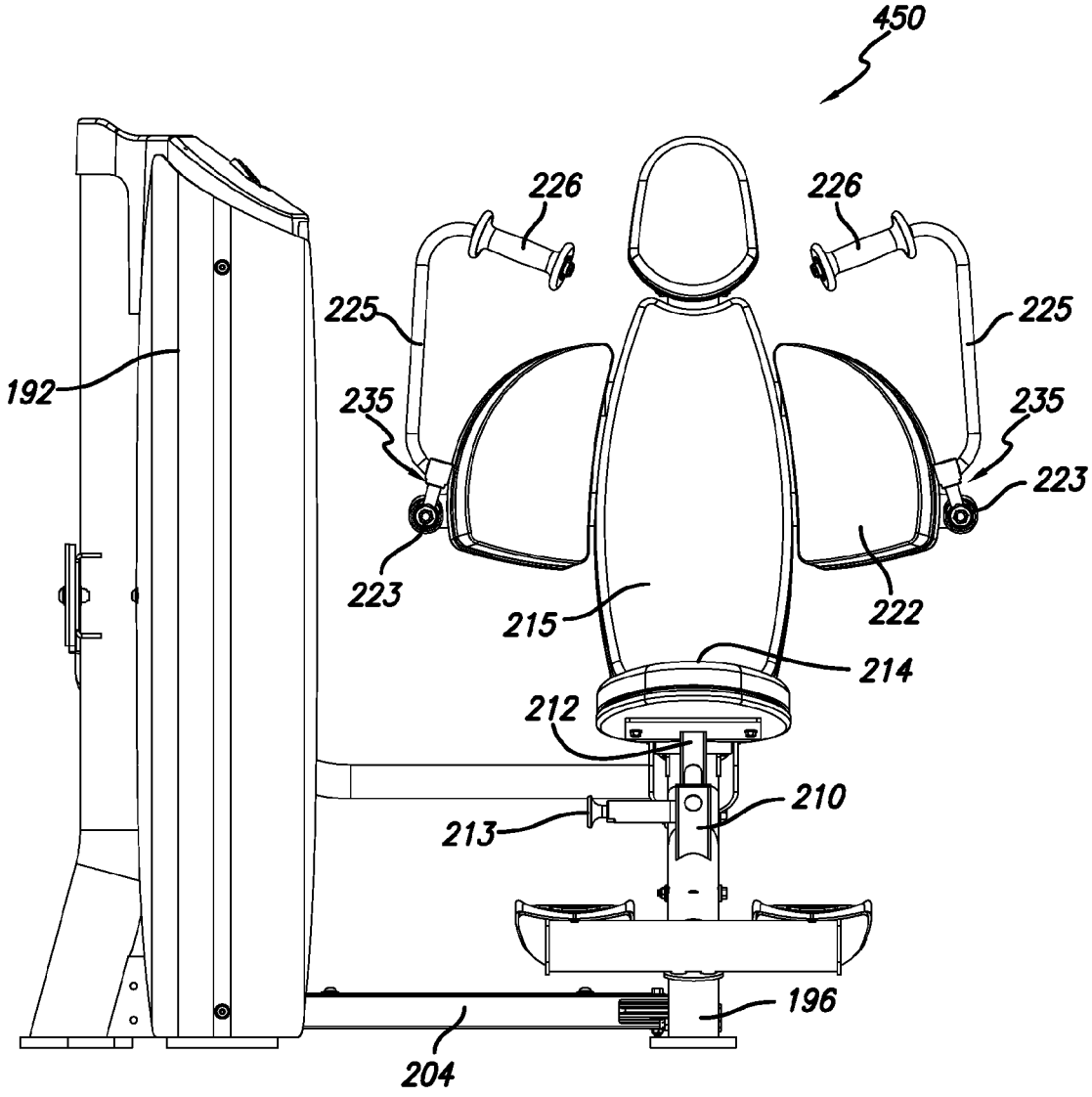
FIG. 31 is a front elevation view of the machine of FIGS. 28 to 30 in a start position.
Figure 32:
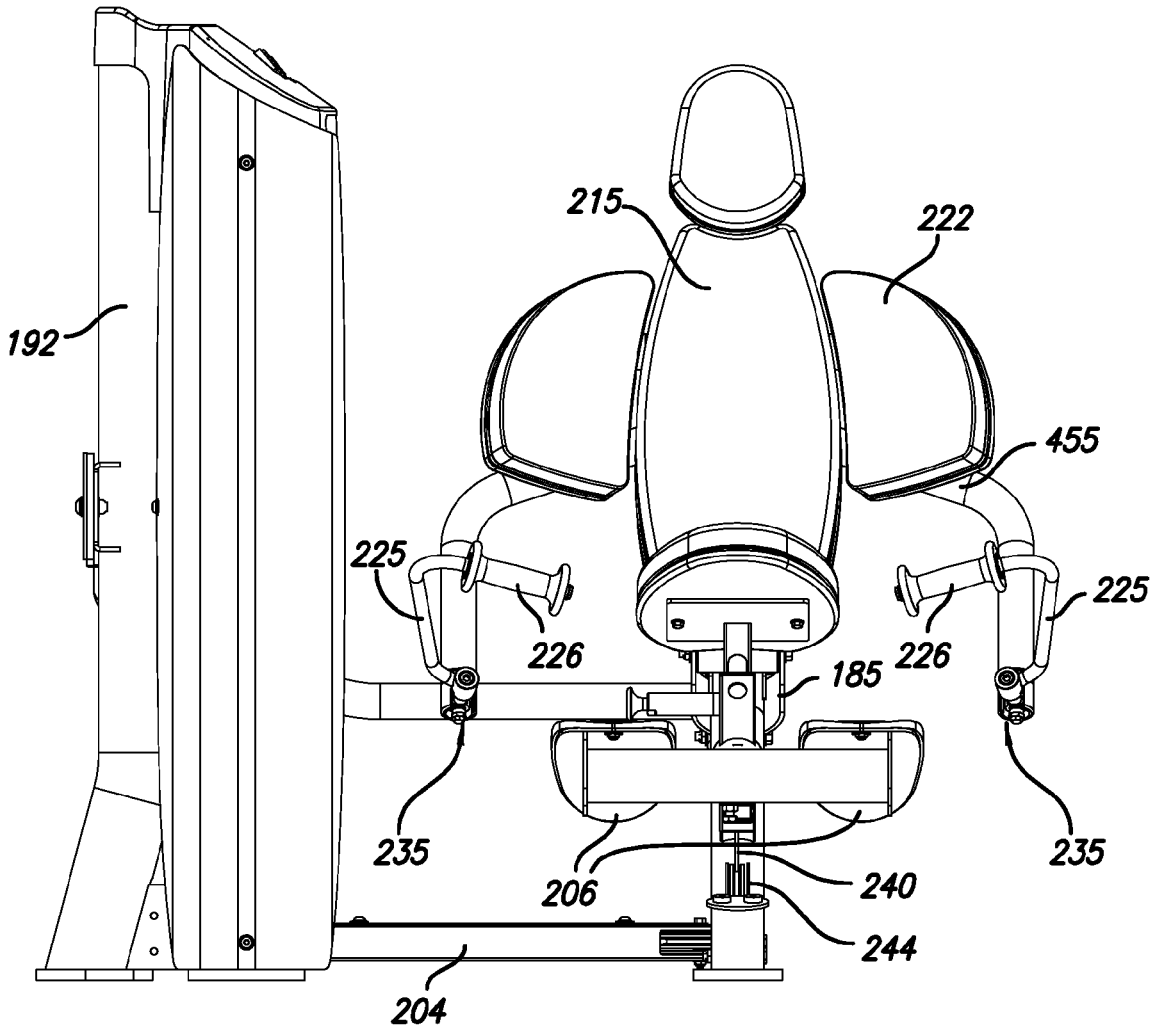
FIG. 32 is a front elevation view of the machine of FIGS. 28 to 30 in a finish position.

FIGS. 24, 26A and 27A illustrate the start position for a triceps extension exercise while FIGS. 25, 26B and 27B illustrate a finish position for this exercise, with a user 80 shown on the machine performing the exercise in FIGS. 27A and 27B. To perform a triceps extension exercise the user simply adjusts the exercise arm to extend upward as illustrated in FIGS. 24, 26A and 27A, using the ROM adjuster mechanism, then grabs the user engaging handles 372 with their arms bent upwardly and rearward, as in FIG. 27A. User 80 starts the exercise movement by pushing the handles 372 downward, away from their head. This movement causes the exercise arm 370 and cam 374 to pivot about pivot axis 400 at their connection to the user support, which pulls the connecting link cable as it wraps around the cam, all of which causes the user support 352 to rotate and pull on load-bearing cable 394. During this movement, cam lever arm 380 does not rotate with the cam.

In the exercise finish position of FIG. 27B, the user has their arm extending straight out in front, and the user support seat has moved from a generally horizontal to a forward inclined orientation, and the user moves from upright to a slight forward lean.

The same user support movement with the four-bar linkage and theoretical pivot are present on this machine as described above in connection with the embodiment of FIGS. 15 to 19, and this movement does not change the position of the user on the user support. Through out the entire "explosive" movement, the user is in a stabilized position with their feet and upper torso supported. This stabilized position provides a strict exercise movement by reducing or eliminating any involvement of other muscle groups and focusing effort just on the biceps or triceps depending on the chosen exercise.

FIGS. 28 to 34 illustrate a triceps extension exercise machine 450 according to another embodiment. This machine is similar to the embodiment of FIGS. 9 to 14, and like reference numerals have been used for like parts as appropriate. The main difference between this machine and the machine 180 of FIGS. 9 to 14 is the exercise arm and connecting link arrangement, which puts the exercise arm in the proper start position for a triceps extension exercise, as discussed in more detail below, and links the exercise arm movement to the user support so as to produce a similar rearward rocking motion to that of machine 180 even though the exercise arm rotates in the opposite direction.

Figure 33A:
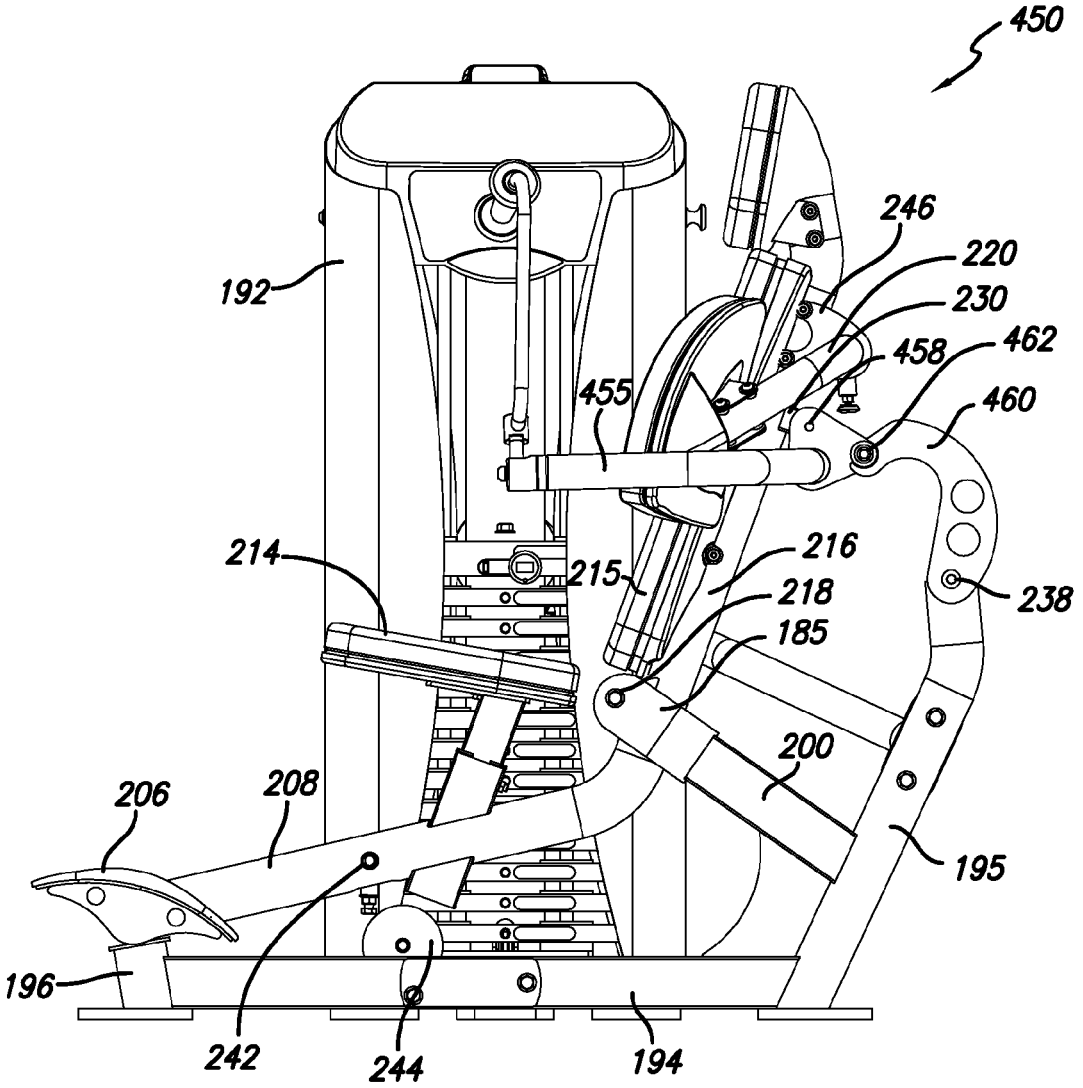
FIG. 33A is a side elevation view of the machine of FIGS. 28 to 32 in a start position for a triceps extension exercise.
Figure 33B:
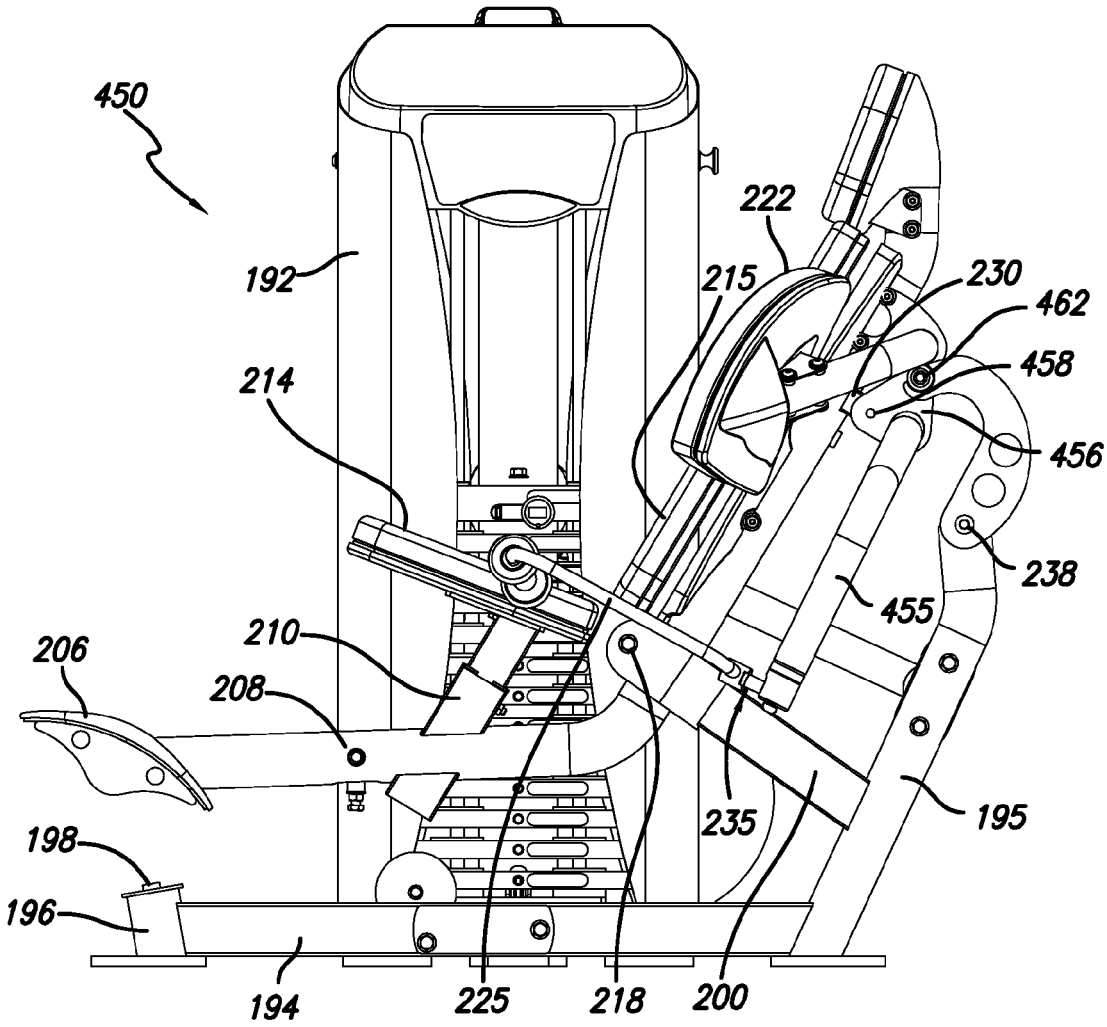
FIG. 33B is a side elevation view of the machine of FIGS. 28 to 32 in a finish position for a triceps extension exercise.
Figure 34A:
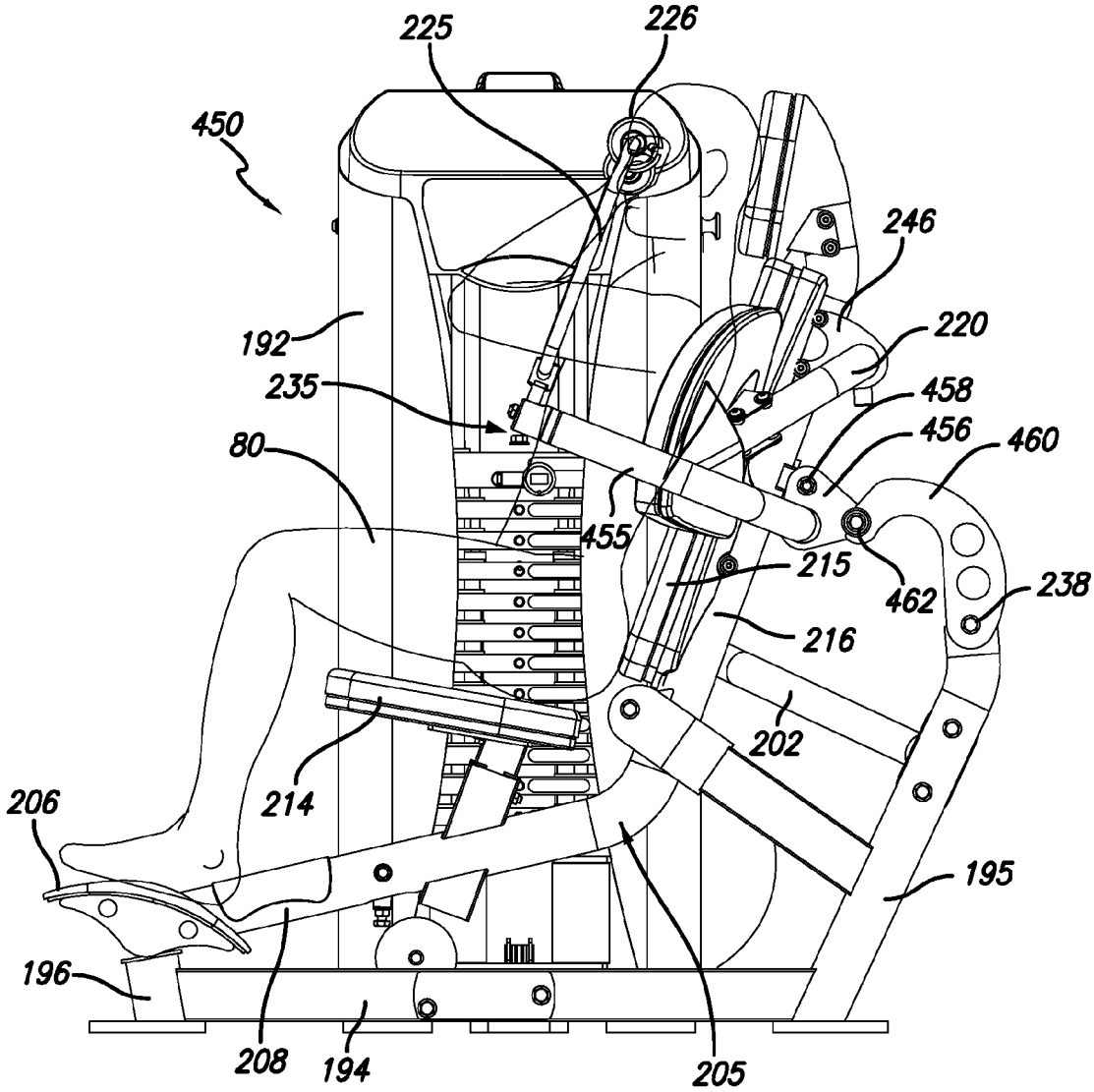
FIGS. 34A and 34B are side elevation views similar to FIGS. 33A and 33B but illustrating a user in position on the machine and performing a triceps extension exercise.
Figure 34B:
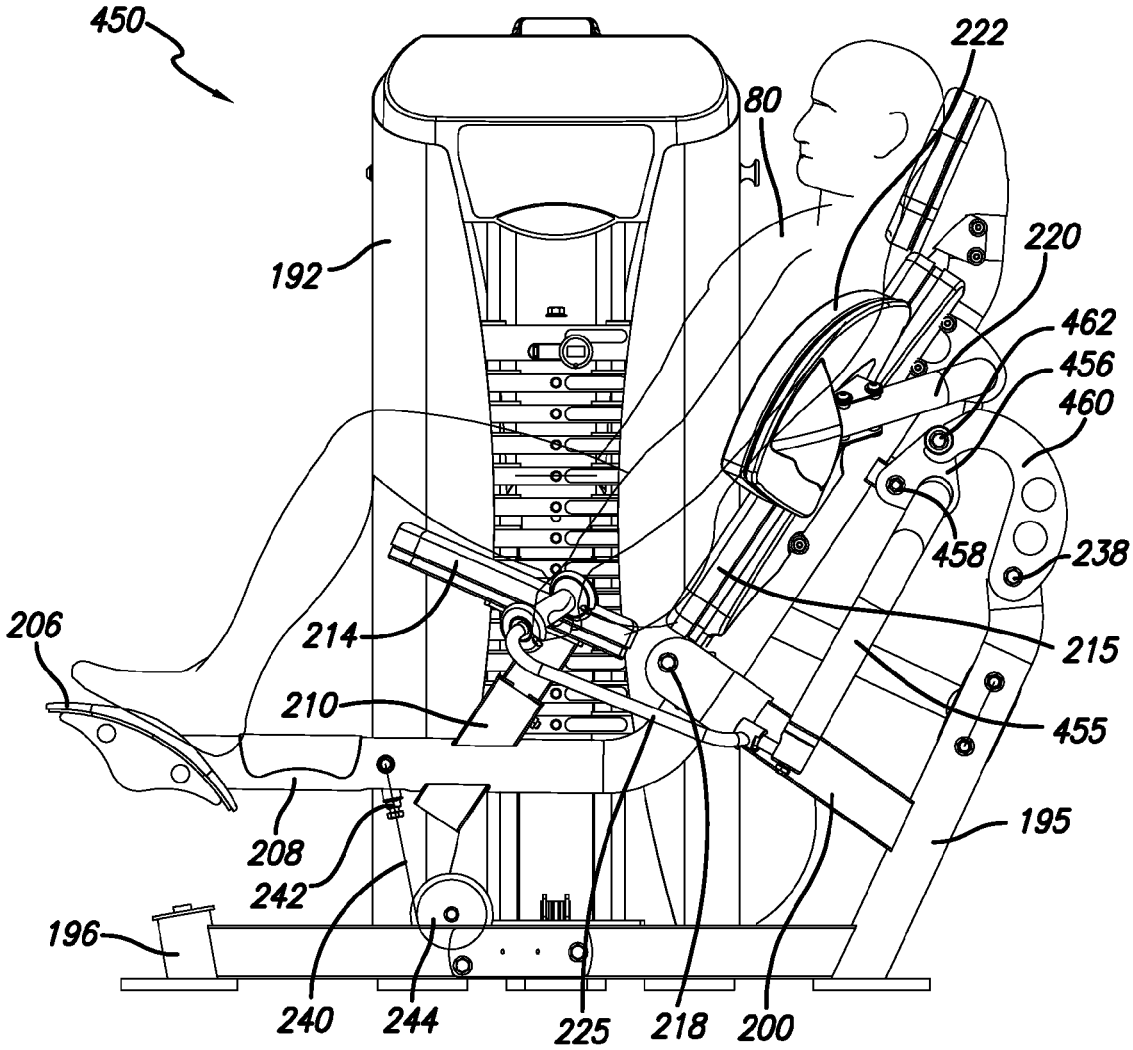

In machine 450, the starting position places the user in a slightly reclined orientation in the start of the exercise (see FIGS. 33A and 34A) and finishes with them in a substantially reclined orientation (see FIGS. 33B and 34B).

Machine 450 has a main frame 182, a user support 184 pivotally mounted on the main frame by means of a pivot bracket 185, an exercise arm assembly 452 pivotally mounted on the user support, a connecting link assembly 454 pivotally connecting the exercise arm assembly to the main frame, and a weight stack 190 housed in a vertical weight stack support frame 192 for providing exercise resistance. The weight stack 190 is linked to the user support by a cable and pulley linkage, part of which is visible in the drawings.

In this embodiment, as in the machine of FIGS. 9 to 14, the main frame has a base section 194 for engaging the floor and an upright tube 195 located at the rearward end of the base section. A stand-off tube 200 is mounted at an intermediate position on rear upright 195 and has a pivot mount 185 associated with its outer end.

The user support 184 has a generally L-shaped seat support tube or frame with foot rests 206 mounted at the end of horizontal leg 208. An adjuster tube 210 is vertically mounted on horizontal leg 208 between the foot rests 206 and the bend in the L shape, and is designed for telescopic adjustment with seat post 212 on which seat pad 214 is mounted. This arrangement accommodates users of different heights by varying the distance between the seat and the user engaging handles of the exercise arm assembly 452. Seat support tube 205 is pivotally attached to pivot bracket 185 via pivot mount 207 for rotation about user support pivot axis 218. A back pad 215 is mounted on the vertical leg 216 of the L-shaped seat support tube, just above pivot axis 218. A pair of downwardly angled arm supports 220 with arm support pads 222 mounted at their respective first ends are fixedly mounted to the upper portion of vertical leg 216 by their respective second ends. A stand-off tube 230 with a second pivot connection is attached to the back side of the vertical leg of the seat support tube, at a location between first pivot connection 218 and the attachment point for arm supports 220.

The handle portions of the exercise arm assembly 452 are identical to those of the embodiment of FIGS. 9 to 14, and like reference numerals have been used for these parts. The exercise arm assembly 452 comprises a generally U-shaped main tube or arm 455 and a pair of user engaging handle arms 225. The main tube 455 has a pivot mount 223 attached at each end of its legs and a pair of connecting brackets 456 located at the central web of the U-shape. The brackets 456 are pivotally mounted on a pivot mount 457 on stand-off 230 on the user support upright leg 216 for rotation about exercise arm pivot axis 458. The two user engaging handle arms 225 are of general "L" shape and have a universal pivot joint 235 associated with the end of their long leg attached to main tube 455 via pivot mount 223. A hand grip 226 for engagement by the user is telescopically mounted over the short leg of each handle arm 225. The telescopic mounting is designed to provide rotational movement for the hand grips on handle arms 225. The universal pivots are designed to enable the user engaging handle arms to self-align to the user during the exercise and automatically adjust to the user's hand position by providing minor adjustments in width positioning and wrist pronation/supination.

The connecting link 454 comprises a pair of generally L-shaped plates 460 having generally rounded edges. One end of each plate is pivotally mounted on pivot mount 237 at the end of main frame upright 195 for rotation about pivot axis 238. The second end of each link plate 460 is pivotally attached to exercise arm connecting brackets 456 for rotation about a second pivot axis 462 which is spaced from the first exercise arm pivot axis 458. It can be seen by comparison of FIG. 33A with FIG. 13A that the exercise arm connecting brackets 456 and connecting link 454 in this embodiment are of similar shape to connecting brackets 228 and connecting link 188 of machine 180, but are inverted relative to the connecting brackets and connecting link in machine 180. Additionally, the exercise arm 455 is rotated through ninety degrees relative to the orientation of exercise arm 224 in machine 180 of the third embodiment. This means that, in the start or rest position of FIGS. 28, 29, 31, 33A and 34A, the opposite side portions of arm 455 project forward from link 456 on opposite sides of back rest 215, instead of extending straight down behind the seat as in machine 180. This means that handle arms 225 are oriented generally upward in the start or rest position. The connecting link pivot axis 462 is also positioned differently relative to the exercise arm pivot axis 458 on the user support.

In this design the user support is pivotally mounted to the main frame via the user support pivot mount 185. The exercise arm is pivotally mounted to the user support by pivotally attaching a first pivot mount of connecting brackets 456 to a pivot connection on the seat support stand-off 230. The connecting link pivotally joins pivot mount 237 on the main frame with a second pivot mount on connecting brackets 456.

In order to perform the exercise, the user 80 sits on the seat with their back against the back pad 215, upper arms against the arm support pads 222 and feet on the foot rests 206. This places the user in a slightly reclined starting position. The user then grabs the user engaging hand grips 226 with their arms bent at the elbow and the handle arms 225 extending generally upwardly at a slight rearward angle, as illustrated in FIG. 34A. The user starts the exercise movement by pushing the handles forward and downward. In this design there is no pivot point for the user to align their elbow with. The universal connection 235 on the user engaging handle arms compensates for this and automatically adjusts to the user arm length and hand position.

This movement causes the exercise arm to pivot about its connections to both the user support and the connecting link at pivot axes 458 and 462. This causes the user support 184 to be pulled rearward, rotating about pivot axis 218 at its connection to the main frame. This pivotal action is designed to reorient the user's position from a slight recline to a substantial recline and duplicate the motion of "cheating" or explosively throwing the weights. This movement is done without changing the position of the user on the user support. Throughout the entire movement the user is in a stabilized position with their feet and upper torso supported. This stabilized position provides a strict exercise movement by preventing the involvement of other muscle groups and focusing effort just on the triceps. As in previous embodiments, the gravitational center line (vertical line extending through user support pivot axis 218) is positioned such that portions of the combined weight of the user and user support are located on both sides of the gravitational center line throughout the exercise movement.

In the above embodiments, the seat and arm support travel together to keep the user in the same position throughout the exercise motion. The user does not have to worry about balancing on a moving platform or pad. The user is placed in an exercise alignment from start to finish. The combined exercise arm and user support movement provide a self-aligning exercise motion that allows the user to achieve a full range of exercise motion and combines traditional exercise machines with free weight movements.

By linking movement of the user support to movement of the exercise arm and positioning the user support pivot so that the combined weight of the user support and user is distributed on both sides of the gravitational centerline, the user support provides a counter-balancing effect on the exercise arm as it moves and its weight is re-distributed. This balanced weight distribution positions a portion of the user and user support on each side of the gravitational centerline in both the start and finish positions. As the exercise arm is moved, a portion of this combined weight passes through the gravitational centerline, re-distributing the weight. This re-distribution is gradual and continuous throughout the exercise motion and is not noticed by the user.

In some of the above embodiments, a four-bar pivot system with a theoretical pivot is used for supporting the user support on the main frame. This arrangement takes the movement pattern of a single point pivot that might normally be located in an area impossible to access due to either structural or user interference and places the pivoting linkage beneath the user support and out of the way of the exercise movement. Without a four-bar pivot system, the desired combined exercise arm and user support movement may not be possible in some machine designs. In other embodiments described above, a single pivot mount connects the user support to the main frame and provides the desired movement of the user support.

The rocking movement of the user support can make the exercise more fun to perform. Repetitious exercise movement can be tedious and boring. By adding motion to the user support, performing the exercise may be enjoyable and the user's interest in their workout may increase. This is a benefit to both the individual user, who may be motivated to exercise more regularly, and the fitness facility, where retention of members is a primary objective.

In the above embodiments, the weight stack and frame can be positioned on either side of the main frame and user support, as desired. The guide tube and connecting rod between the main frame and weight stack frame are releasably connected to one or both frames, and can be removed to allow the weight stack frame to be reversed and placed on the opposite side of the machine. The guide tube and connecting rod are then re-attached and the cable and pulley linkage re-connected.

It should be understood that all the different elements used in the various embodiments may be mixed and interchanged with one another. The arm pads and/or back pad could be made adjustable; various types of user engaging handles could be used; the exercise arm could be unidirectional or bi-directional and may be a rigid exercise arm or a flexible line; the connecting links could be made adjustable, solid links could be replaced with flexible ones; and the connecting links could be made to push or pull to urge rotation of the user support. Any of the various designs could have the resistance associated with any of the moving parts (user support, exercise arm or connecting link).

It should also be noted that different types and forms of components could be used in the above embodiments without affecting the scope of this invention. Cables could be replaced with belts, ropes, chains or the like, pulleys replaced with sprockets, and tubes could be replaced with solid rods or bars. The arm rest, back pad (where present) and/or foot rest could be made adjustable. The foot rest can travel with the user support or be fixed to the frame. Other types of resistance know to the art could by used instead of the weight stack such as weight plates, hydraulic, pneumatic, electromagnetic or elastic band resistance.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An arm exercise machine for performing isolation arm exercises, comprising:

a main frame having a front end and a rear end;

a user support pivotally mounted relative to the main frame and adapted to support a user in an exercise position, the user support moving between a start position and an end position during an exercise movement and having a primary support portion and at least one secondary support portion which are adapted to support spaced positions on a user's body when the user is positioned in the exercise position on the user support and which move together throughout an exercise movement, the primary support portion comprising a seat portion;

at least one user engagement device movably mounted relative to the main frame to move in an isolation exercise path defining an isolation arm movement and having a user engaging portion which is adapted to be engaged by a user positioned on the user support to move the user engagement device in the isolation exercise path;

the secondary support portion comprising spaced left and right arm rest portions adapted to be engaged by parts of the respective left and right arms of a user when the user is positioned in an exercise position on the user support and is moving the user engagement device in the isolation exercise path during an arm exercise;

a connecting link which links movement of the user engagement device to movement of the user support; and a load which resists movement of at least one of the user support, user engagement device, and connecting link.

2. The machine of claim 1, wherein the primary support portion of the user support comprises a seat portion which is adapted to support a user in a generally upright seated position at the start of an exercise.

3. The machine of claim 2, wherein the user support further comprises a backrest portion which is adapted to be engaged by the back of a user seated on the user support and which moves together with the seat portion throughout the exercise movement.

4. The machine of claim 3, wherein the user support further comprises a footrest portion which is adapted to be engaged by the feet of a user seated on the user support and which moves together with the seat and back rest portions throughout the exercise movement.

5. The machine of claim 2, wherein the seat portion is reclined rearward relative to the start position in the end position of the user support.

6. The machine of claim 2, wherein the seat portion is inclined forward relative to the start position in the end position of the user support.

7. The machine of claim 2, wherein the user support further comprises a leg support.

8. The machine of claim 1, wherein the arm rest portions are located at a forward portion of the user support and the user engagement device is pivotally linked to the user support at the arm rest portions and extends forward from the arm rest portions.

9. The machine of claim 1, wherein the user engagement device is linked to the user support to the rear of the primary support portion and has first and second side portions extending forward on opposite sides of the user support, the user engaging portion comprising a first handle located on the first side portion and a second handle located on the second side portion.

10. The machine of claim 9, wherein the connection between the user engagement device and the user support is a pivotal connection.

11. The machine of claim 9, wherein the first and second side portions and handles are configured for three dimensional movement of the user's hands during an exercise.

12. The machine of claim 1, wherein the user engagement device comprises at least one exercise arm movably mounted relative to the main frame for movement between a start position and an end position during an exercise movement, the user engaging portion comprising at least one handle which is adapted to be engaged by a user positioned on the user support, the handle positioned in a first position at the start of the isolation exercise movement and a second position at the end of the isolation exercise movement, the first position of the handle defining a predetermined starting orientation of the user's arm at the start of an isolation arm exercise.

13. The machine of claim 12, wherein the exercise arm has a main arm portion which is pivotally linked to the user support for rotation about a first arm pivot axis, and at least one handle portion associated with the main arm portion.

14. The machine of claim 13, wherein said one handle portion is pivotally linked to the main arm portion.

15. The machine of claim 12, wherein the exercise arm is bidirectional.

16. The machine of claim 15, further comprising a pivot connection between the exercise arm and user support which includes a ROM adjuster for adjustment of the handle start position between a first start position for performing a biceps curl exercise and a second start position for performing a triceps extension exercise.

17. The machine of claim 1, further comprising a user support pivot mount comprising a four bar linkage between the user support and main frame, the four bar linkage configured to produce pivotal movement of the user support about a predetermined theoretical pivot axis.

18. The machine of claim 17, wherein the main frame has a floor-engaging base portion and the theoretical pivot axis is located below the base portion.

19. The machine of claim 1, wherein the connecting link has a first pivot connection to the user engagement device and a second pivot connection to the main frame.

20. The machine of claim 1, wherein the connecting link comprises a multi-part pivot linkage between the user support, main frame, and user engagement device.

21. The machine of claim 1 wherein the connecting link is a flexible link.

22. The machine of claim 1, wherein the user support is pivotally mounted relative to the main frame for rotation about a user support pivot axis defining a vertical gravitational center line of the pivotal movement of the user support, the user support pivot axis being positioned at a predetermined location such that portions of the combined weight of the user and user support are distributed on each side of the gravitational center line at the start and end of the exercise movement.

23. The machine of claim 22, wherein more of the combined weight is located forward of the gravitational center line at the start of the exercise movement than at the end of the exercise movement.

24. The machine of claim 22, wherein more of the combined weight is located forward of the gravitational center line at the end of the exercise movement than at the start of the exercise movement.

25. The machine of claim 1, further comprising a user support pivot mount pivotally mounting the user support frame relative to the main frame, the pivot mount having at least one pivot axis.

26. The machine of claim 1, wherein the user engaging portion of the user engagement device comprises at least one handle which self-aligns to the user's hand movement during an exercise.

27. The machine of claim 26, wherein the handle has a rotating grip.

28. The machine of claim 26, wherein the user engagement device comprises at least one exercise arm and the handle is pivotally connected to the exercise arm for self-aligning movement to align to the user's hand movement during an exercise.

29. The machine of claim 1, wherein the primary and secondary support portions are fixed relative to one another and move together in the same relative orientation to one another throughout the exercise movement.

30. The machine of claim 1, wherein the user support further comprises at least one additional support portion which supports a different part of a user's body from the primary and secondary support portions and which moves together with the primary and secondary support portions during an exercise.

31. The machine of claim 1, wherein the user support is pivotally mounted relative to the main frame for rotation about a user support pivot axis defining a vertical gravitational center line of the pivotal movement of the user support, the user support pivot axis being positioned at a predetermined location such that portions of the combined weight of the user and user support are distributed on each side of the gravitational center line in at least one of the start and end positions of the exercise movement.

32. The machine of claim 1, wherein the user engagement device moves relative to the main frame and user support in an exercise path corresponding to a biceps curl or triceps extension exercise.

33. The machine of claim 1, wherein movement of the user engagement device in the isolation arm exercise path requires action of only one arm joint of one or both of the user's arms.

34. The machine of claim 1, wherein the secondary support portion comprises a single arm support pad located at a forward portion of said user support and having left and right side portions comprising said left and right arm rest portions.

35. An arm exercise machine for performing isolation arm exercises, comprising:

a main frame having a front end and a rear end;

a user support pivotally mounted relative to the main frame which is adapted to support a user in an exercise position, the user support moving between a start position and an end position during an exercise movement and having a primary support portion and at least one secondary support portion which are adapted to be engaged by spaced positions on a user's body when positioned on the user support and which move together throughout an exercise movement;

at least one user engagement device movably mounted relative to the main frame to define an exercise path corresponding to an isolation arm exercise and having first and second side portions extending forward on opposite sides of the user support, a first handle located on the first side portion and a second handle located on the second side portion which are adapted to be engaged by a user's hands to move the user engagement device in the isolation arm exercise path when the user is positioned on the user support;

a connecting link which links movement of the user engagement device to movement of the user support;

a load which resists movement of at least one of the user support, user engagement device, and connecting link; and a pair of arm rest pads on opposite sides of the user support which are adapted to be engaged by the user's upper arms when the user is positioned on the user support, the arm rest pads being adapted to support the upper arms of a user positioned on the user support throughout an exercise as the handles are moved in the isolation arm exercise path.

36. An arm exercise machine for performing isolation arm exercises, comprising:

a main frame having a front end and a rear end;

a user support pivotally mounted relative to the main frame and adapted to support a user in an exercise position, the user support moving between a start position and an end position during an exercise movement and having a primary support portion, a secondary support portion, and an additional support portion which are adapted for engagement by spaced positions on the body of a user positioned on the user support and which move together throughout an exercise movement;

at least one user engagement device movably mounted relative to the main frame to define an exercise path corresponding to an isolation arm exercise and having a user engaging portion which is adapted for engagement by a user positioned on the user support to move the user engagement device in the isolation arm exercise path;

a connecting link which links movement of the user engagement device to movement of the user support;

a load which resists movement of at least one of the user support, user engagement device, and connecting link;

the additional support portion comprising at least one arm rest adapted for engagement by the upper part of an arm of a user positioned on the user support during an exercise while the user's forearm moves with the user engagement device in the isolation arm exercise path; and the primary support portion comprising a seat and the secondary support portion comprising a back rest separate from said arm rest.

37. An arm exercise machine for performing isolation arm exercises, comprising:

a main frame having a front end and a rear end;

a user support pivotally mounted relative to the main frame and adapted to support a user in an exercise position on the user support, the user support moving between a start position and an end position during an exercise movement, the user support having a primary support portion and at least one secondary support portion which are adapted to support spaced positions on a user's body when the user is positioned on the user support and which move together throughout an exercise movement;

the user support further comprises at least first and second additional support portions which are each adapted to be engaged by a different part of a body of a user positioned on the user support from the primary and secondary support portions and which move together with the primary and secondary support portions during an exercise;

the first additional support portion comprising a back rest;

the second additional support portion comprising an arm rest which is adapted to engage part of a user's arm during an exercise;

at least one user engagement device movably mounted relative to the main frame to define an exercise path corresponding to an isolation arm exercise and having a user engaging portion which is adapted to be engaged by a user positioned on the user support to move the user engagement device in the isolation arm exercise path;

a connecting link which links movement of the user engagement device to movement of the user support; and a load which resists movement of at least one of the user support, user engagement device, and connecting link.

38. An arm exercise machine for performing isolation arm exercises, comprising:

a main frame having a front end and a rear end;

a user support pivotally mounted relative to the main frame to support a user in an exercise position and moving between a start position and an end position during an exercise movement, the user support having a primary support portion and a secondary support portion which are adapted to be engaged by spaced positions on a user's body excluding the user's arms when a user is supported on the user support, and a pair of arm support portions which are adapted to be engaged by parts of the user's arms when a user is positioned on the user support during an exercise movement, the primary, secondary, and aim support portions moving together throughout an exercise movement;

at least one user engagement device movably mounted relative to the main frame and having first and second side portions, each side portion defining at least one isolation arm exercise path, a first handle located on the first side portion and a second handle located on the second side portion which are adapted to be engaged by a user's hands when a user is supported in an exercise position on the user support to move the first and second side portions of the user engagement device in respective isolation arm exercise paths;

a connecting link which links movement of the user engagement device to movement of the user support; and a load which resists movement of at least one of the user support, user engagement device, and connecting link.

39. The machine of claim 38, wherein the arm support portions comprise left and right arm rest pads which support an upper part of the user's left and right arm, respectively, in a stable position while the user's left and right forearms move with the user's hands gripping the respective handles from the first position to the second position.

40. The machine of claim 38, further comprising a single arm support pad located at a forward portion of said user support and having left and right side portions comprising said arm support portions.

* * * * *